US012208305B2

(12) United States Patent
Kordecki

(10) Patent No.: US 12,208,305 B2
(45) Date of Patent: Jan. 28, 2025

(54) MULTI-FUNCTION, COLLAPSIBLE EXERCISE APPARATUS FOR PERFORMING A GLUTEAL BRIDGE EXERCISE AND FLAT BENCH EXERCISES

(71) Applicant: Kormel LLC, Vernon Hills, IL (US)

(72) Inventor: Michael Kordecki, Vernon Hills, IL (US)

(73) Assignee: Kormel, LLC, Vernon Hills, IL (US)

( * ) Notice: Subject to any disclaimer, the term of this patent is extended or adjusted under 35 U.S.C. 154(b) by 159 days.

(21) Appl. No.: 18/080,066

(22) Filed: Dec. 13, 2022

(65) Prior Publication Data

US 2023/0111117 A1 Apr. 13, 2023

Related U.S. Application Data

(63) Continuation of application No. PCT/US2021/037219, filed on Jun. 14, 2021.
(Continued)

(51) Int. Cl.
*A63B 22/00* (2006.01)
*A63B 21/00* (2006.01)
*A63B 21/055* (2006.01)

(52) U.S. Cl.
CPC ..... *A63B 22/0023* (2013.01); *A63B 21/4033* (2015.10); *A63B 21/0552* (2013.01);
(Continued)

(58) Field of Classification Search
CPC ..... A63B 22/0023; A63B 21/4033; A63B 2210/50; A63B 21/0552; A63B 2225/09;
(Continued)

(56) References Cited

U.S. PATENT DOCUMENTS 6,955,635 B2 * 10/2005 Chelekis ..... A63B 21/0004 482/140
7,044,898 B2 * 5/2006 Kuo ..... A63B 21/4035 482/121

(Continued)

FOREIGN PATENT DOCUMENTS

CA 2194334 A1 * 1/1997 ..... A63B 23/12
WO WO-2016115254 A1 * 7/2016 ..... A63B 21/00065

*Primary Examiner* — Sundhara M Ganesan
(74) *Attorney, Agent, or Firm* — Barnes & Thornburg LLP

(57) ABSTRACT

A collapsible exercise apparatus is configured to allow a user to perform a gluteal bridge movement or flat bench exercises. In its ready to use position, the exercise apparatus allows a person to properly perform a gluteal bridge movement on a repeated basis. Resistance can be applied to the gluteal bridge movement where the resistance increases the amount of work to be performed by the person during the exercise. The exercise apparatus includes a frame assembly with a support member that extends from a lower frame member. A bench assembly is pivotally connected to the support member to provide an elevated pivot point about which the bench assembly pivots when a user performs the gluteal bridge movement. A stabilization assembly includes a front locking member operably connected to the frame assembly, a front retaining mechanism operably connected to the bench assembly, a rear locking mechanism operably connected to the frame assembly, and an upper retaining mechanism operably connected to the bench assembly. The front locking member, the front retaining mechanism, the rear locking mechanism, and the upper retaining mechanism are configured to place the bench in a flat bench position whereupon the user can perform various flat bench exercises. The exercise apparatus can also be placed in a low-profile, collapsed positon where the apparatus can be stored when not in use.

20 Claims, 78 Drawing Sheets

Related U.S. Application Data

(60) Provisional application No. 63/115,929, filed on Nov. 19, 2020, provisional application No. 63/038,338, filed on Jun. 12, 2020.

(52) U.S. Cl.
CPC ..... *A63B 21/4031* (2015.10); *A63B 2210/50* (2013.01); *A63B 2225/09* (2013.01); *A63B 2225/093* (2013.01); *A63B 2225/10* (2013.01)

(58) Field of Classification Search
CPC ..... A63B 2225/093; A63B 2225/10; A63B 21/4031
See application file for complete search history.

(56) References Cited

U.S. PATENT DOCUMENTS

| | | | | |
|---|---|---|---|---|
| 7,137,934 | B2 * | 11/2006 | Paramater | A63B 21/159 482/130 |
| 8,465,403 | B2 * | 6/2013 | McCall, Jr. | A63B 23/0205 482/148 |
| 9,474,923 | B2 * | 10/2016 | Davenport | A63B 21/4023 |
| 9,737,750 | B2 * | 8/2017 | Garcia Lopez | A63B 21/0442 |
| 2002/0094918 | A1 * | 7/2002 | Gerschefske | A63B 21/4029 482/92 |
| 2017/0056708 | A1 * | 3/2017 | Kelly | A63B 23/0233 |
| 2017/0304677 | A1 * | 10/2017 | Clinton | A63B 21/4047 |
| 2018/0001131 | A1 * | 1/2018 | Nevarez, Jr. | A63B 21/068 |
| 2018/0326258 | A1 * | 11/2018 | Kordecki | A63B 21/4031 |
| 2019/0111302 | A1 * | 4/2019 | Ballestero | A63B 23/0211 |
| 2020/0338391 | A1 * | 10/2020 | Hall | A63B 21/0724 |

* cited by examiner

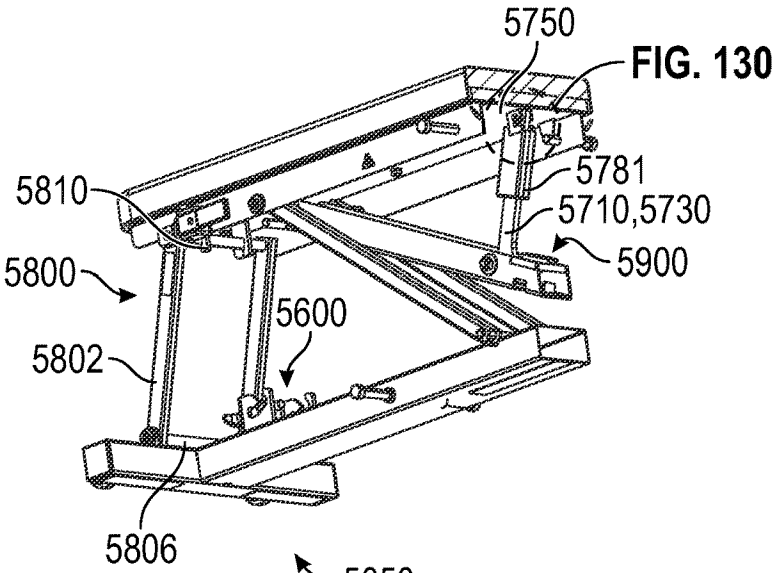
FIG. 130
FIG. 129
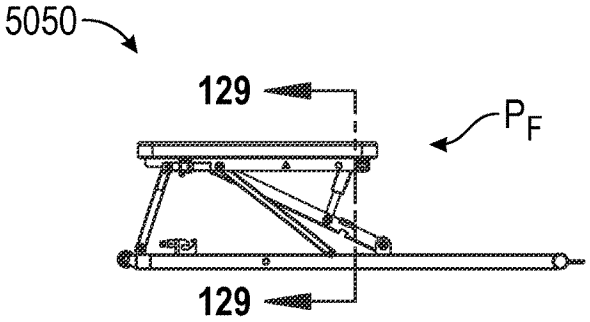
FIG. 128
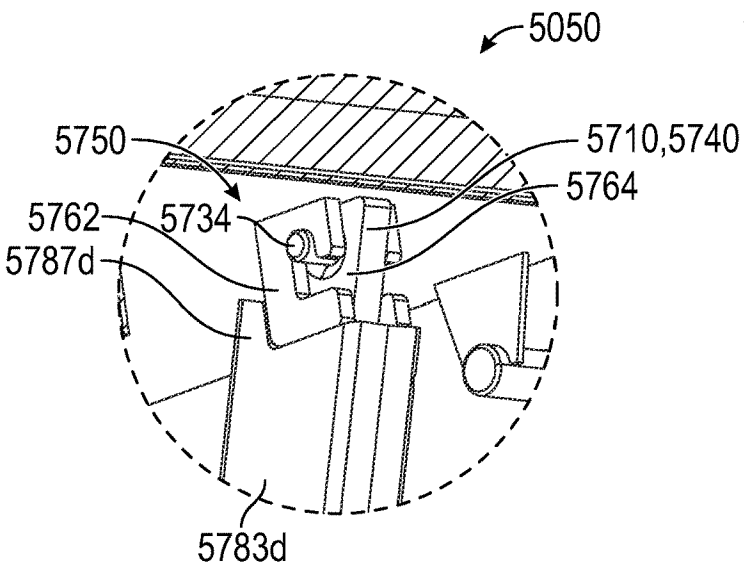
FIG. 130

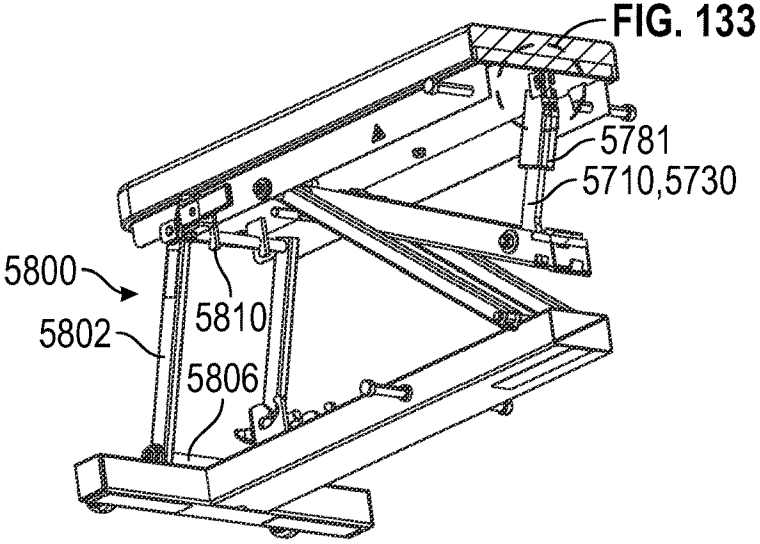
FIG. 133
FIG. 132
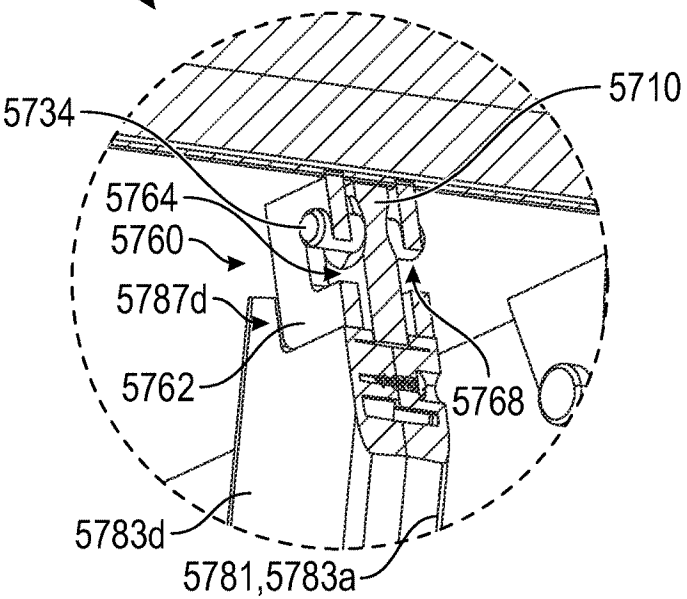
FIG. 133
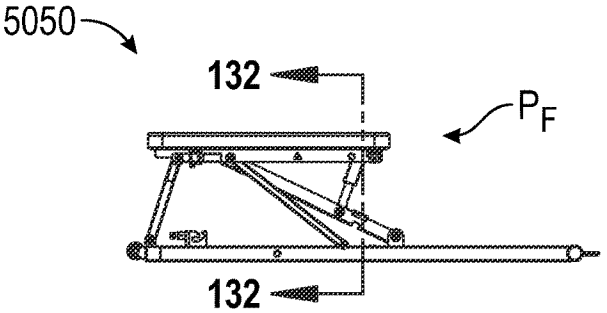
FIG. 131

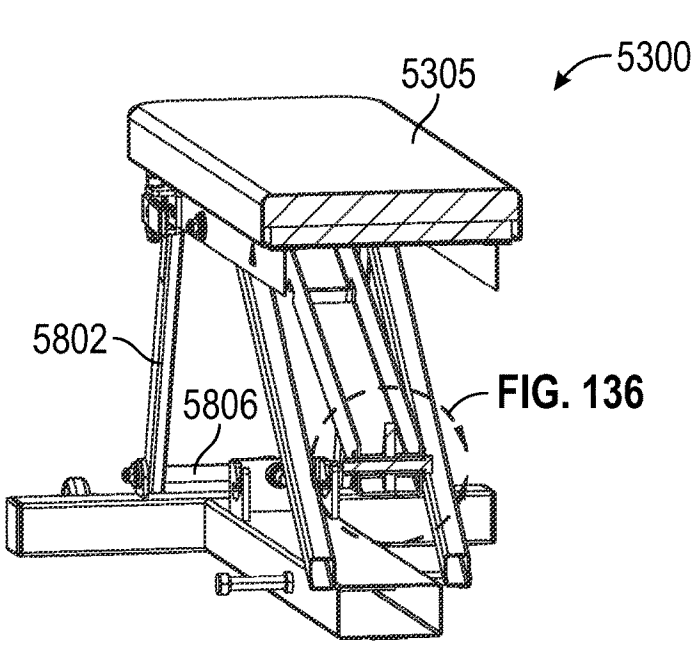
FIG. 136
FIG. 135
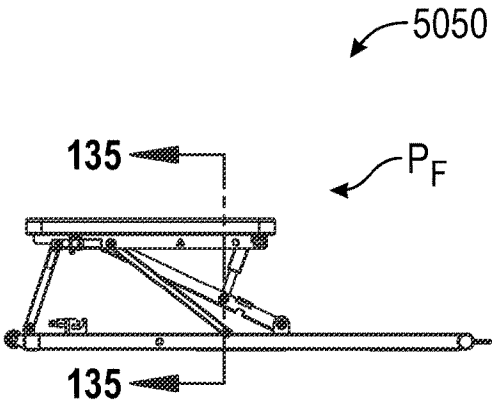
FIG. 134
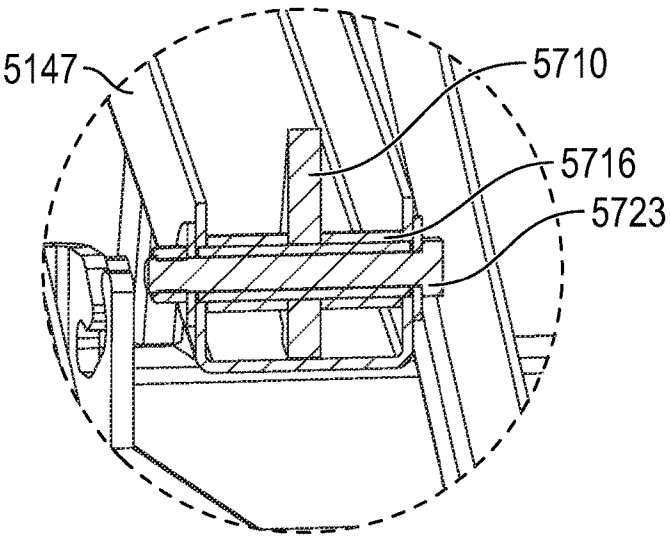
FIG. 136

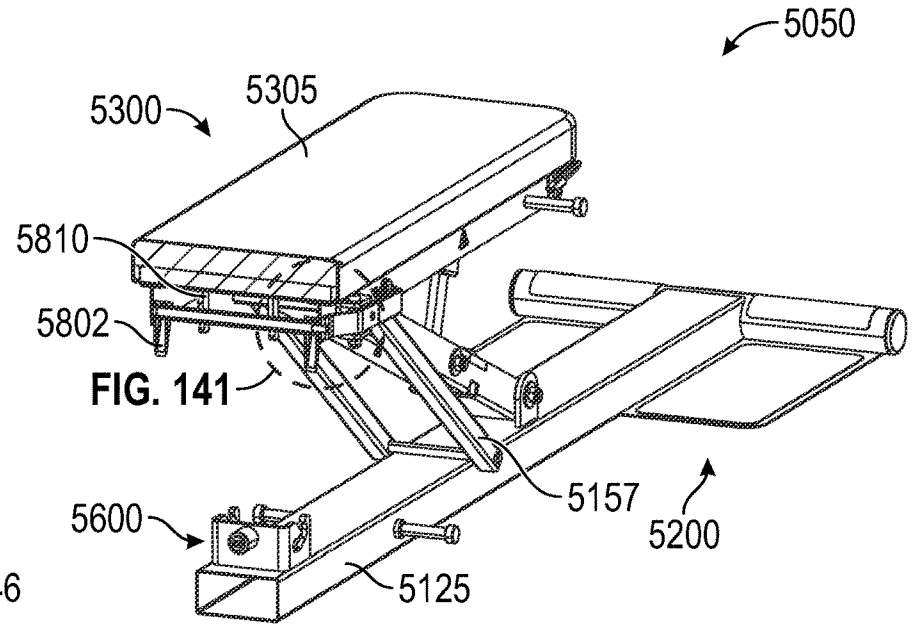
FIG. 140
FIG. 141
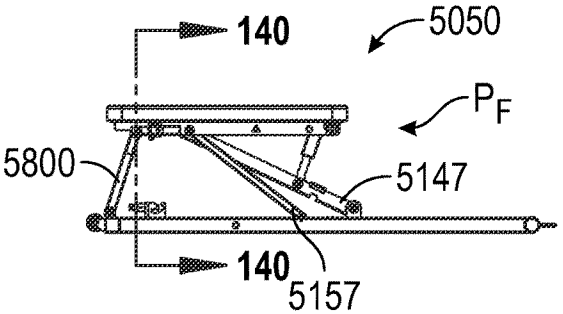
FIG. 139
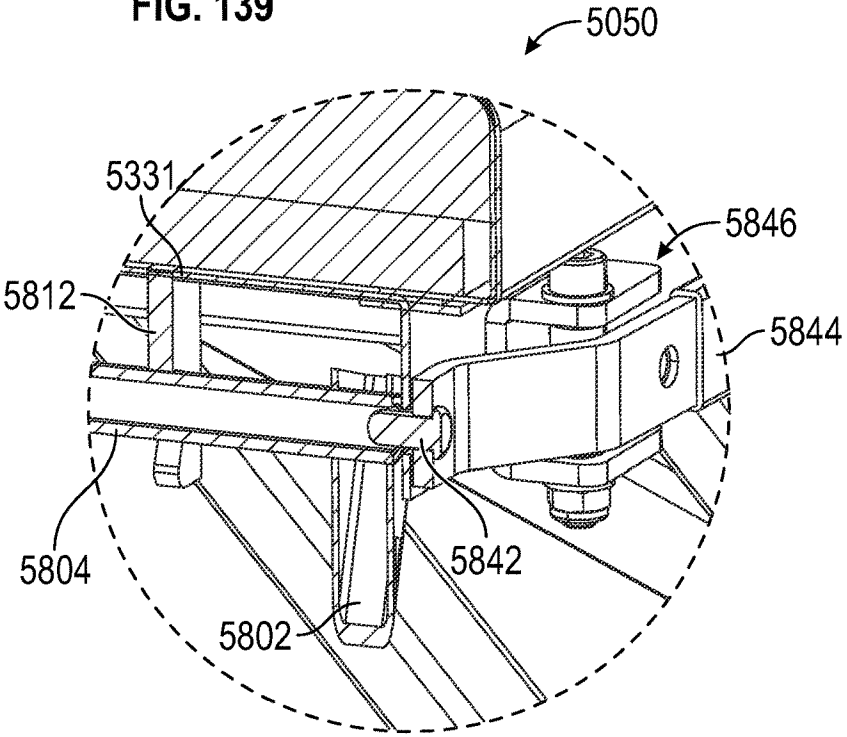
FIG. 141

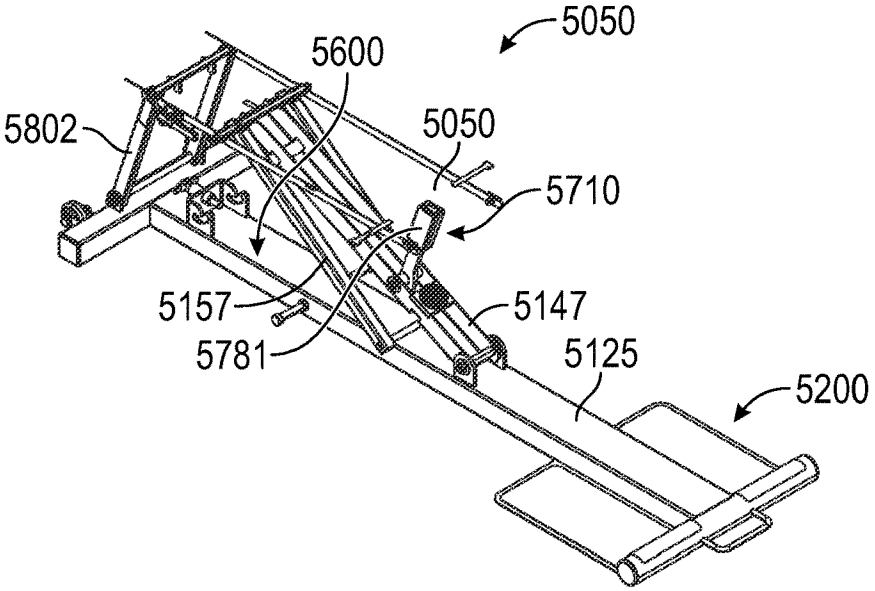
FIG. 143
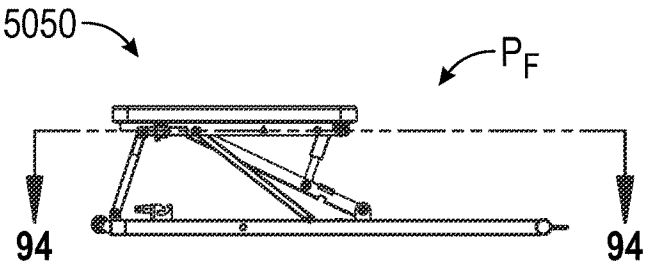
FIG. 142
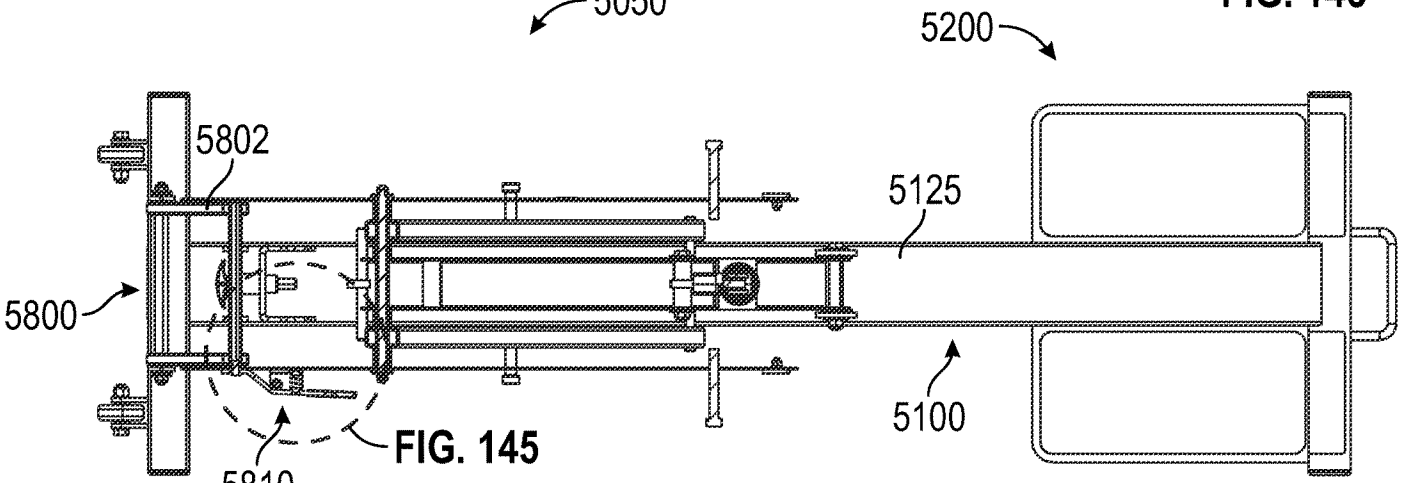
FIG. 144
FIG. 145

MULTI-FUNCTION, COLLAPSIBLE EXERCISE APPARATUS FOR PERFORMING A GLUTEAL BRIDGE EXERCISE AND FLAT BENCH EXERCISES

PRIORITY CLAIM

This application is a continuation of PCT Patent Application No. PCT/US2021/037219, which claims the benefit of U.S. Provisional Application No. 63/038,338, and U.S. Provisional Application No. 63/115,929.

CROSS-REFERENCE TO OTHER APPLICATIONS

U.S. Pat. No. 10,226,665, U.S. Provisional Patent Application Nos. 63/115,929, 63/038,338, 62/563,456, 62/505,542, and U.S. patent application Ser. No. 29/737,871, the disclosure of which are hereby incorporated by reference for all purposes.

TECHNICAL FIELD

This disclosure relates to a collapsible exercise apparatus configured to allow a person to perform a gluteal bridge movement or flat bench exercises, and then be collapsed into a low-profile storage configuration. In its ready to use position, the exercise apparatus allows a person to properly perform a gluteal bridge movement on a repeated basis. Resistance can be applied to the gluteal bridge movement where the resistance increases the amount of work to be performed by the person during the exercise. The configuration of the exercise apparatus can be further altered to place it in a flat bench positon, where the bench is positioned substantially horizontal to the support surface (e.g., ground that the apparatus is resting upon) such that the user can perform a wide variety of exercises, such as dumbbell flyes, presses, extensions, kickbacks and rowing movements. The configuration of the exercise apparatus can be altered to place it a low-profile, collapsed positon where the exercise apparatus can be stored when not in use.

BACKGROUND

Muscles of the human posterior hip, or gluteal muscles, are critical for the task of locomotion. Healthy and/or well-developed gluteal muscles are a key factor in maintaining the strength and health of a person's lower back, hips and knees. Conversely, unhealthy and/or under-developed gluteal muscles have been identified as a significant cause of a number of conditions, including patellar alignment problems, iliotibial (IT) band pathology, and mechanical lower back pain.

An exercise technique referred to as a "gluteal bridge," which is also commonly referred to as a "glute bridge" or "hip thrust," has been developed to strengthen gluteal muscles. The gluteal bridge is a complex movement because it requires the person to perform multiple movements in a specific sequence. The gluteal bridge is typically performed when a person, user or individual is in the supine position on the ground or on a mat where the person's the hips and knees are flexed while the lower back is pressed flat on the ground. The person then performs a pelvic tilt, whereby the pelvis is moved or "rolled" toward the posterior and the lower back flattens. With the pelvic tilt engaged, the person then raises his or her buttocks and shifts weight to the feet and an area of the upper thorax located at the inferior aspect of the person's scapulae. When properly performing the gluteal bridge exercise, the person moves only at the hips, without bending the spine. Also, when a person performs the gluteal bridge in this manner, it is commonly referred to as an "un-resisted" exercise since no external resistance is being applied during the complex movement.

As an individual becomes proficient at the basic gluteal bridge, the gluteal muscles become stronger. Various forms of resistance may be added to the gluteal bridge movement to increase the load on the gluteal muscles and other muscles. Safely increasing the load on the gluteal muscles is an important step in building overall muscular strength, endurance, power and girth. When resistance, e.g, in the form of an elastically deformable band, or some form of weight resistance such as a barbell, weight plate or dumbbell is applied to the exercise it is referred to as a "resisted gluteal bridge."

Past attempts to provide a resisted gluteal bridge include the use of additional devices, such as stretching a strongly-resistive elastic resistance band across a of a person's abdomen, along with contorting the person's knees to a severe angle to position the pelvis low enough to properly affix the elastic resistance band. Some attempts require the person to maneuver between a seat and a lower leg pad prior to initiating the exercise, creating dangers to the person, especially when he or she becomes fatigued. Other attempts require the person to press against a bare metal bar, typically while adding some form of an external pad, with their abdomen and contort their body to slide under the bar before initiating the gluteal bridge exercise. Further attempts require the use of hand-held free weights and a free-standing bench, presenting issues pertaining to the stability, strength and sliding resistance of the bench along a ground surface. Still further attempts rely on the compromised directional stability and support of an exercise ball. Even further attempts rely on the use of a Smith machine, which creates a movement pathway that forces the user to move in an undesired vertical path (i.e., straight up and down) motion rather than a proper curvilinear path. The use of these additional devices to perform a resisted gluteal bridge causes numerous problems that reduce the effectiveness of the exercise while exposing the person trying to perform the exercise to potential injury. For example, these conventional resisted gluteal bridge exercises do not properly support the lumbar spine throughout the exercise's range of motion. Accordingly, these conventional exercises force the lumbar spine into a position of hyperextension, particularly at an end range of motion of the exercise which places significant pressure on a user's facet joints. This pressure is undesirable because it is a noted cause of lower back pain. Additionally, these conventional resisted gluteal bridge exercises do not allow the user to perform a resisted gluteal bridge movement with only one leg at a time, or with alternating legs because the weight shifts in an uncontrolled manner across the user's pelvis, which may cause the user to fall or become injured.

Accordingly, there has been a long-standing, unmet need for an exercise apparatus specifically designed to allow a person to properly perform a resisted gluteal bridge movement to improve the strength of the person's human posterior hip and gluteal muscles.

SUMMARY OF THE INVENTION

The present disclosure provides a collapsible exercise apparatus specifically designed to allow a person or user to perform a gluteal bridge, typically with resistance, to improve the strength of a person's human posterior hip and gluteal muscles. The collapsible exercise apparatus can be configured for use in different environments—namely, in a gym, fitness center, human performance training environment, hotel exercise facility, spa, studio or home gym. The exercise apparatus facilitates the performance of a resisted gluteal bridge in a safe, controlled and efficient manner while the person lies on a bench of the apparatus. In use, the person lies along the length of the bench instead of perpendicular to the bench. Due to the added support of the bench under the length of the person's spine, the exercise apparatus protects the person's spine by maintaining the lumbar spine in a neutral position throughout the entire range of motion of the gluteal bridge exercise, and also allows the motion of the exercise to be concentrated at the person's hip joints. Maintaining the lumbar spine in the neutral position and concentrating motion at the hip joints (i) eliminates any undesirable accessory movement in the spine, where accessory movement is movement created between the various segments of the user's spine, including at the facet joints or between the vertebral bodies, and (ii) improves the overall effectiveness of the resisted gluteal bridge exercise performed on the apparatus. Due to its unique configuration, the exercise apparatus also protects the user's pelvic bones from pressure that occurs when a heavy weight plate, barbell or dumbbells are placed across the upper portion of the user's hips, as done with conventional attempts to perform resisted gluteal bridges.

The collapsible exercise apparatus for performing a resisted gluteal bridge movement is intended for use in a gym, fitness center, human performance training environment, hotel exercise facility, spa, studio or home gym. The exercise apparatus generally comprises (i) a support assembly with a frame assembly and a deck assembly; (ii) a bench assembly; and, (iii) a resistance assembly. The exercise apparatus is designed to be placed on a planar support surface or floor within the spa, studio or home gym. The user or person selects a level of resistance using the elastically deformable bands, secures himself/herself to the bench assembly and then performs at least one repetition of the resisted gluteal bridge movement. Typically, the user performs multiple repetitions of the resisted gluteal bridge movement as part of his/her training regimen. The exercise apparatus can also be placed in a flat bench position where the user can perform variety of exercises on the bench assembly of the apparatus. Also, the user can articulate the exercise apparatus in a low-profile, collapsed position to facilitate storage (e.g., under a bed or in a closet) of the apparatus when it is not in use.

Other features and advantages of the disclosure will be apparent from the following specification taken in conjunction with the following drawings.

BRIEF DESCRIPTION OF THE DRAWINGS

The figures depict one or more implementations in accord with the present teachings, by way of example only, not by way of limitation. In the figures, like reference numerals refer to the same or similar elements.

FIG. 120 is a first zoomed-in sectional view of FIG. 119 focusing on the upper retaining mechanism;

FIG. 121 is a second zoomed-in sectional view of FIG. 119 focusing on the front retaining mechanism in the secured state;

FIG. 122 is a rear view of the exercise apparatus of FIG. 106;

FIG. 123 is a perspective sectional view of the exercise apparatus of FIG. 106 taken along line 123-123 of FIG. 122;

FIG. 124A is a side sectional view of the exercise apparatus of FIG. 106 taken along line 124-124 of FIG. 122;

FIG. 124B is a zoomed-in sectional view of FIG. 124A focusing on the rear retaining mechanism;

FIG. 125 is a zoomed-in sectional view of FIG. 123 focusing on the front retaining mechanism in the locked or secured position;

FIG. 126 is a first zoomed-in sectional view of FIG. 124A focusing on the front energy absorbing structure;

FIG. 127 is a second zoomed-in sectional view of FIG. 124 focusing on the upper retaining mechanism;

FIG. 128 is a right side view of the exercise apparatus of FIG. 106;

FIG. 129 is a perspective sectional view of the exercise apparatus of FIG. 106 taken along line 129-129 of FIG. 128;

FIG. 130 is a zoomed-in sectional view of FIG. 129 focusing on the front retaining mechanism in the secured state;

Figure 1:
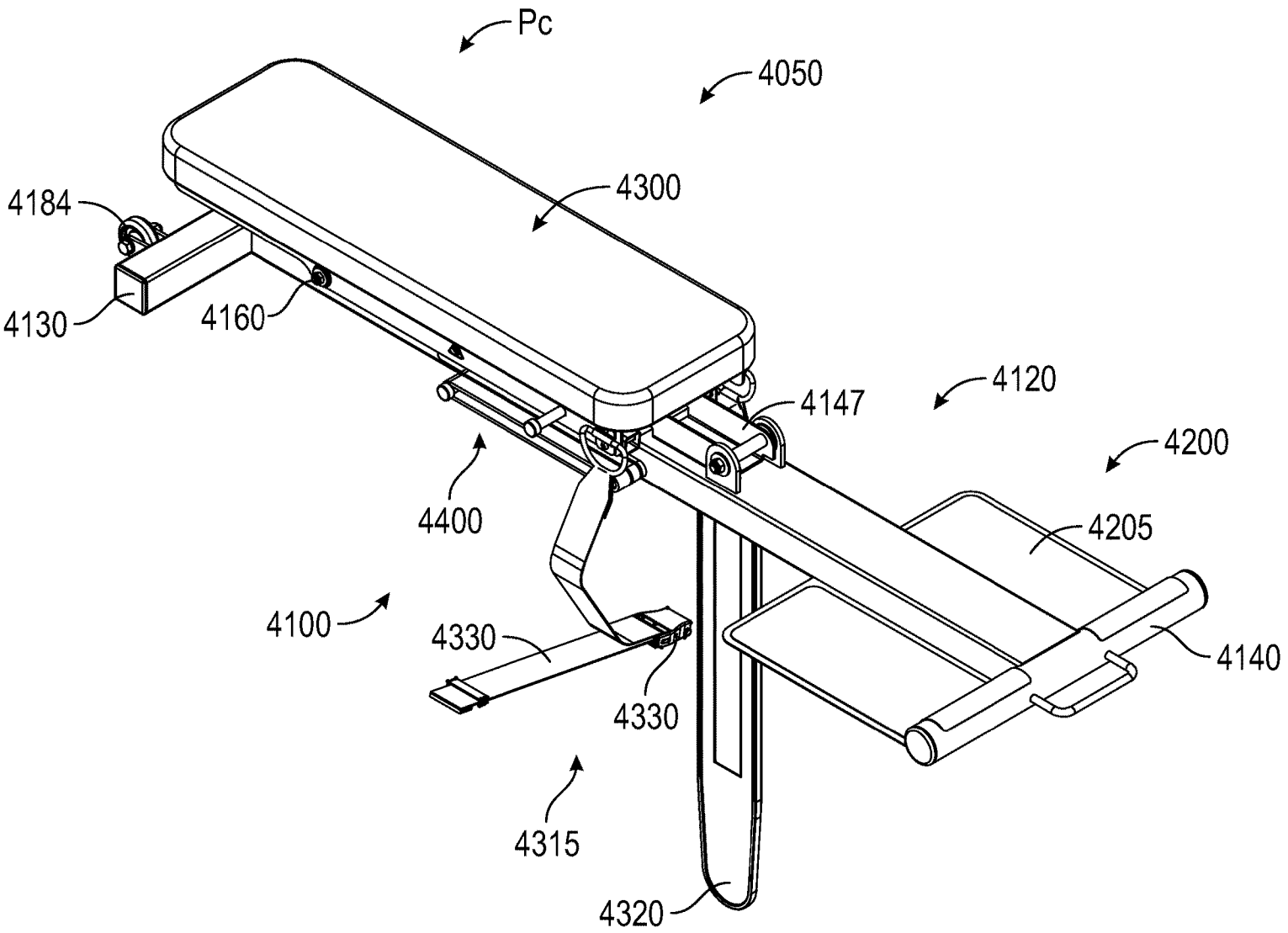
FIG. 1 is a perspective view of a first embodiment of an exercise apparatus for performing both a gluteal bridge movement and flat bench exercises, the exercise apparatus shown in a collapsed position.
Figure 2:
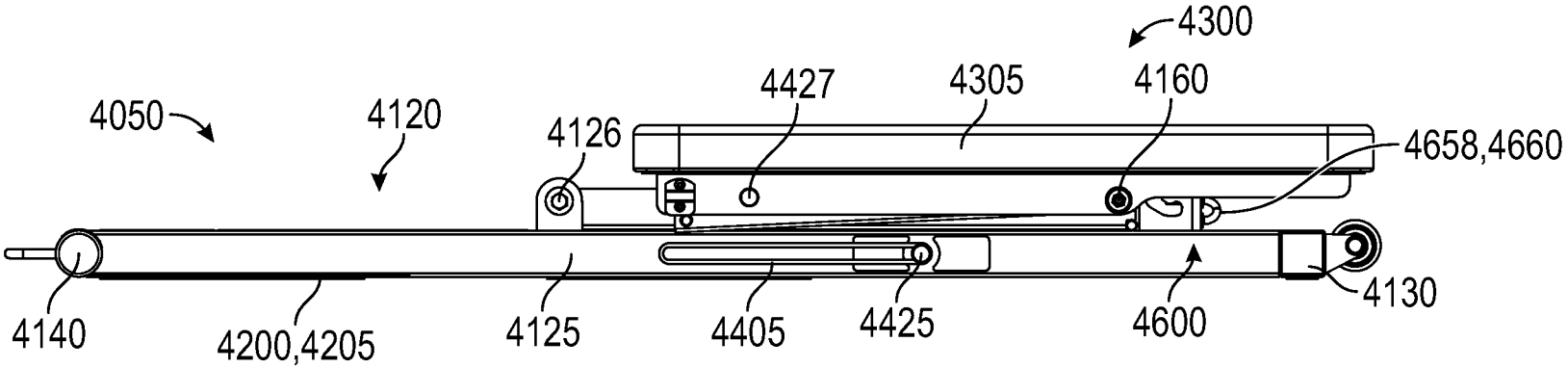
FIG. 2 is a left side view of the exercise apparatus of FIG. 1.
Figure 98:
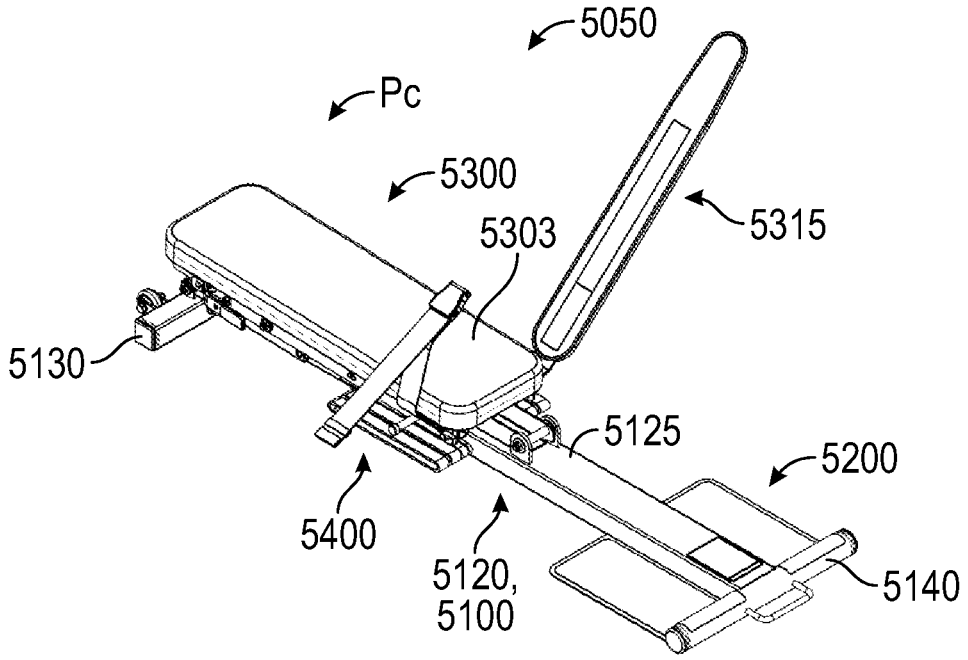
FIG. 98 is a perspective view of a second embodiment of an exercise apparatus for performing both a gluteal bridge movement and flat bench exercises, the exercise apparatus shown in a collapsed position.
Figure 106:
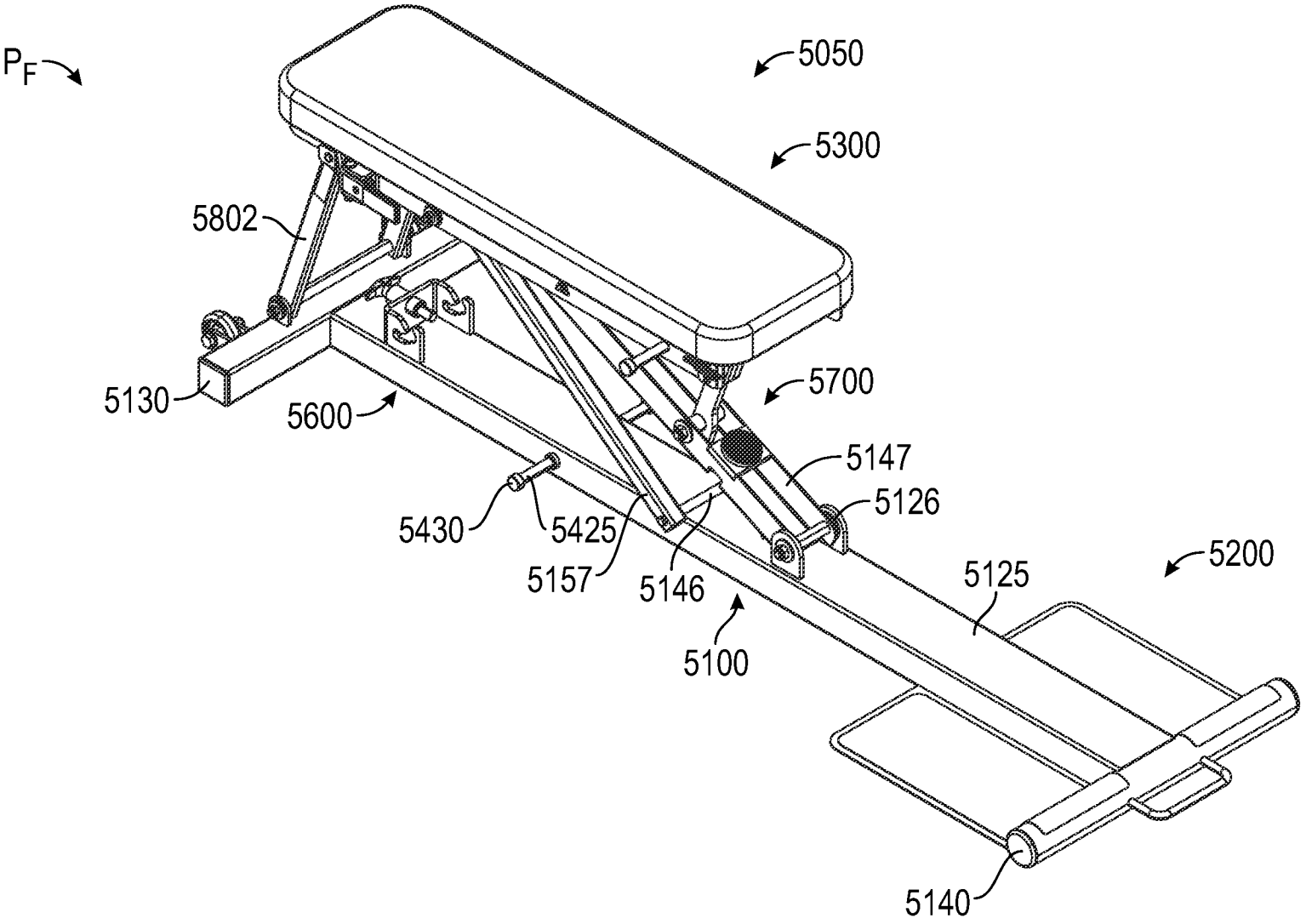
FIG. 106 is a perspective view of the second embodiment of an exercise apparatus for performing both a gluteal bridge movement and flat bench exercises, the exercise apparatus shown in the flat bench position.
Figure 138:
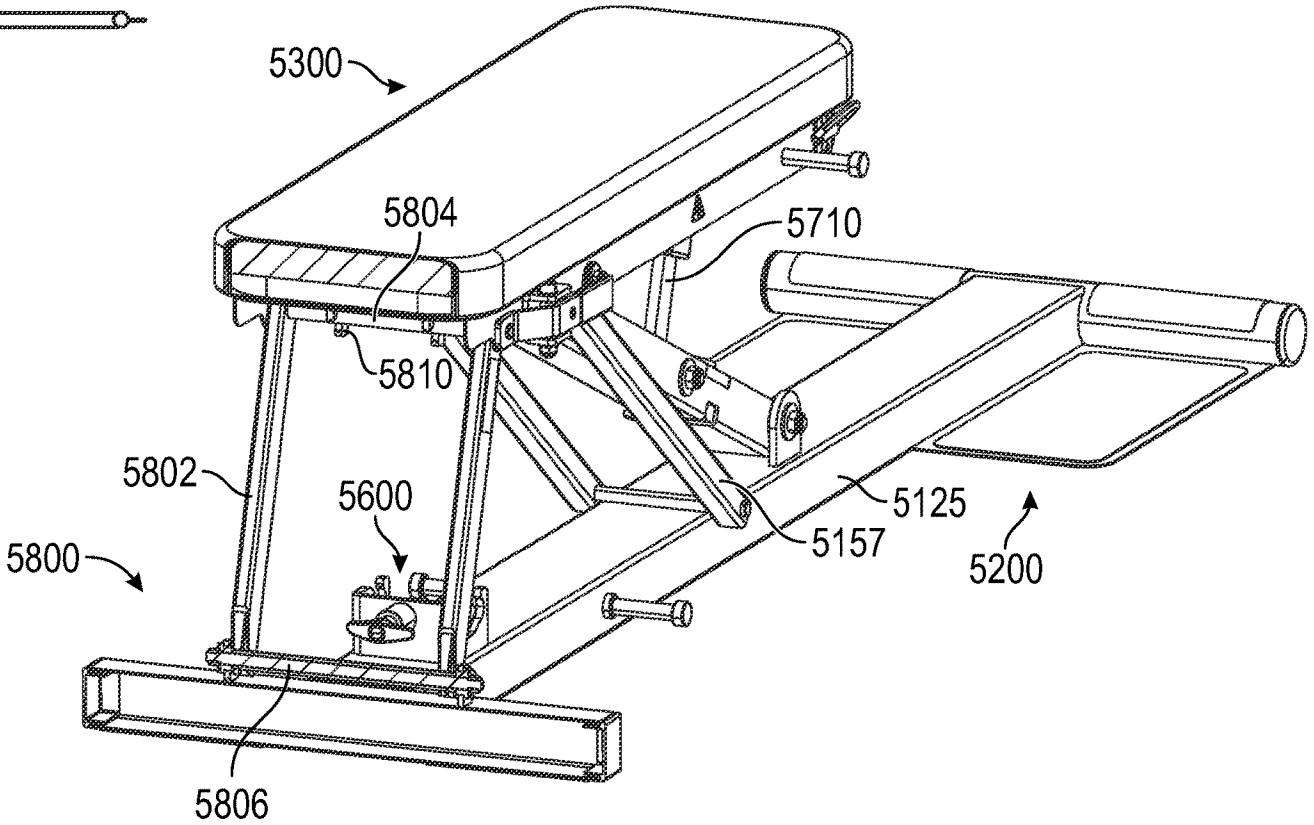
Figure 137:
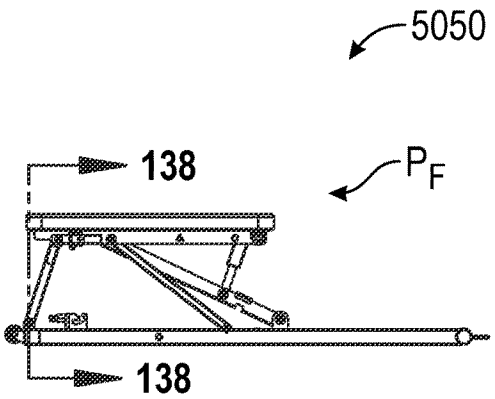
Figure 145:
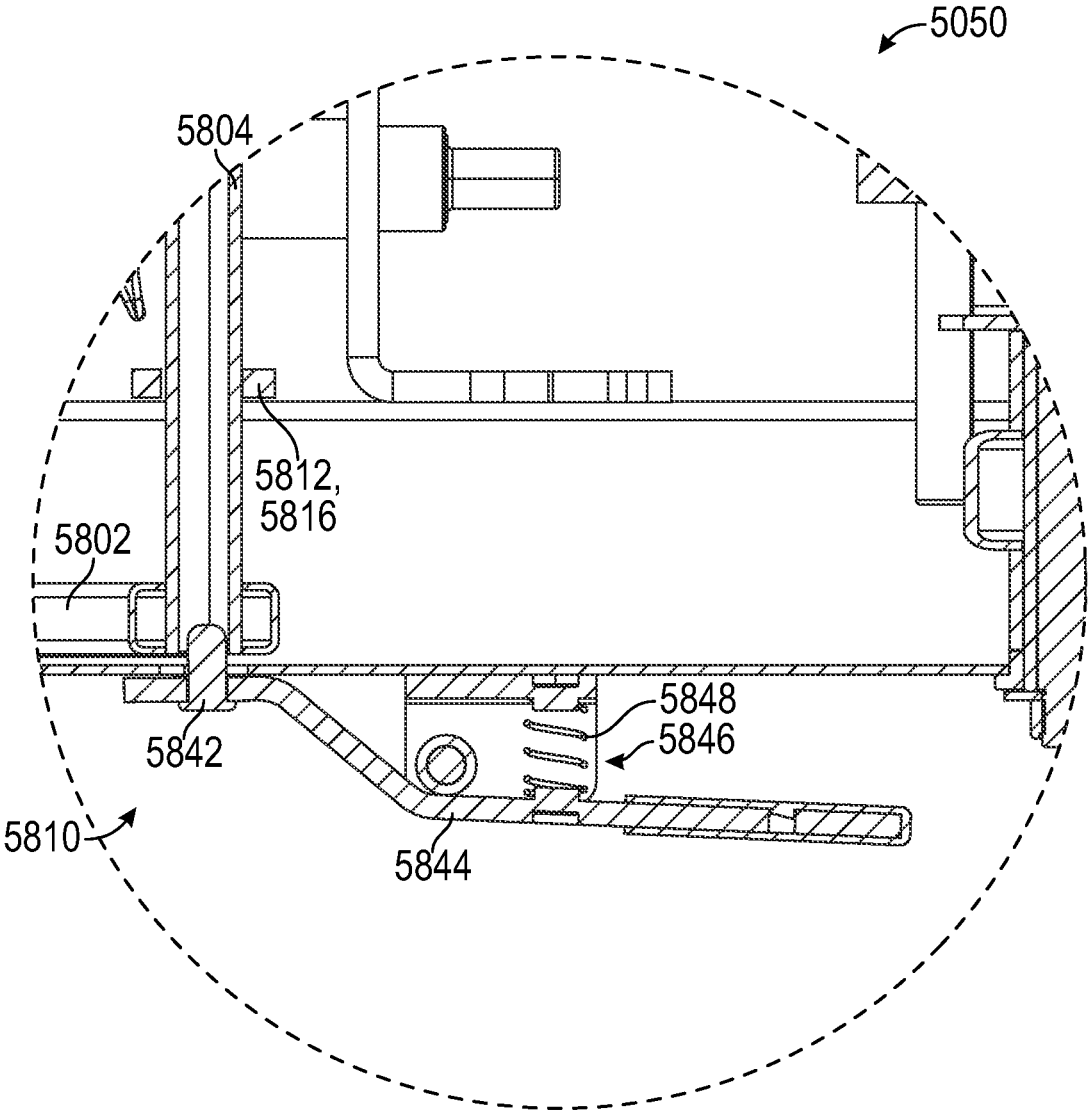
Figure 146:
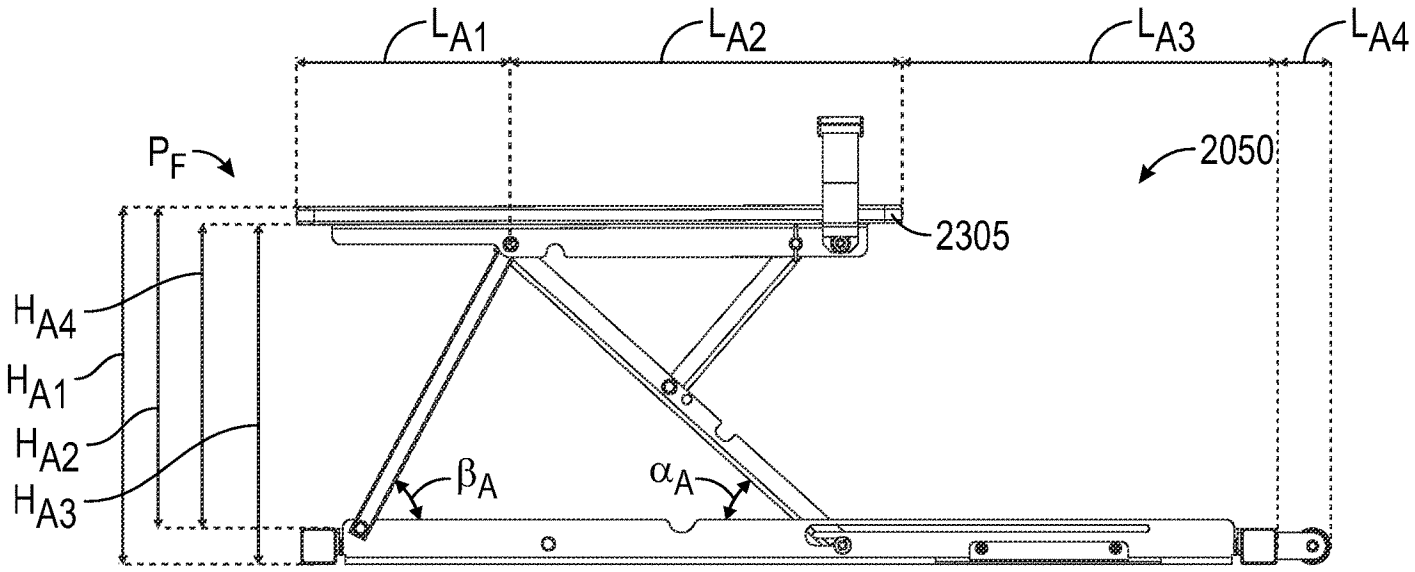
Figure 147:
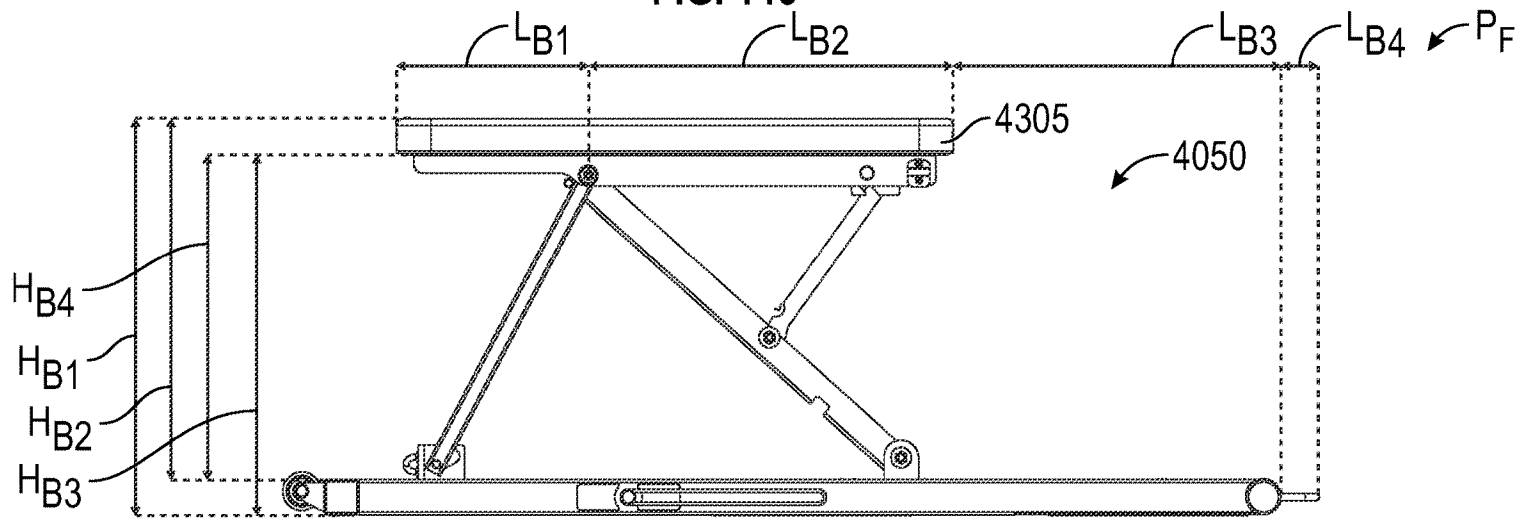
Figure 148:
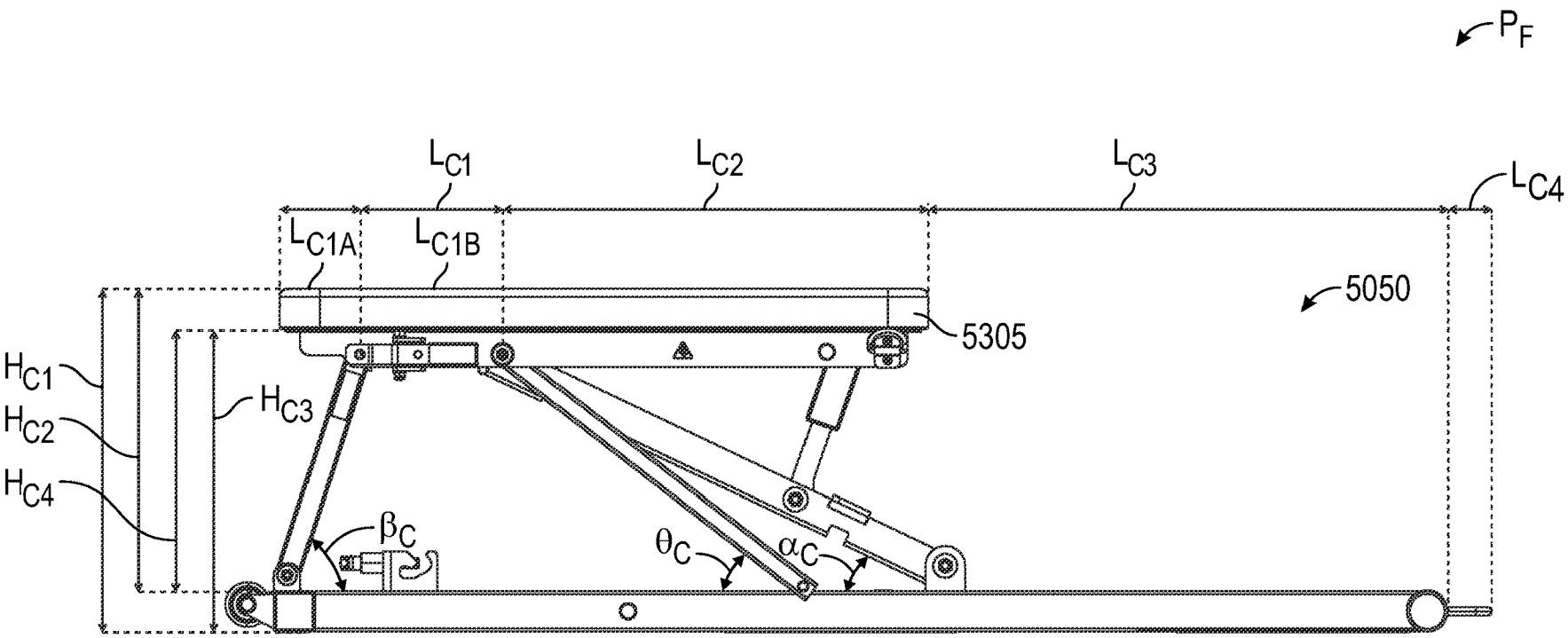
Figure 149:
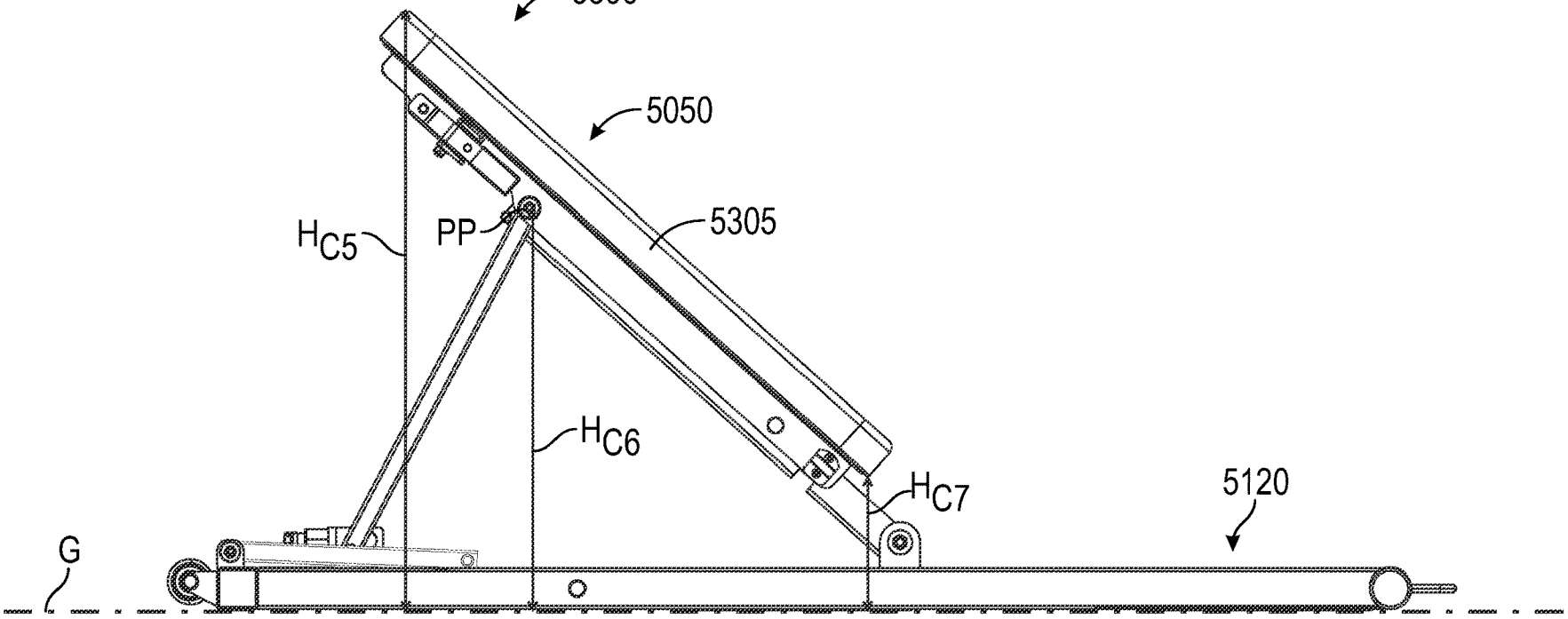
Figure 150:
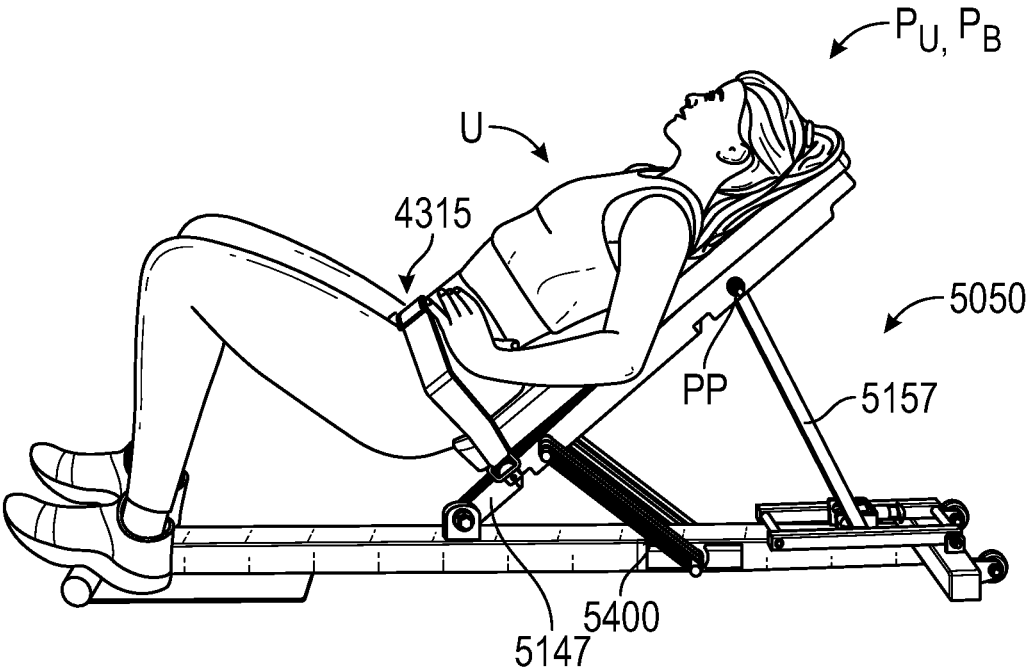
Figure 151:
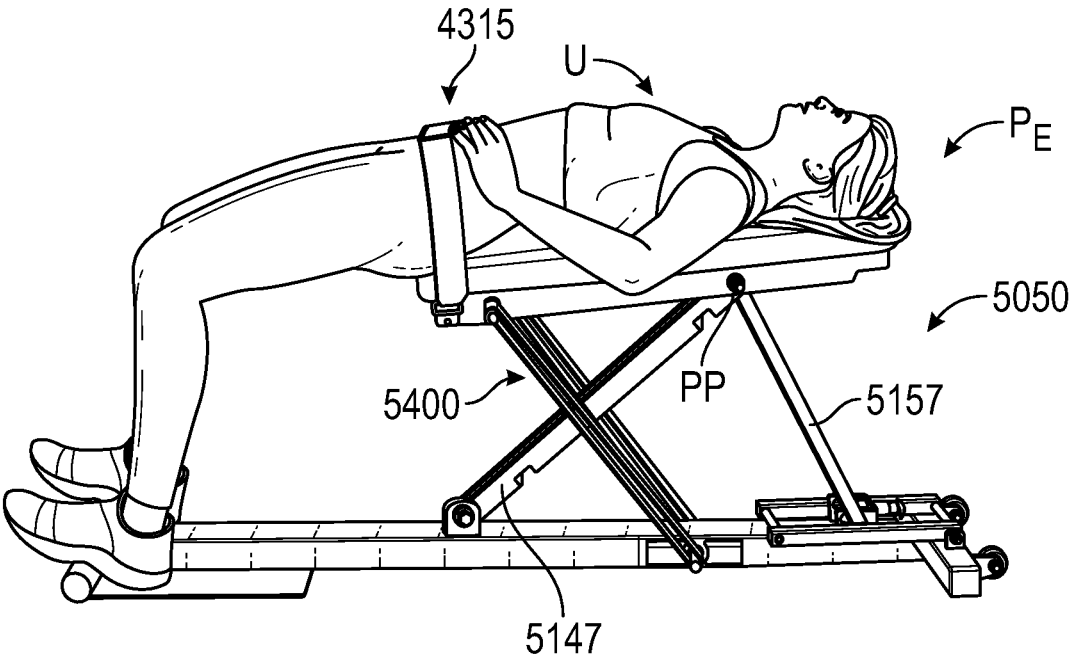
Figure 152:
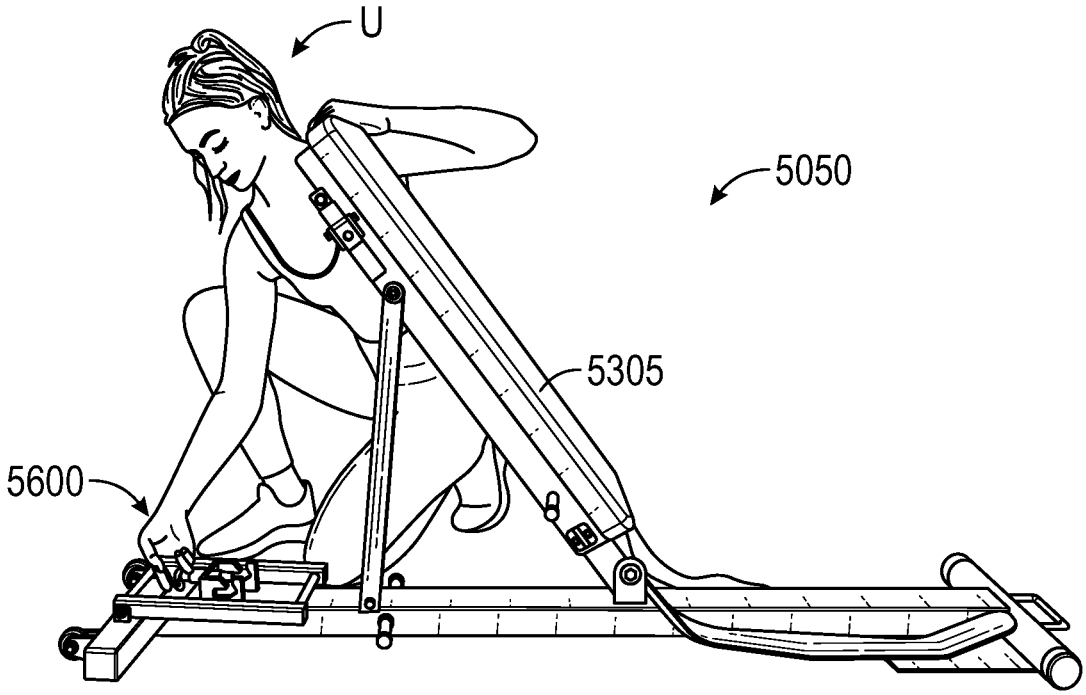
Figure 153:
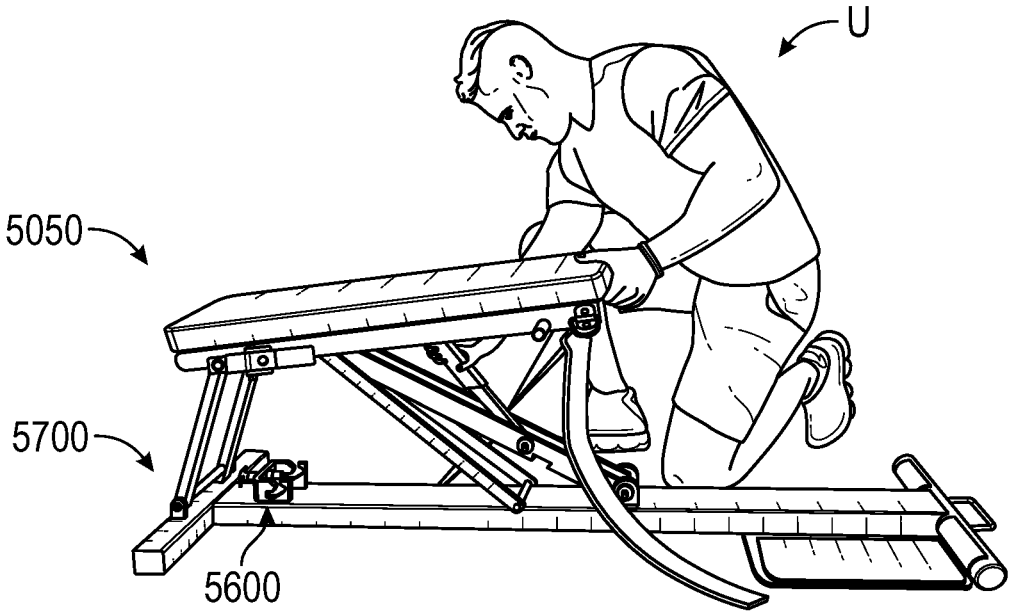
Figure 154:
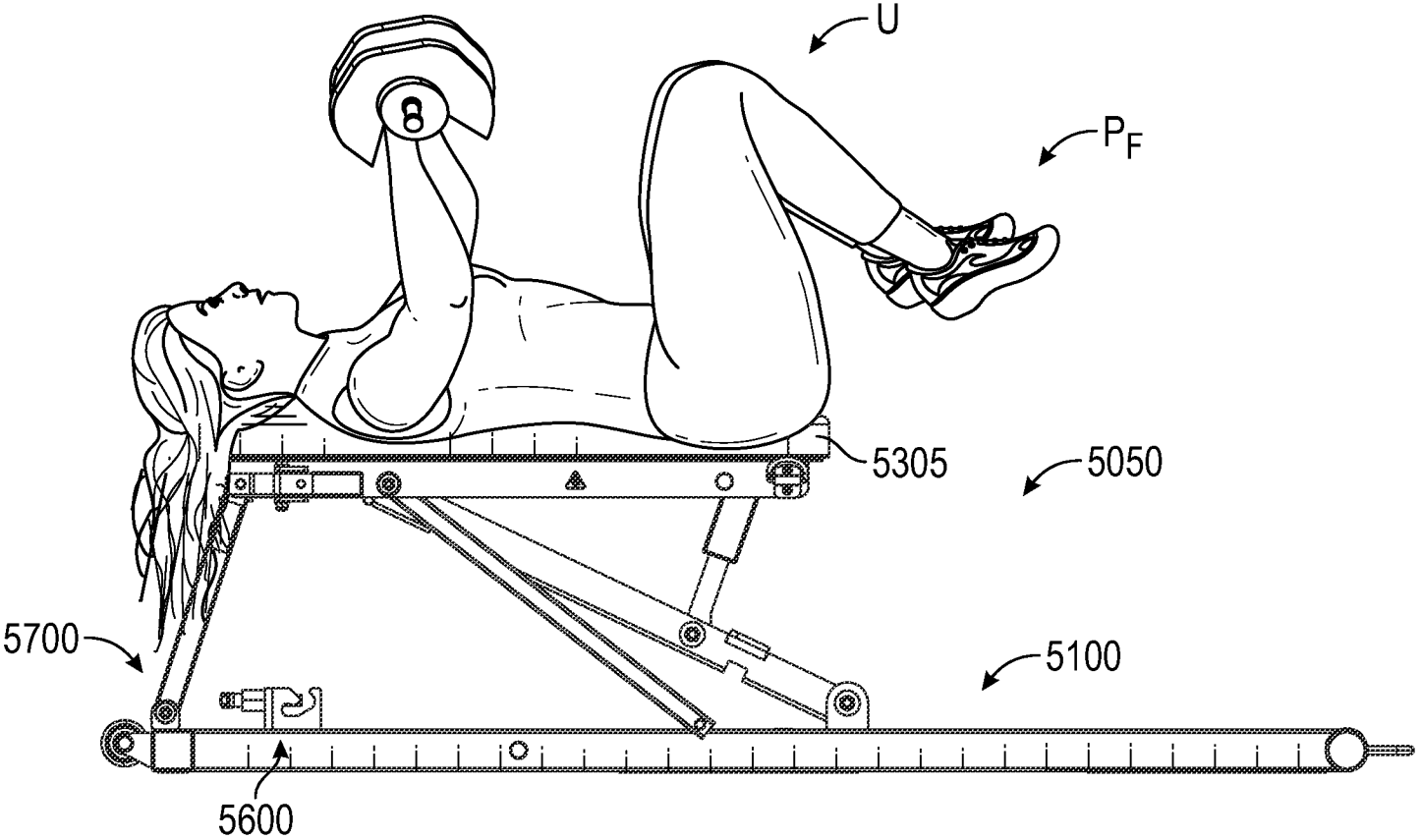
Figure 155:
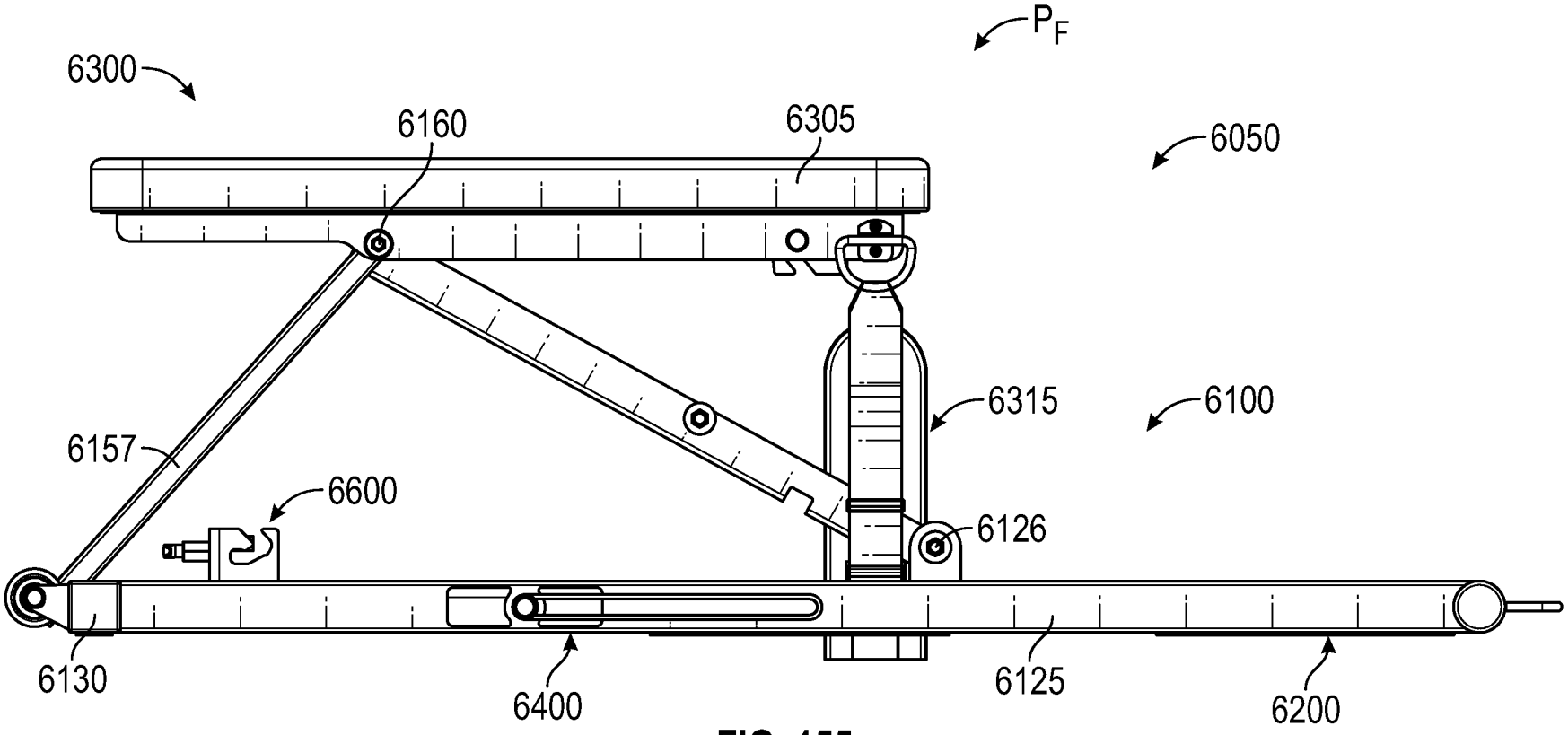
Figure 156:
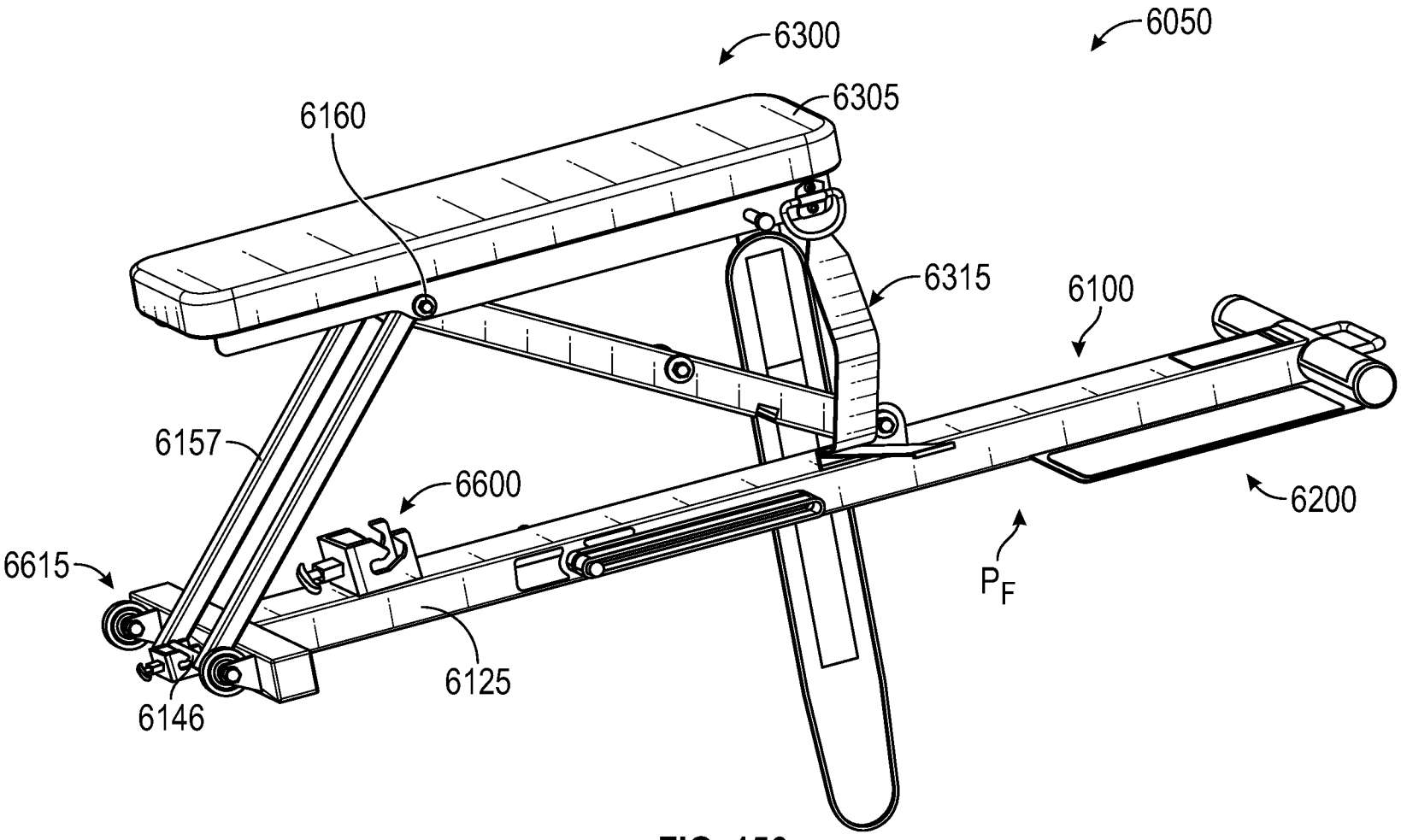

FIG. 131 is a right side view of the exercise apparatus of FIG. 106;

FIG. 132 is a perspective sectional view of the exercise apparatus of FIG. 106 taken along line 132-132 of FIG. 131;

FIG. 133 is a zoomed-in sectional view of FIG. 132 focusing on the front retaining mechanism in the secured state;

FIG. 134 is a right side view of the exercise apparatus of FIG. 106;

FIG. 135 is a perspective sectional view of the exercise apparatus of FIG. 106 taken along line 135-135 of FIG. 134;

FIG. 136 is a zoomed-in sectional view of FIG. 135 focusing on the interaction between the locking member and the front retaining mechanism;

FIG. 137 is a right side view of the exercise apparatus of FIG. 106;

FIG. 138 is a perspective sectional view of the exercise apparatus of FIG. 106 taken along line 138-138 of FIG. 137;

FIG. 139 is a right side view of the exercise apparatus of FIG. 106;

FIG. 140 is a perspective sectional view of the exercise apparatus of FIG. 106 taken along line 140-140 of FIG. 139;

FIG. 141 is a zoomed-in sectional view of FIG. 140 focusing on the upper retaining mechanism in the secured state;

FIG. 142 is a right side view of the exercise apparatus of FIG. 106;

FIG. 143 is a perspective sectional view of the exercise apparatus of FIG. 106 taken along line 143-143 of FIG. 142;

FIG. 144 is a top sectional view of the exercise apparatus of FIG. 106 taken along line 144-144 of FIG. 142;

FIG. 145 is a zoomed-in sectional view of FIG. 144 focusing on the upper retaining mechanism in the secured state;

FIG. 146 is a right side view of the exercise apparatus in U.S. Pat. No. 10,226,665, showing the exercise apparatus in the flat bench position and having multiple dimensions;

FIG. 147 is a side view of the exercise apparatus of FIG. 1, showing the bench assembly in the flat bench position and having multiple dimensions;

FIG. 148 is a side view of the exercise apparatus of FIG. 98, showing the bench assembly in the flat bench position and having multiple dimensions and angles;

FIG. 149 is a side view of the exercise apparatus of FIG. 98, showing the bench assembly in the ready to use position and having a series of dimensions and angles;

FIG. 150 is a side view of the exercise apparatus of FIG. 98, showing a user interacting with the bench assembly in the ready to use position;

FIG. 151 is a side view of the exercise apparatus of FIG. 98, showing a user interacting with the bench assembly in the extended position;

FIG. 152 is a side view of the exercise apparatus of FIG. 98, showing a user moving the apparatus between various positions;

FIG. 153 is a side view of the exercise apparatus of FIG. 98, showing a user interacting with the bench assembly to arrive at the flat bench position;

FIG. 154 is a side view of the exercise apparatus of FIG. 98, showing a user performing a dumbbell press exercise while lying on the bench assembly in the flat bench position;

FIG. 155 is a side view of a third embodiment of an exercise apparatus for performing both a gluteal bridge movement and flat bench exercises, the exercise apparatus shown in a flat bench position;

FIG. 156 is a perspective view of the exercise apparatus of FIG. 155, showing the exercise apparatus shown in the flat bench position; and

DETAILED DESCRIPTION

While this disclosure includes a number of details and implementations in many different forms, there is shown in the drawings and will herein be described in detail particular implementations with the understanding that the present disclosure is to be considered as an exemplification of the principles of the disclosed methods and systems, and is not intended to limit the broad aspects of the disclosed concepts to the implementations illustrated.

1) Overview of the Exercise Apparatus

Figure 97:
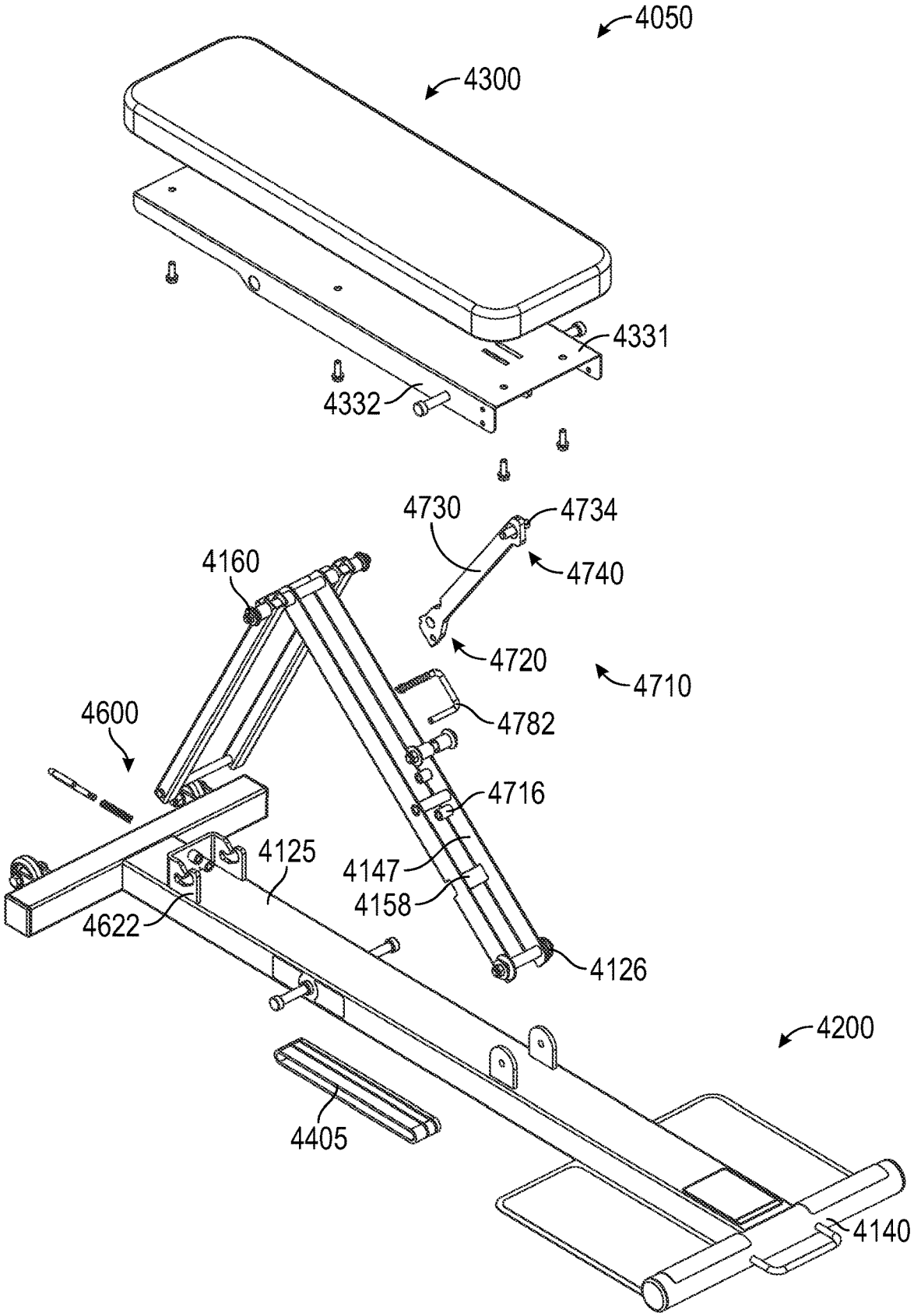
FIG. 97 is an exploded view of the exercise apparatus of FIG. 63.

This disclosure relates to a collapsible exercise apparatus specifically designed to allow a person or user to perform a gluteal bridge, typically with resistance, to improve the strength of a user's human posterior hip and gluteal muscles. FIGS. 1-97 and 147 show a first embodiment or version of an exercise apparatus 4050, while FIGS. 98-145, 148-154 show an embodiment or second version of an exercise apparatus 5050, and FIGS. 155-156 show a third embodiment or version of an exercise apparatus 6050. The exercise apparatuses 4050, 5050, 6050 are designed to be used in similar exercise, training and fitness environments (e.g., gym, fitness center, spa, studio, or a home gym) and as such they have many overlapping features. Accordingly, the following description primarily focuses on the first exercise apparatus 4050 with the understanding that this disclosure will apply to the second exercise apparatus 5050 and the third exercise apparatus 6050, except for where specified. Further, similar structures between these embodiments are identified by similar numbers that are separated by 1000. For example, the disclosure in connection with a bench assembly 4300, including its components and parts, of the first exercise apparatus 4050 applies to (i) a bench assembly 5300, including its components and parts, of the second exercise apparatus 5050, and (ii) a bench assembly 6300, including its components and parts, of the third exercise apparatus 6050. Thus, multiple reference numbers for the second exercise apparatus 5050 and third exercise apparatus 6050 are not included in this specification; instead one should refer to the disclosure of corresponding components and parts for the first exercise apparatus 4050. This format of the disclosure is efficient and does not limit the disclosure of either the first or second or third embodiment of the bench assembly 4300, 5300, 6300 or the first or second or third exercise apparatus 4050, 5050, 6050 in any manner. In fact, it should be understood that any feature that is shown within or pertaining to the first exercise apparatus 4050 could be used in connection with the second exercise apparatus 5050 or the third exercise apparatus 6050, and vice versa.

Figure 99:
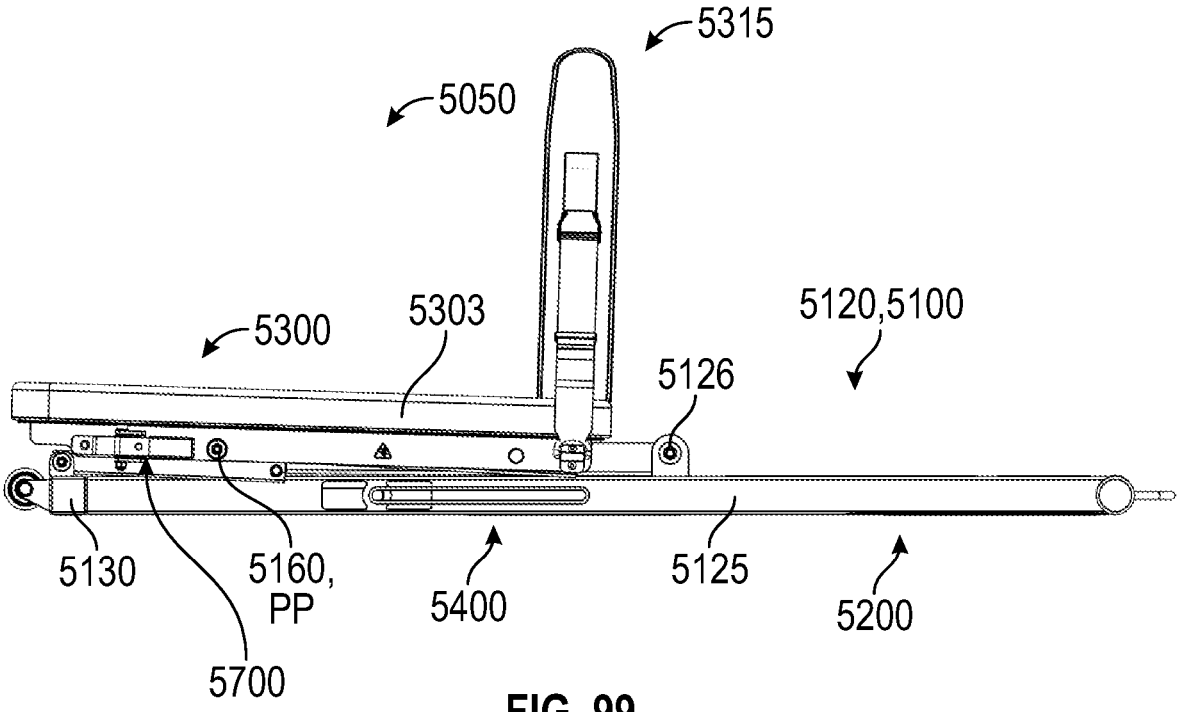
FIG. 99 is right side view of the exercise apparatus of FIG. 98.
Figure 100:
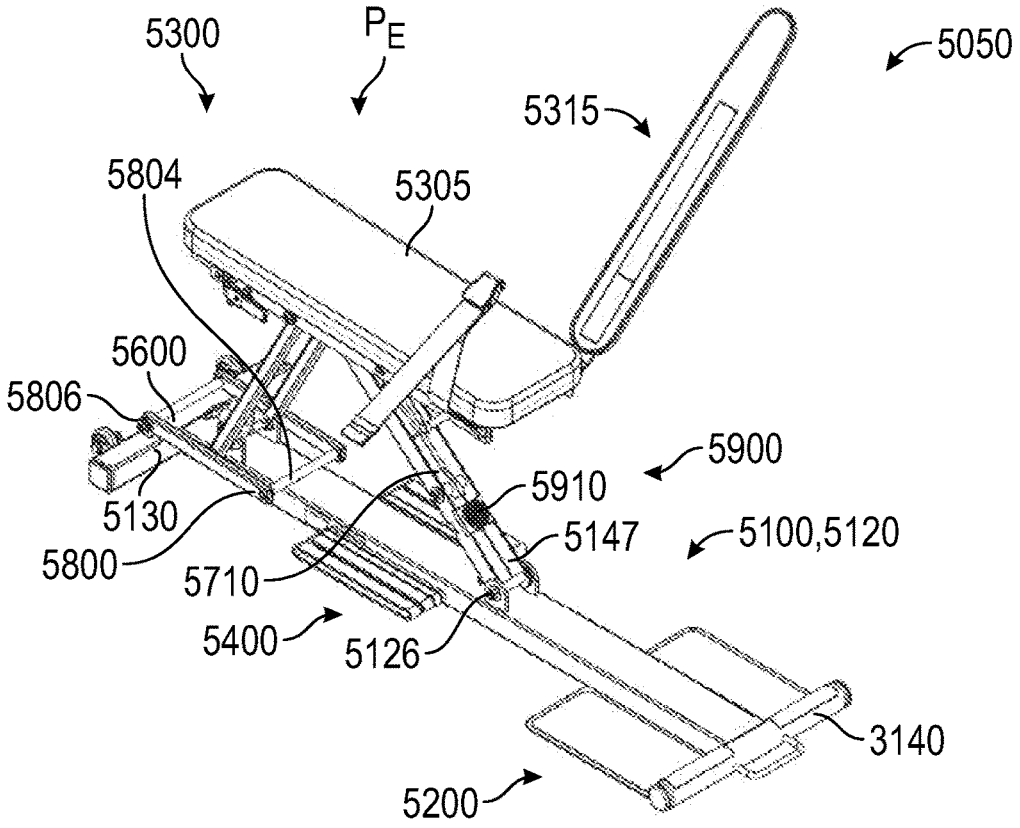
FIG. 100 is a perspective view of the exercise apparatus of FIG. 98, the exercise apparatus shown in an extended position without showing the user residing on the exercise apparatus.
Figure 101:
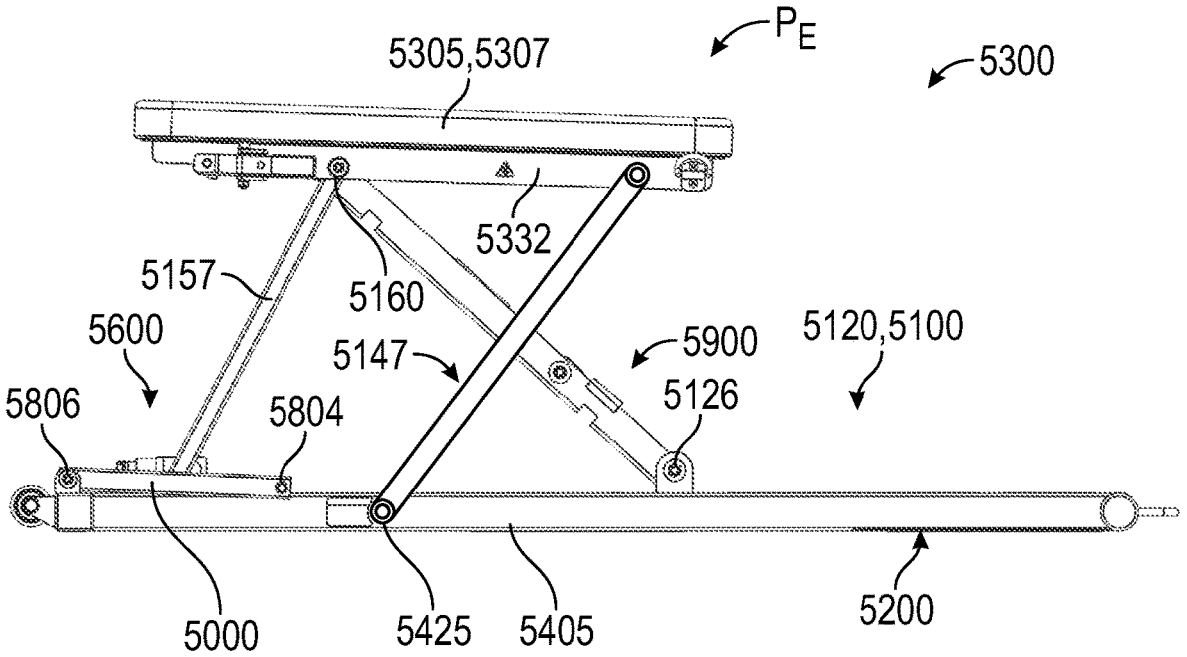
FIG. 101 is a right side view of the exercise apparatus of FIG. 100, where the resistance assembly is exerting a force on the bench assembly in the extended position.
Figure 103:
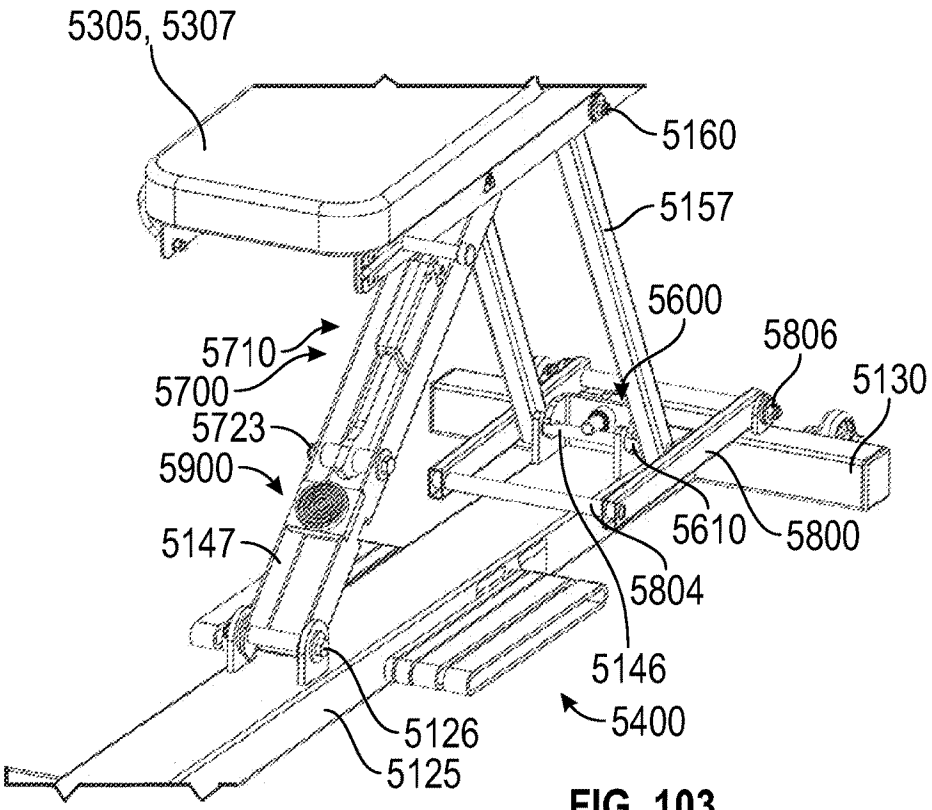
FIG. 103 is second frontal prospective view of the exercise apparatus of FIG. 100.
Figure 102:
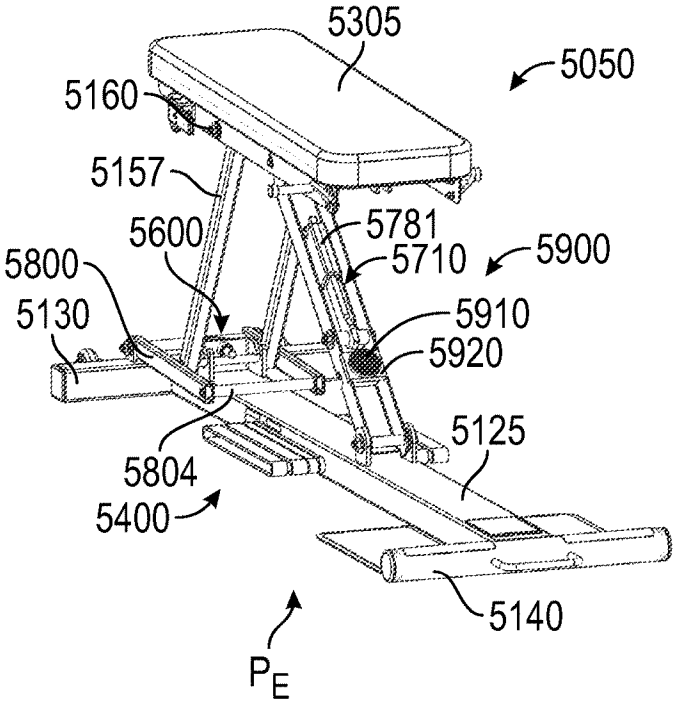
FIG. 102 is a first frontal prospective view of the exercise apparatus of FIG. 100.

The Figures show the first, second and third embodiments of the exercise apparatus 4050, 5050, 6050 in multiple positions or configurations for specific usage. Specifically, FIGS. 1-28 show the exercise apparatus 4050 in a first or low-profile, collapsed position, $P_C$ that is suitable for storage of the apparatus 4050 when it is not being used); FIGS. 29-62 show the exercise apparatus 4050 in a second or ready to use position, $P_U$ and in a third or bottom position, $P_B$, denoting the relative location of the bench assembly 4300 when the user is not utilizing the apparatus 4050 or the user is at the lowermost portion of the gluteal bridge movement; and, FIGS. 63-97 show the exercise apparatus 4050 in a fourth or flat bench position, $P_F$. Additionally, FIGS. 98-99 show the second embodiment of the exercise apparatus 5050 in the first or low-profile, collapsed position, $P_C$; FIGS. 100-105 show the exercise apparatus 5050 in a fifth or extended position $P_E$ where the user U reaches the uppermost portion of the gluteal bridge movement; and FIGS. 106-145 show the exercise apparatus 5050 in the fourth or flat bench position, $P_F$. FIGS. 146-149 show relative dimensions and angular arrangements of structures and components of the exercise apparatus 4050, 5050, as compared to the exercise apparatus disclosed in U.S. Pat. No. 10,226,665. FIGS. 155-156 show the exercise apparatus 6050 in the fourth or flat bench position, $P_F$. Unlike the plate-loaded or select drive versions of the exercise machines disclosed in U.S. Pat. No. 10,226,665 which are large and non-collapsible machines, the exercise apparatus 4050, 5050, 6050 can be easily articulated into the low-profile, collapsed position, $P_C$, which allows the apparatus to be both efficiently packaged for shipment to market and then conveniently stored under a bed or in a closet. Accordingly, the exercise apparatus 4050, 5050, 6050 has been carefully designed and manufactured with a collection of structures and components that feature select dimensions and angular arrangements to provide the apparatus 4050, 5050, 6050 with the functionality described herein.

FIGS. 150-154 show how the user U interacts with the exercise apparatus 5050. In particular, FIG. 150 shows a user U positioned on the exercise apparatus 5050 in both the ready to use position $P_U$ and the bottom position $P_B$. FIG. 151 shows the user U positioned on the exercise apparatus 5050 in the extend position, $P_E$. FIG. 152 shows the user U: (i) moving the exercise apparatus 5050 from the low-profile, collapsed position $P_C$ towards the ready to use position, $P_U$, (ii) moving the exercise apparatus 5050 from the ready to use position, $P_U$ towards the flat bench position, $P_F$, or (iii) moving the exercise apparatus 5050 from the ready to use position, $P_U$ towards the low-profile, collapsed position, $P_C$. FIG. 153 shows the user U moving the exercise apparatus 5050 from the ready to use position, $P_U$ towards the flat bench position, $P_F$. FIG. 154 shows user U performing a dumbbell press exercise while lying on the exercise apparatus 5050 in the flat bench position, $P_F$. In summary, the exercise apparatuses 4050, 5050, 6050 are configured to be articulated between five positions by the user: collapsed position, $P_C$, ready to use position, $P_U$, hip extended position, $P_E$, bottom position, $P_B$, and the flat bench position, $P_F$, all dependent upon the type of exercise to be performed by the user U.

The exercise apparatus 4050, 5050, 6050 enable the performance of a resisted gluteal bridge in a safe, controlled and efficient manner while the user U lies on a bench assembly 4300, 5300, 6300. In use, the user U lies along the length of the bench assembly 4300, 5300, 6300 instead of transverse, including perpendicular, to the length of the bench assembly 4300, 5300, 6300. Due to the added support of the bench assembly 4300, 5300, 6300 under the length of the user's spine, the exercise apparatus 4050, 5050, 6050 protects the user's spine by maintaining the lumbar spine in a neutral position throughout the entire range of motion of the exercise, and also allows the motion of the gluteal bridge movement to be concentrated at the user's hip joints. The lumbar spine consists of five vertebrae labeled L1 through L5, and it is situated between the thoracic spine and the sacrum. Maintaining the lumbar spine in the neutral position and concentrating motion at the hip joints helps eliminate accessory movement, as defined above in the Summary section, through the entire spine while improving the overall effectiveness of the resisted gluteal bridge exercise performed on the apparatus. Due to its unique configuration, the exercise apparatus 4050, 5050 also protects the user's pelvic bones from pressure that occurs when a heavy weight plate, barbell or dumbbells are placed across the upper portion of the user's hips, as done with conventional attempts to perform resisted gluteal bridges.

2) Overview of the First Embodiment of the Exercise Apparatus

The first embodiment of the exercise apparatus 4050 includes: (i) a support assembly 4100 with a frame assembly 4120 and a deck assembly 4200, (ii) a bench assembly 4300, and (iii) a resistance assembly 4400. The exercise apparatus 4050 is designed to be placed on a planar support surface or floor F within the spa, studio, or home. As described in greater detail below, the user or user selects a level of resistance using the resistance assembly 4400, secures himself/herself to the bench assembly 4300 and then performs at least one repetition of the resisted gluteal bridge movement. Typically, the user performs multiple repetitions of the resisted gluteal bridge movement as part of his/her training regimen.

A. The Support Assembly

As shown in the Figures and stated above, the support assembly 4100 includes the frame assembly 4120 and the deck assembly 4200. The frame assembly 4120 comprises: (i) a central member 4125, (ii) a front lateral member 4140, (iii) a rear lateral member 4130, (iv) a front support member 4147, and (iv) a pair of rear support members 4157 that are coupled to one another via a cross-bar 4146. As seen in at least FIGS. 5, 13, 21, 34, 43, and 85, the central member 4125 extend between the front lateral member 4140 and rear lateral member 4130. Coupled to the bottom of the central member 4125, the front lateral member 4140, and rear lateral member 4130 are distributed padding structures 4135 that are designed to: (i) prevent damage to the users floor when the user moved/uses the machine and/or (ii) absorb the energy generated by the user in an attempt to reduce undesired force on the human body while using the machine. It should be understood that these padding structures 4135 or the front and rear lateral members 4140, 4130 may be omitted without altering the performance of the exercise apparatus 4050. In an additional embodiment, the pair of rear support members 4157 may be replaced with a single rear support member that has a greater width or may utilize only a rear support member contained within the pair of rear support members 4157. Further, is some embodiments, the central member 4125 may be considered a lower frame member because it is in a lower vertical position in comparison to the front support member 4147 and the rear support members 4157.

Figure 3:
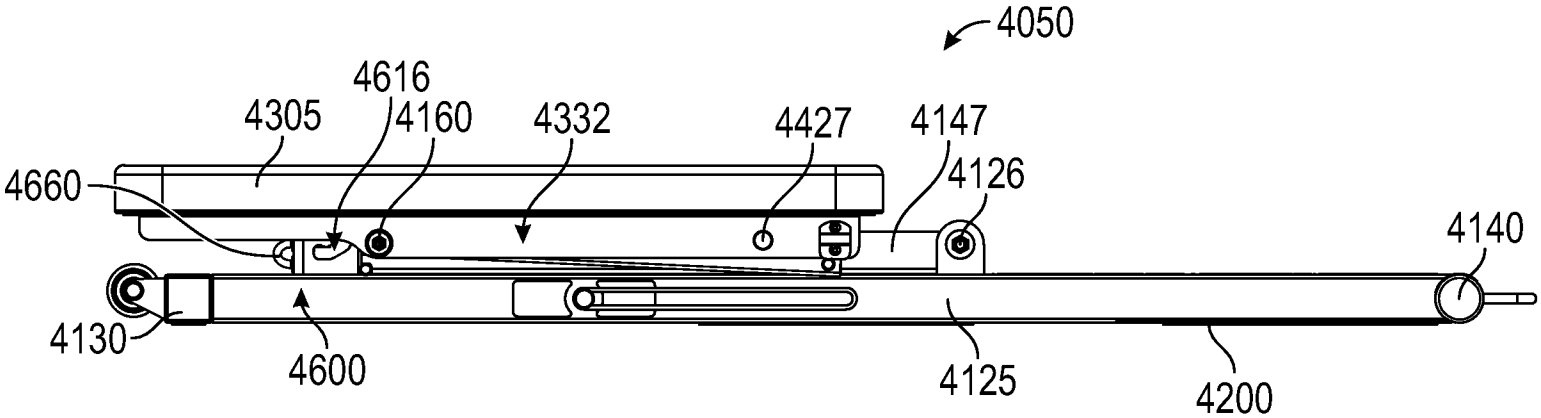
FIG. 3 is a right side view of the exercise apparatus of FIG. 1.
Figure 4:
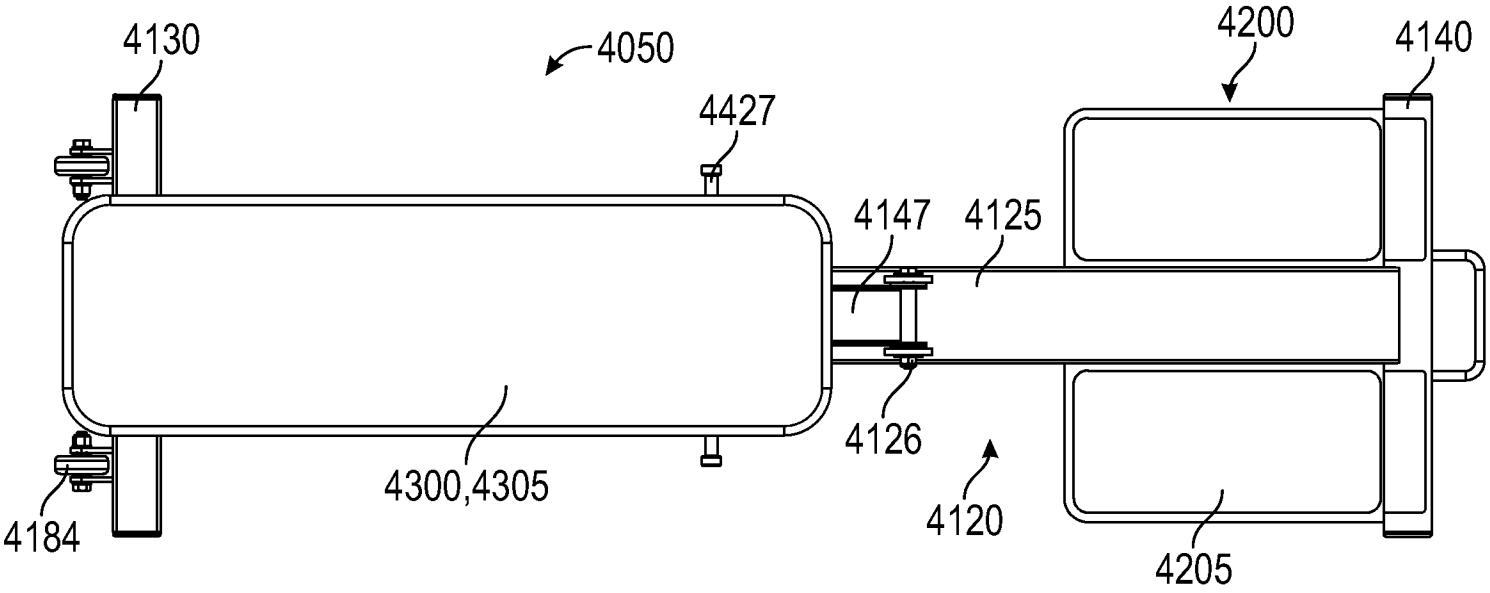
FIG. 4 is a top view of the exercise apparatus of FIG. 1.
Figure 5:
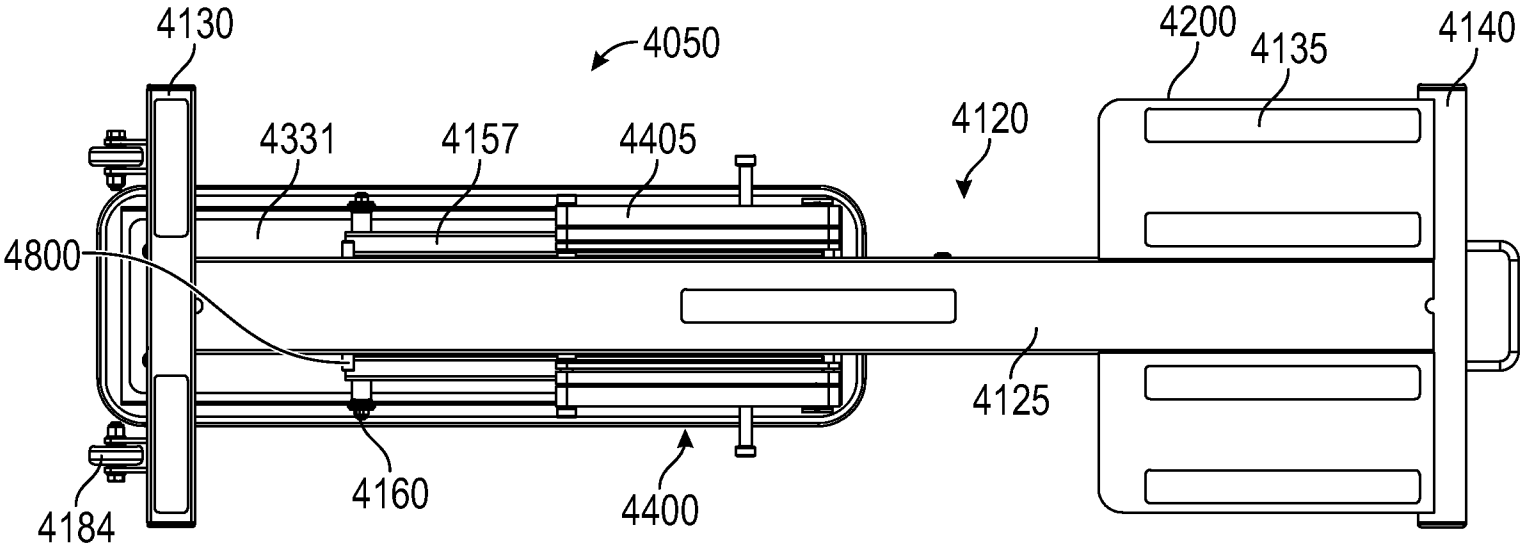
FIG. 5 is a bottom view of the exercise apparatus of FIG. 1.
Figure 6:
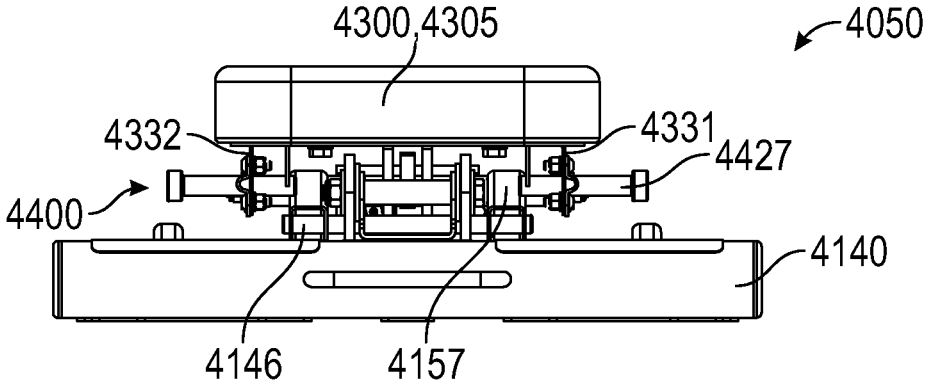
FIG. 6 is a front view of the exercise apparatus of FIG. 1.
Figure 7:
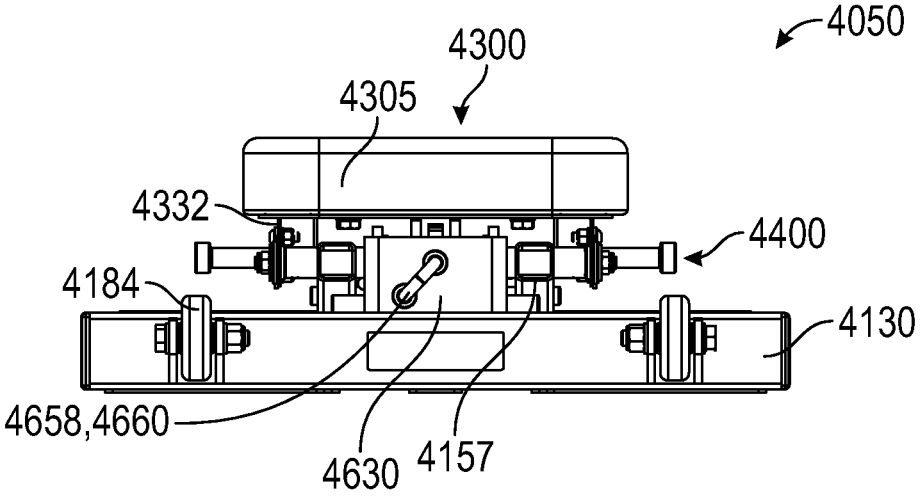
FIG. 7 is a rear view of the exercise apparatus of FIG. 1.
Figure 9:
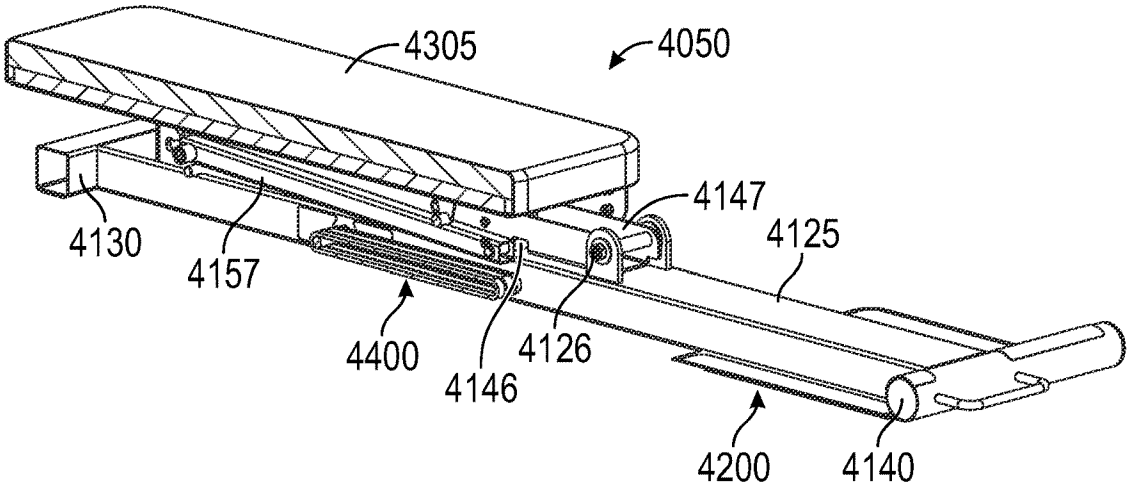
FIG. 9 is a perspective sectional view of the exercise apparatus of FIG. 1 taken along line 9-9 of FIG. 8.
Figure 8:
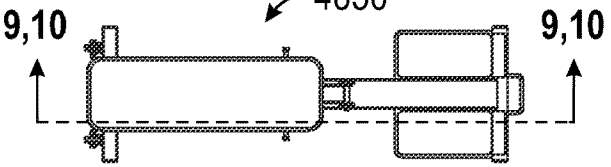
FIG. 8 is a top view of the exercise apparatus of FIG. 1 in the collapsed position.
Figure 10:
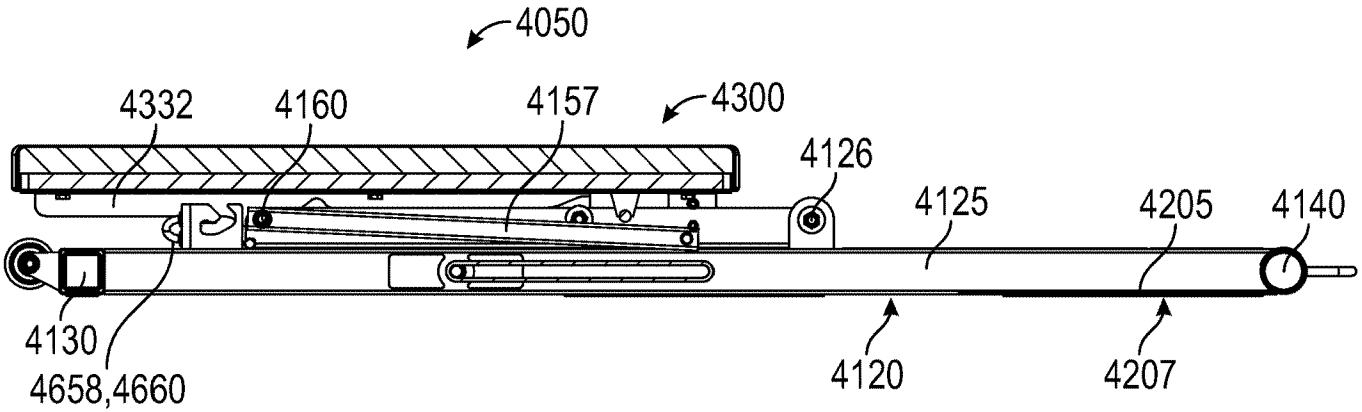
FIG. 10 is a side sectional view of the exercise apparatus of FIG. 1 taken along line 10-10 of FIG. 8.
Figure 12:
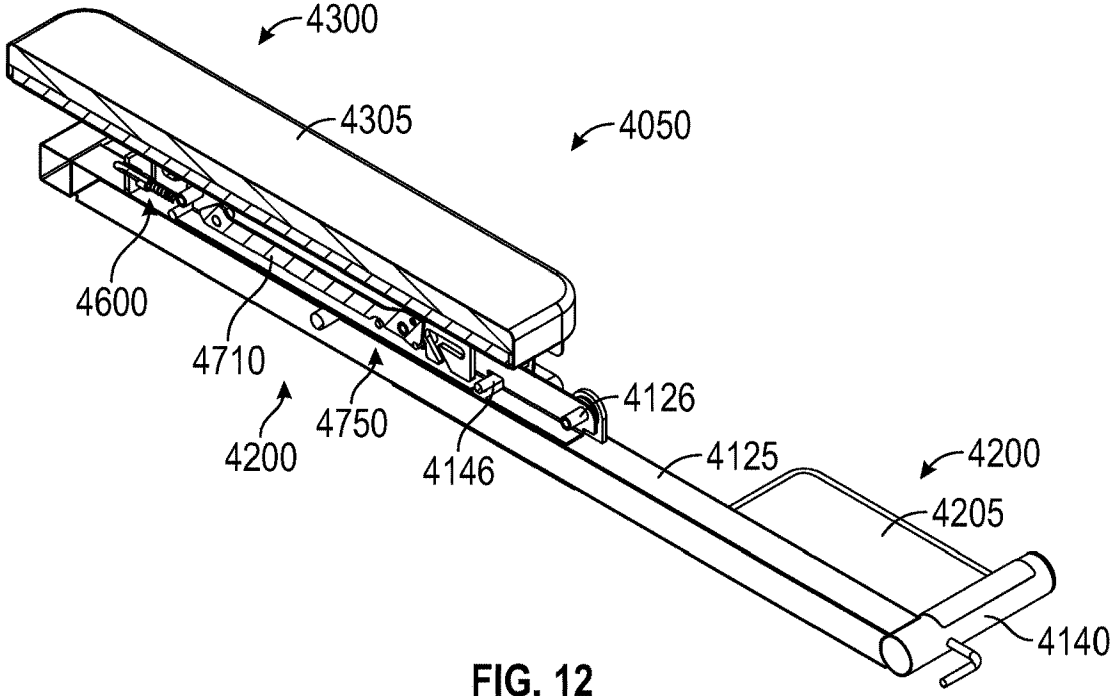
FIG. 12 is a perspective sectional view of the exercise apparatus of FIG. 1 taken along line 12-12 of FIG. 11.
Figure 11:
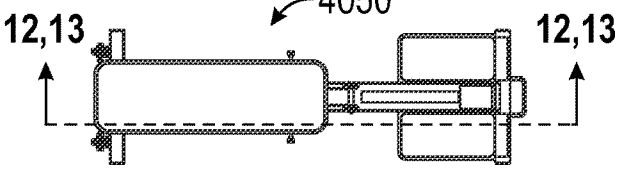
FIG. 11 is a top view of the exercise apparatus of FIG. 1 in the collapsed position.
Figure 13:
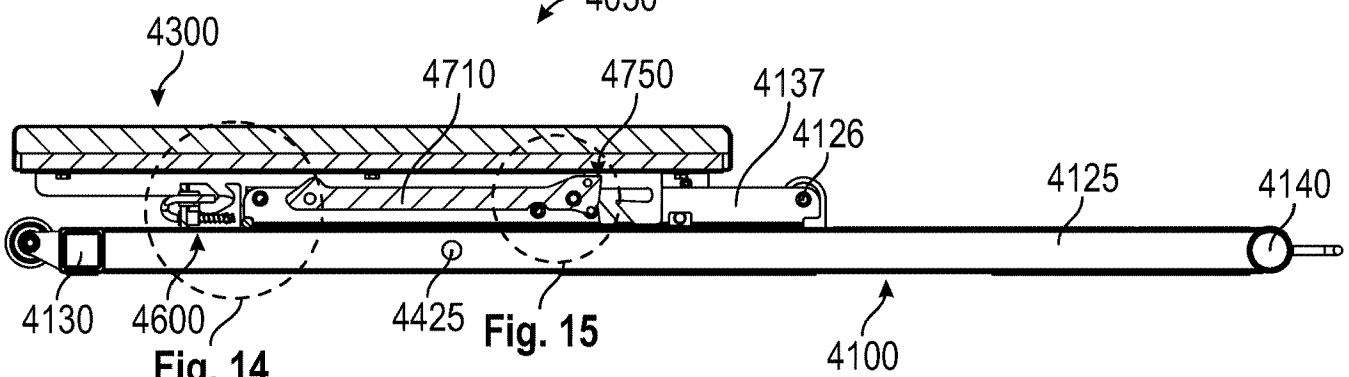
FIG. 13 is a side sectional view of the exercise apparatus of FIG. 1 taken along line 13-13 of FIG. 11.
Figure 15:
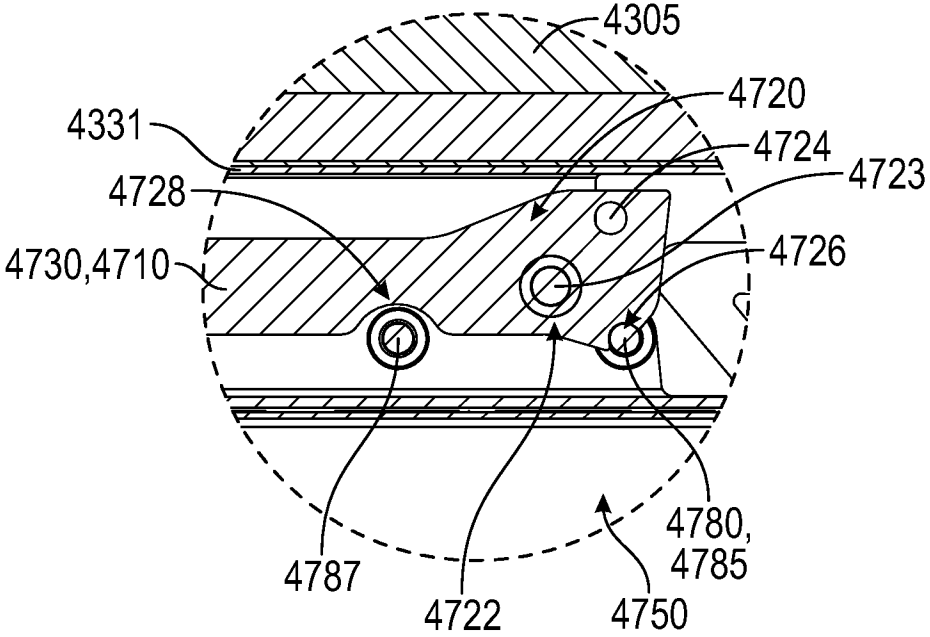
FIG. 15 is a second zoomed-in sectional view of FIG. 13 focusing on the interaction between the locking member and the front retaining mechanism.
Figure 14:
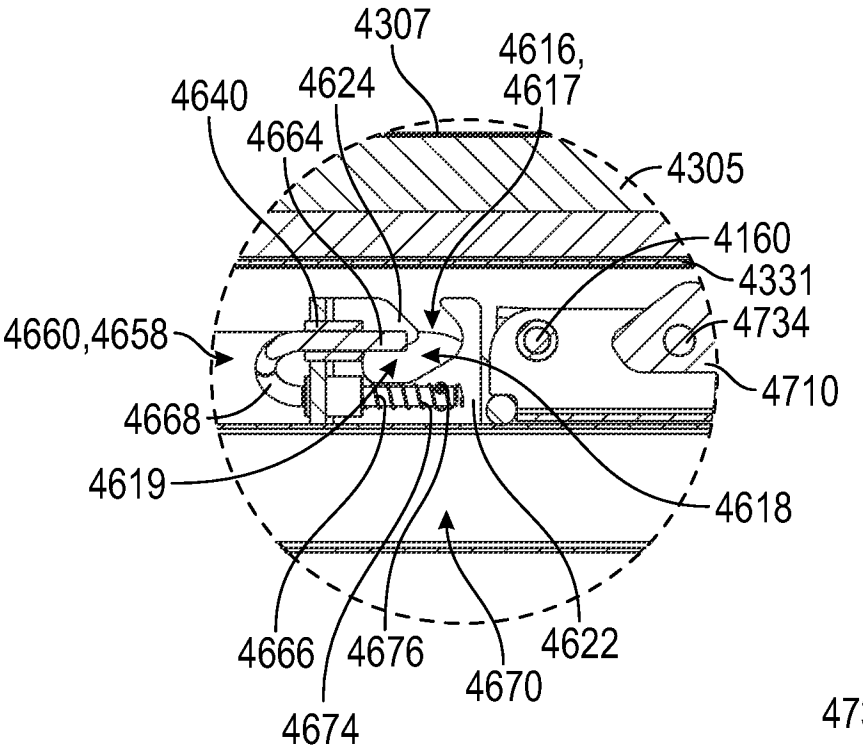
FIG. 14 is a first zoomed-in sectional view of FIG. 13 focusing on the rear retaining mechanism.
Figure 17:
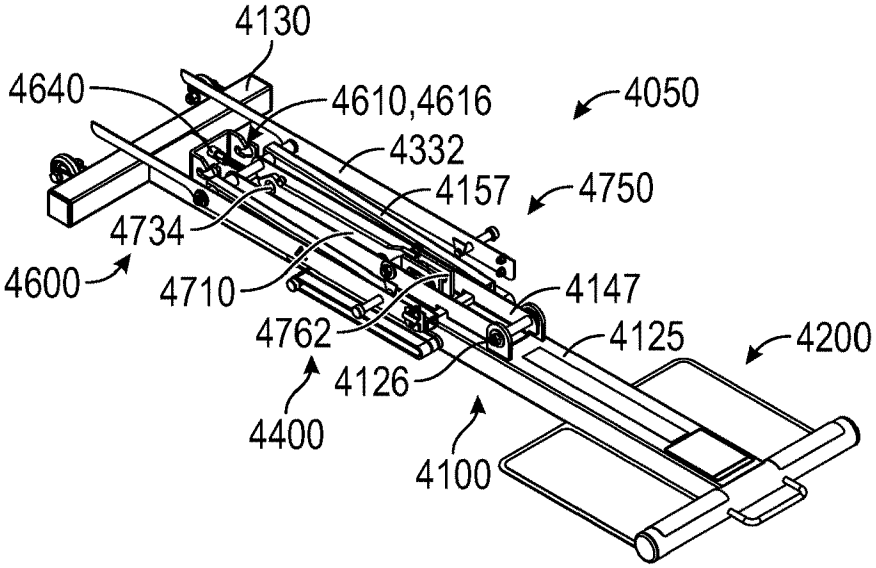
FIG. 17 is a perspective sectional view of the exercise apparatus of FIG. 1 taken along line 17-17 of FIG. 16.
Figure 16:
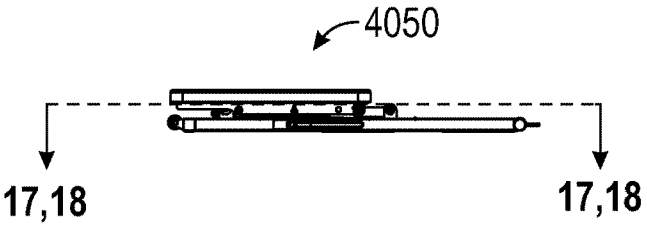
FIG. 16 is a side view of the exercise apparatus of FIG. 1 in the collapsed position.
Figure 18:
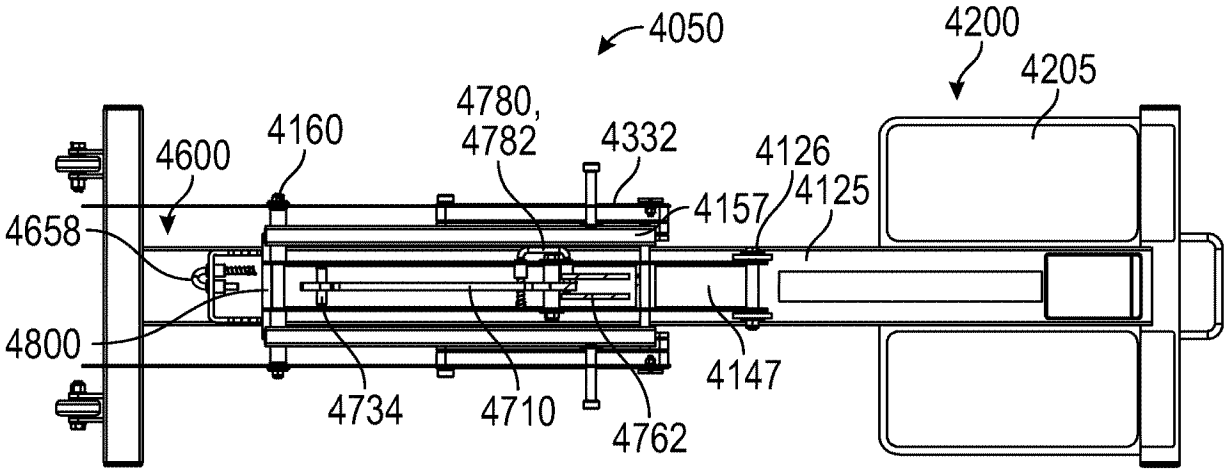
FIG. 18 is a top sectional view of the exercise apparatus of FIG. 1 taken along line 18-18 of FIG. 16.
Figure 20:
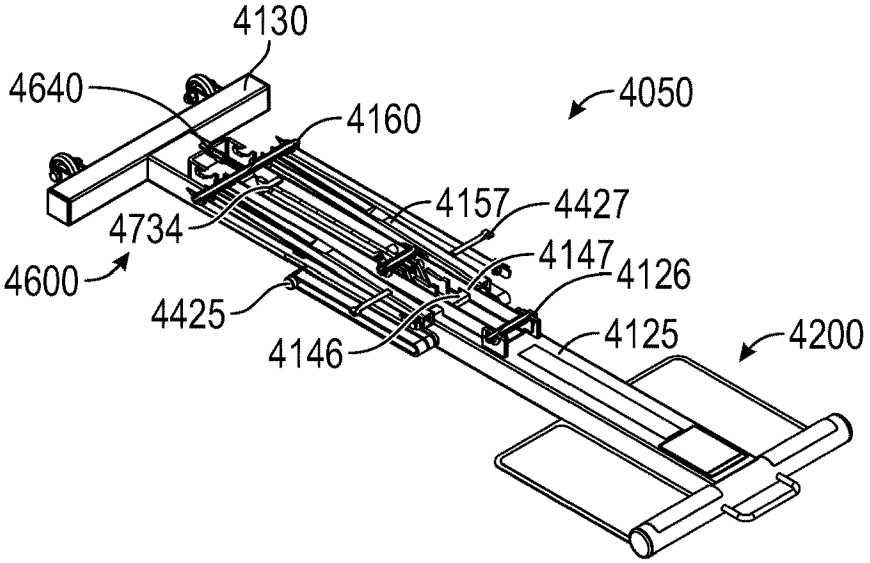
FIG. 20 is a perspective sectional view of the exercise apparatus of FIG. 1 taken along line 20-20 line of FIG. 19.
Figure 19:
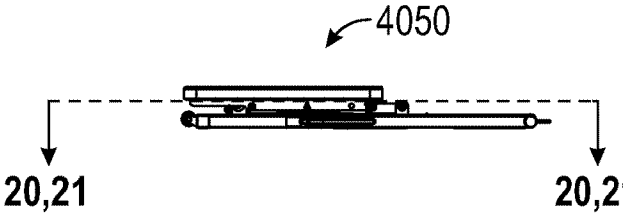
FIG. 19 is a side view of the exercise apparatus of FIG. 1 in the collapsed position.
Figure 21:
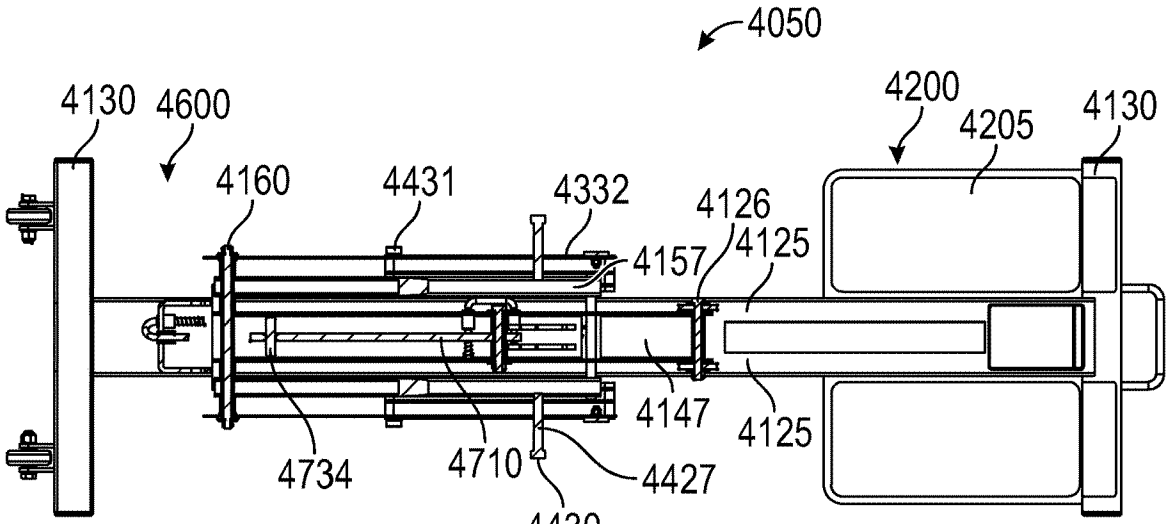
FIG. 21 is a top sectional view of FIG. 71 of the exercise apparatus of FIG. 1 taken along line 21-21 of FIG. 19.
Figure 23:
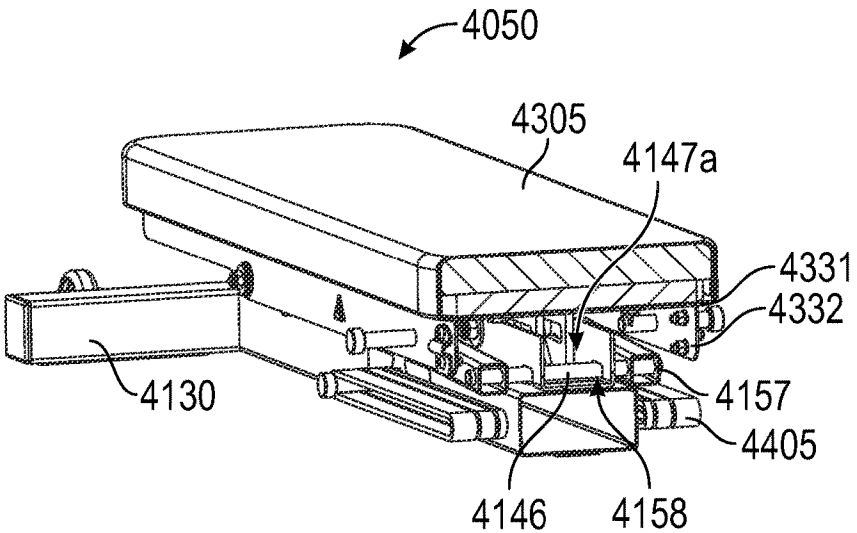
FIG. 23 is a perspective sectional view of the exercise apparatus of FIG. 1 taken along line 23-23 of FIG. 22.
Figure 24:
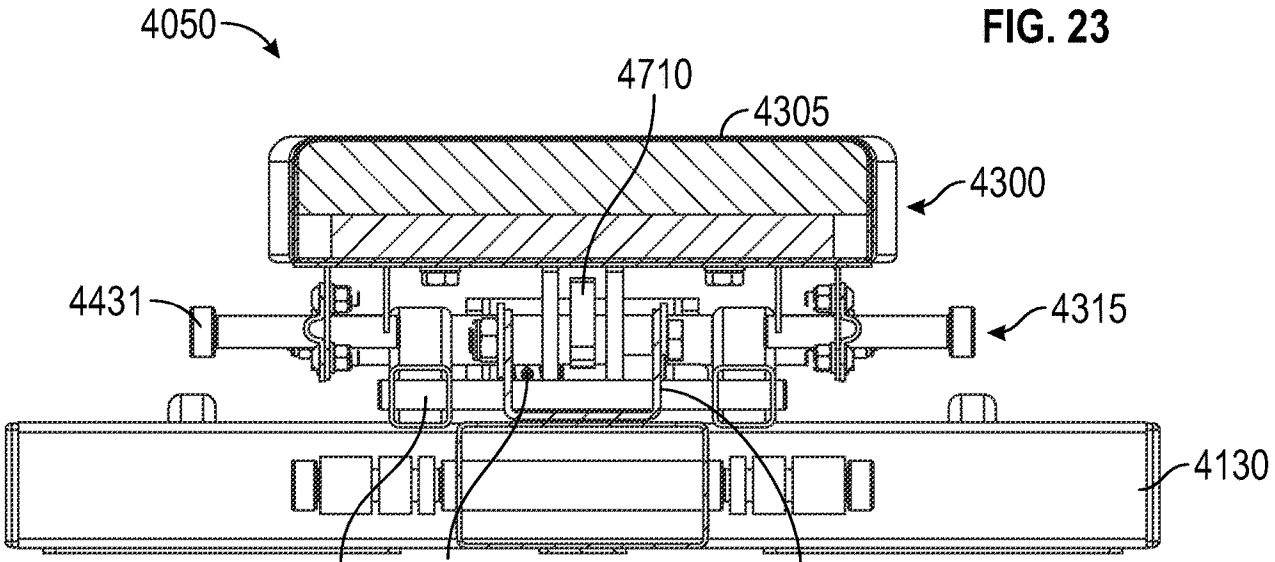
FIG. 24 is an end sectional view of the exercise apparatus of FIG. 1 taken along line 24-24 of FIG. 22.
Figure 22:
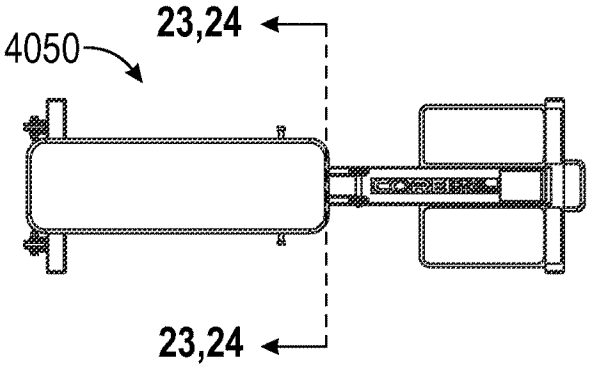
FIG. 22 is a top view of the exercise apparatus of FIG. 1 in the collapsed position.
Figure 26:
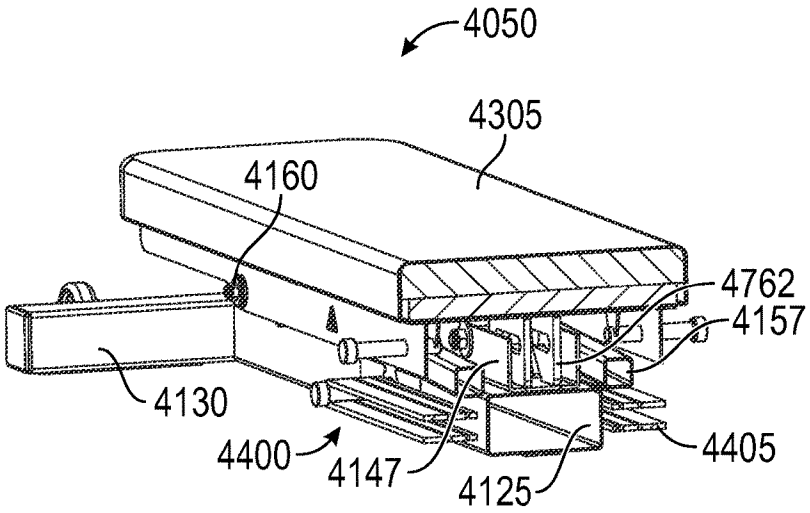
FIG. 26 is a perspective sectional view of the exercise apparatus of FIG. 1 taken along line 26-26 of FIG. 25.
Figure 27:
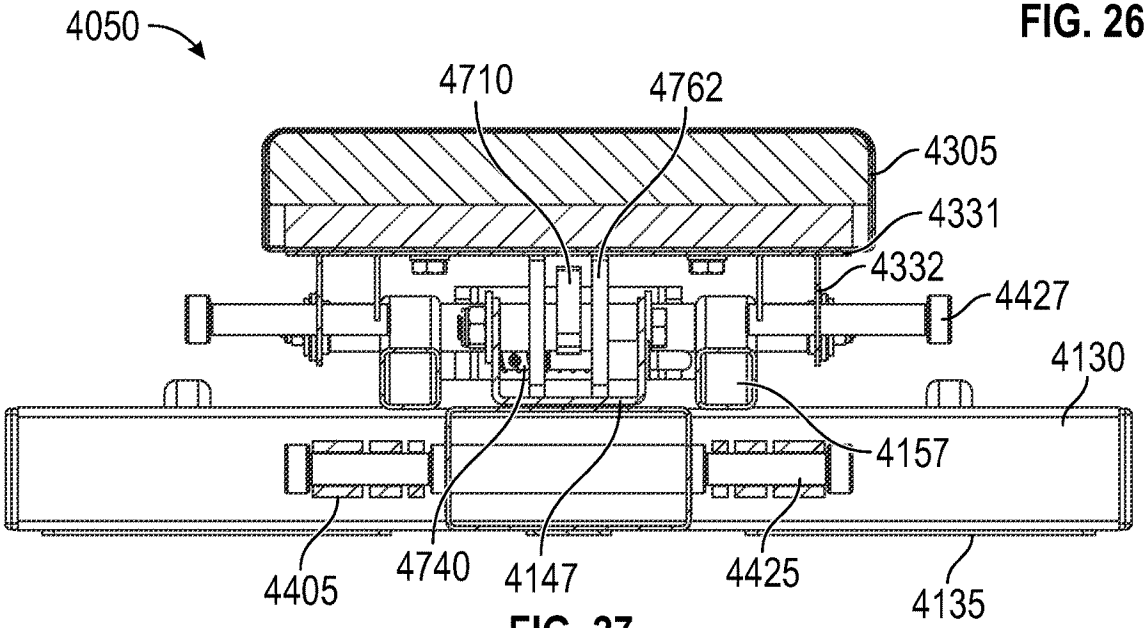
FIG. 27 is an end sectional of the exercise apparatus of FIG. 1 taken along line 27-27 of FIG. 25.
Figure 25:
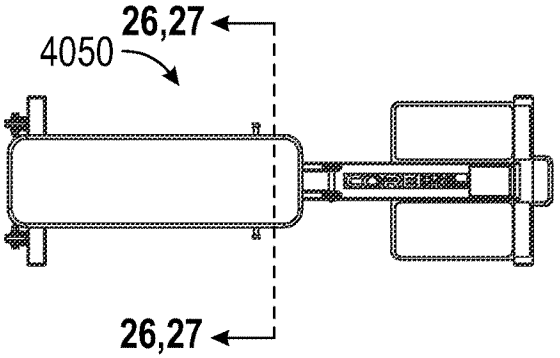
FIG. 25 is a top view of the exercise apparatus of FIG. 1 in the collapsed position.
Figure 28:
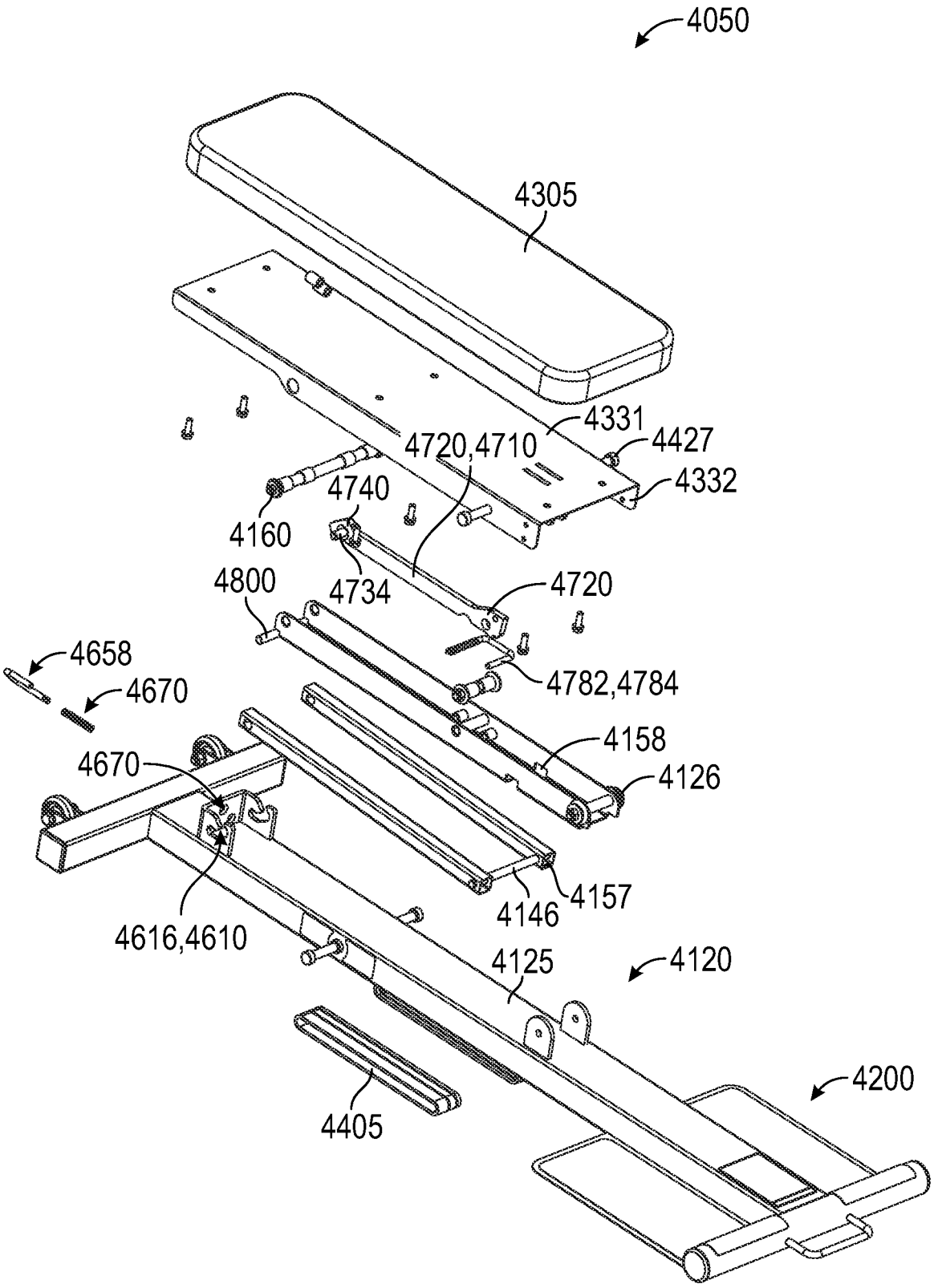
FIG. 28 is an exploded view of the exercise apparatus of FIG. 1 in the collapsed position.
Figure 29:
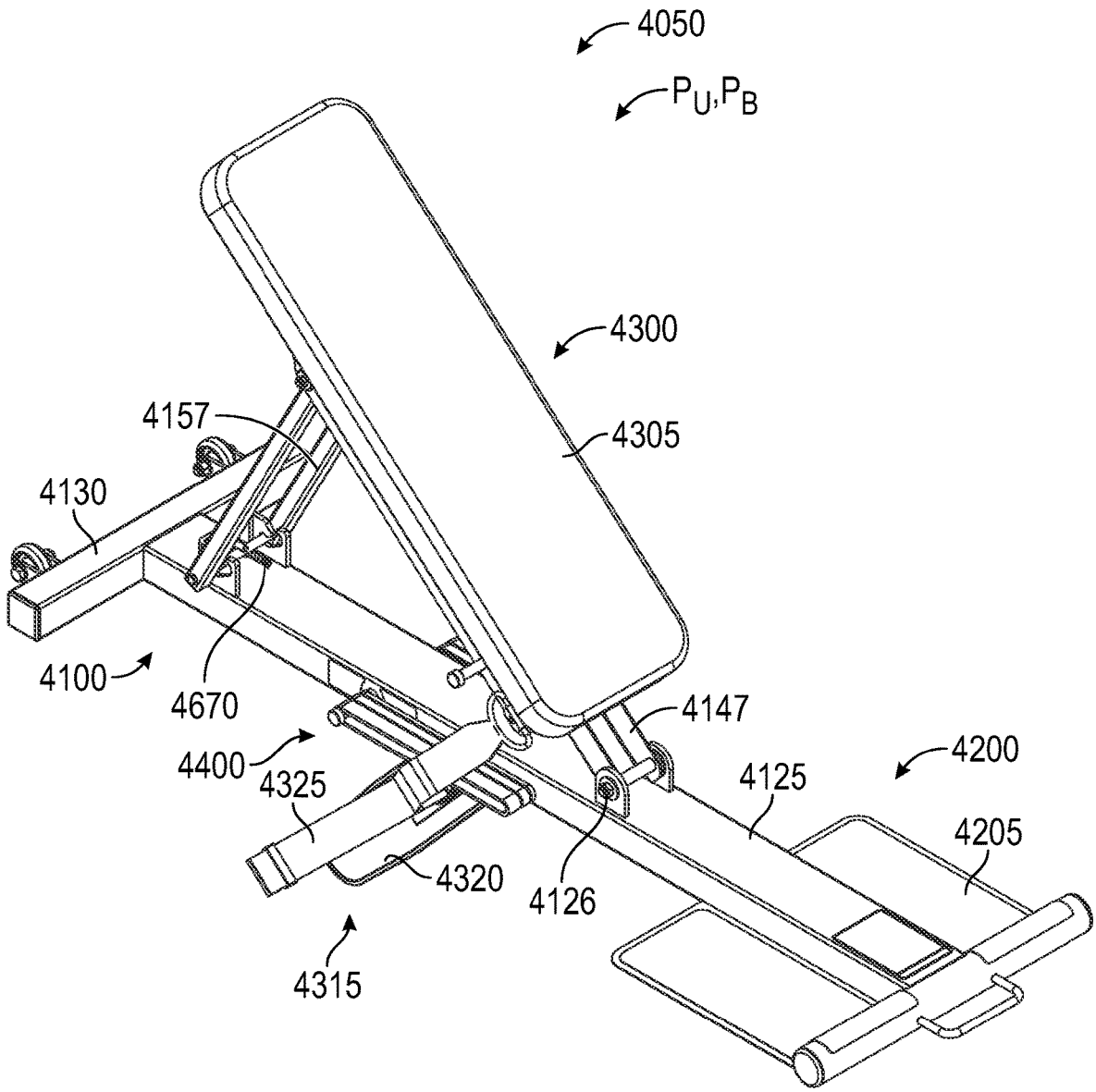
FIG. 29 is a perspective view of the first embodiment of an exercise apparatus for performing both a gluteal bridge movement and flat bench exercises, the exercise apparatus shown in a ready to use position.
Figure 30:
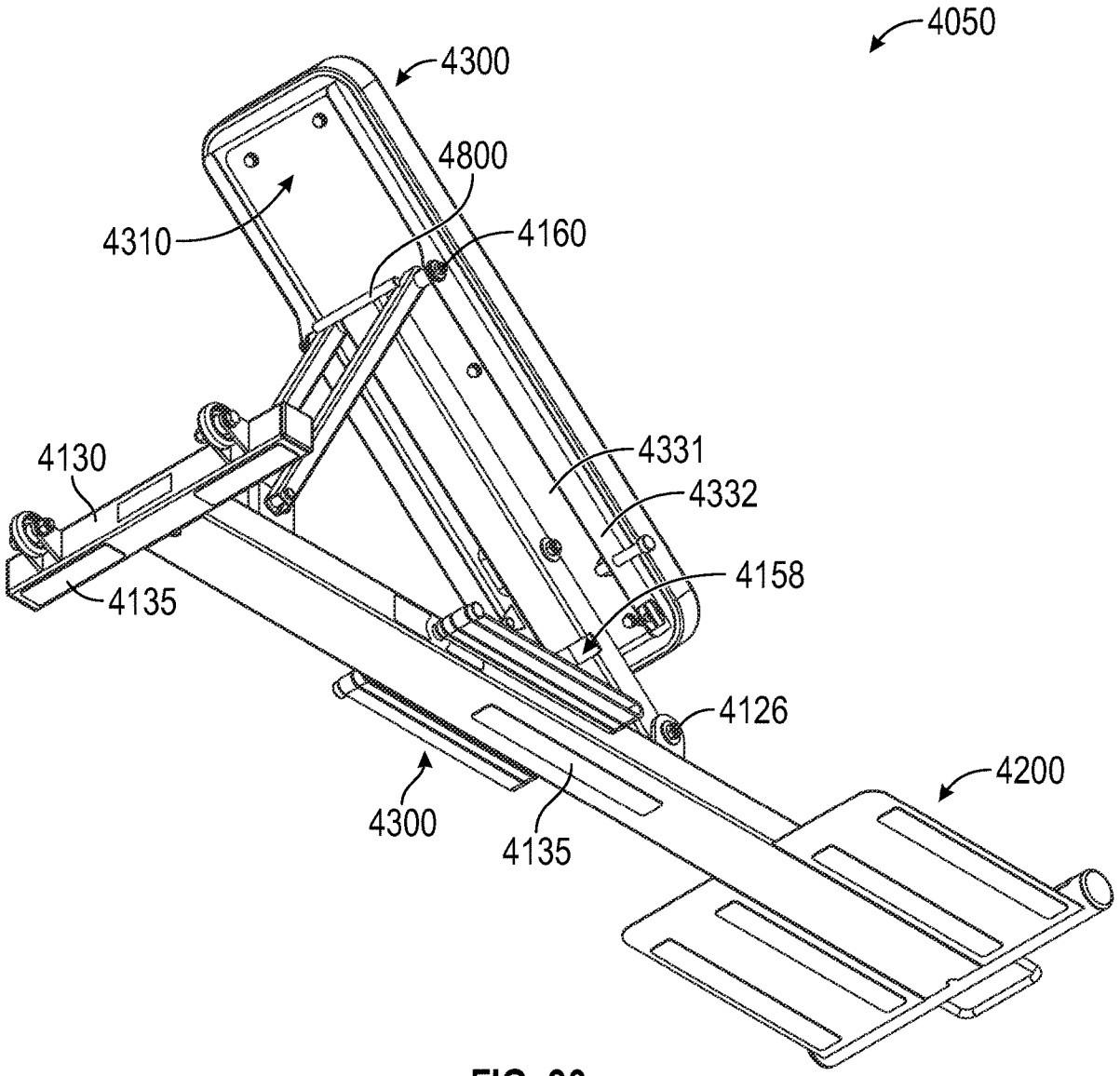
FIG. 30 is a rear perspective view of the exercise apparatus of FIG. 29.
Figure 31:
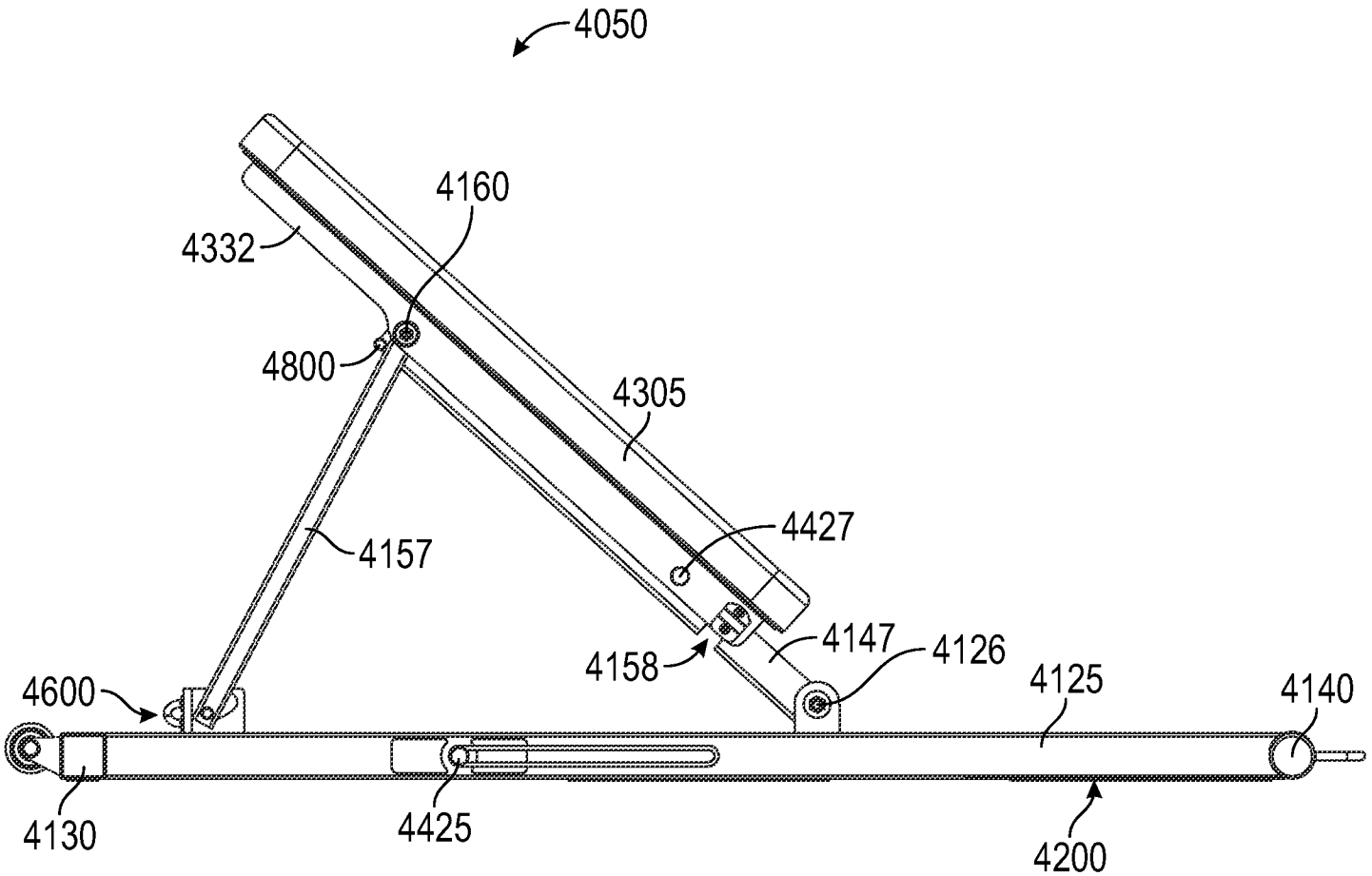
FIG. 31 is a right side view of the exercise apparatus of FIG. 29.
Figure 41:
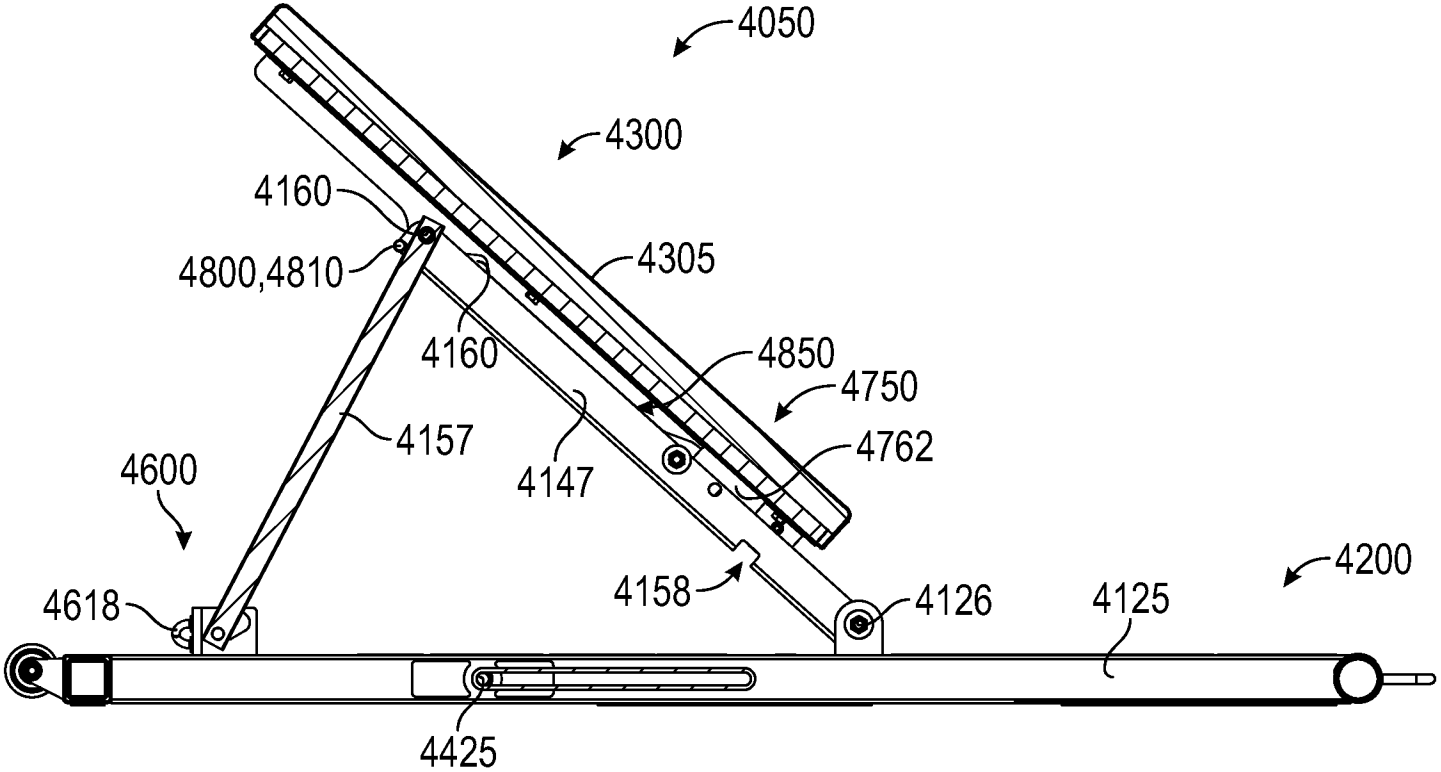
FIG. 41 is a side sectional view of the exercise apparatus of FIG. 29 taken along line 41-41 of FIG. 40.
Figure 42:
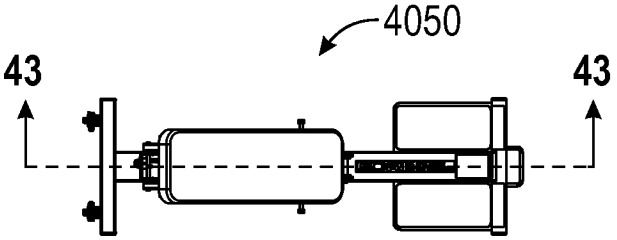
FIG. 42 is a top view of the exercise apparatus of FIG. 29 in the ready to use position.
Figure 43:
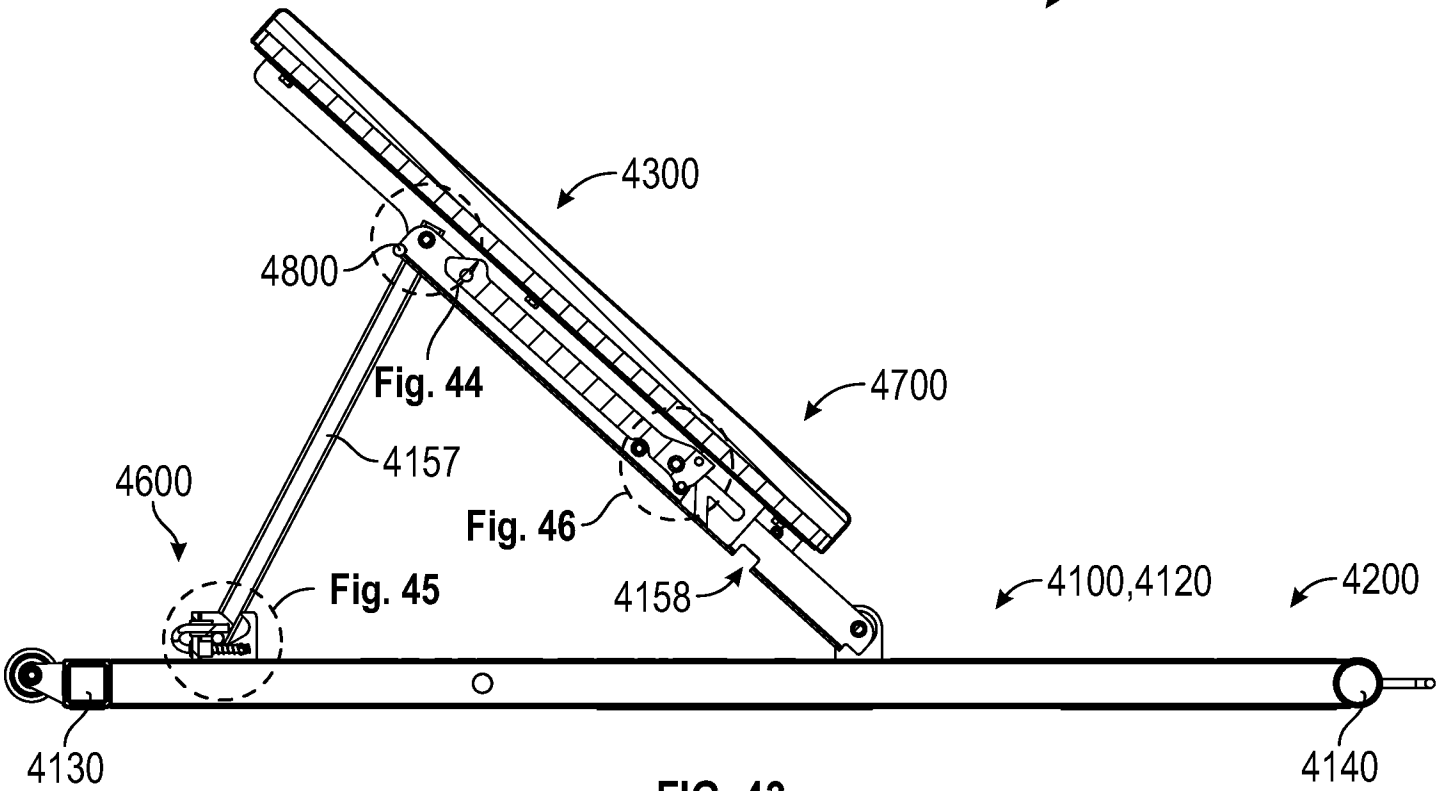
FIG. 43 is a side sectional view of the exercise apparatus of FIG. 29 taken along line 43-43 of FIG. 42.
Figure 44:
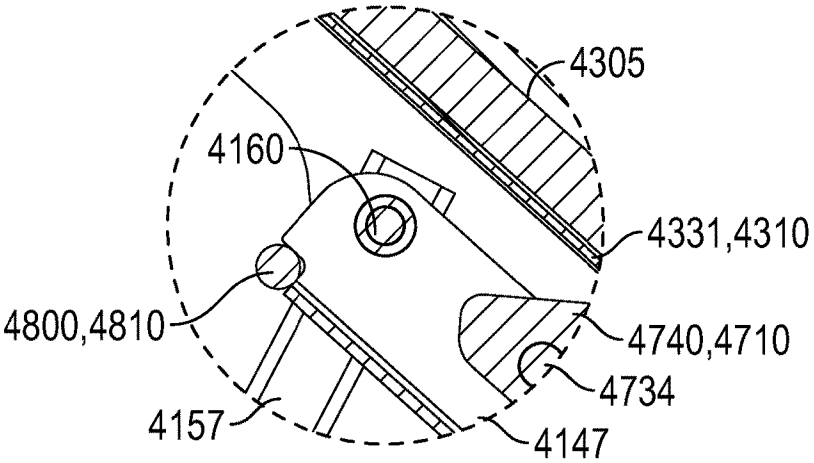
FIG. 44 is a first zoomed-in sectional view of FIG. 43 focusing on the elevated pivot point.
Figure 46:
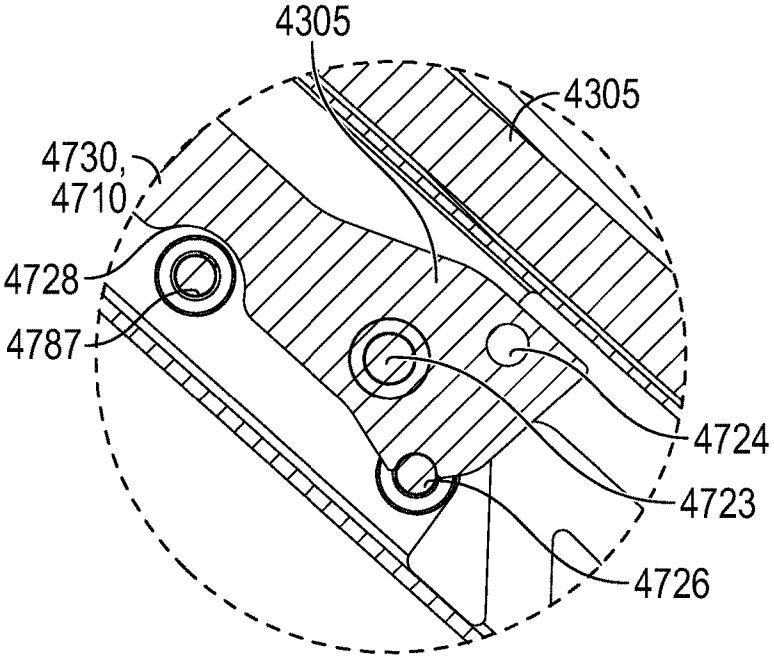
FIG. 46 is a third zoomed-in sectional view of FIG. 43 focusing on the interaction between the locking member and the front retaining mechanism.
Figure 45:
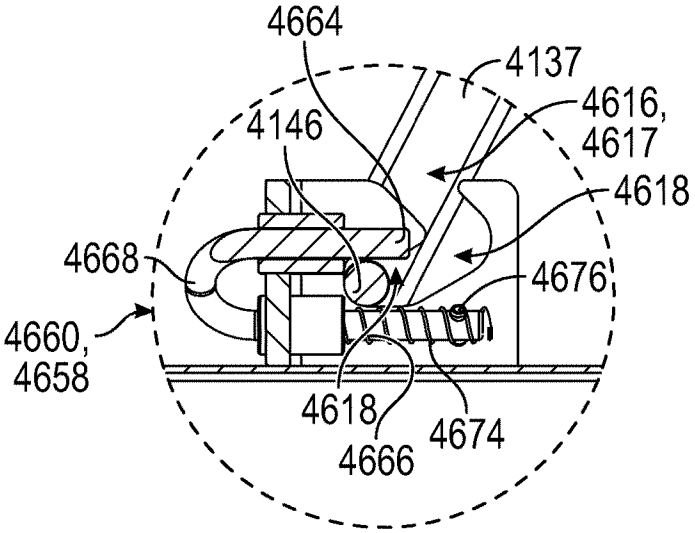
FIG. 45 is a second zoomed-in sectional view of FIG. 43 focusing on the rear retaining mechanism.
Figure 47:
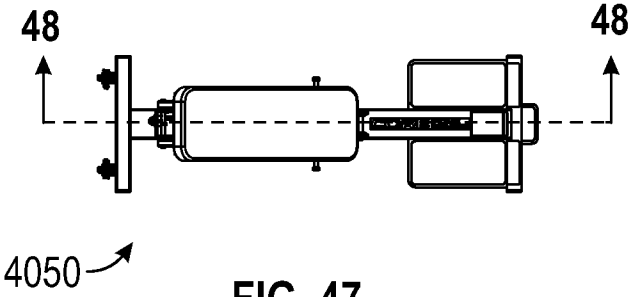
FIG. 47 is a top view of the exercise apparatus of FIG. 29 in the ready to use position.
Figure 48:
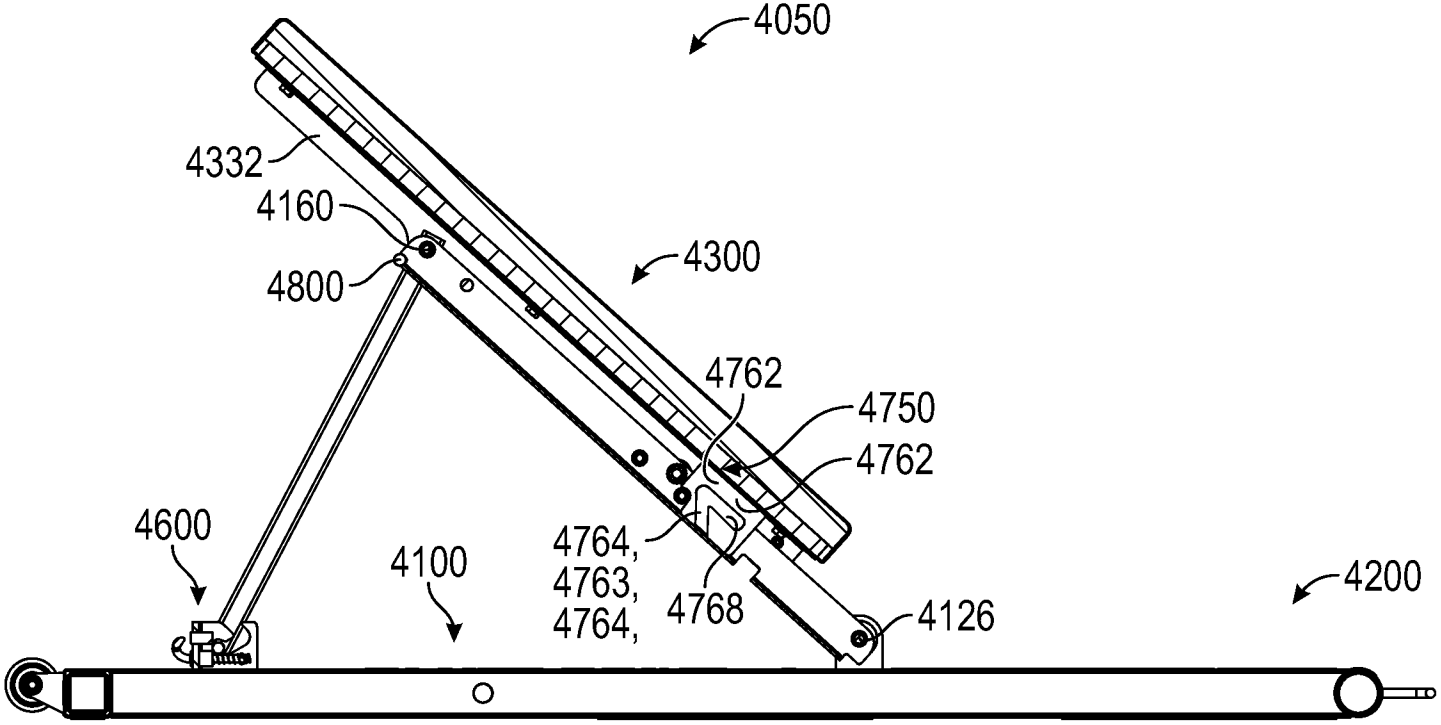
FIG. 48 is a side sectional view of the exercise apparatus of FIG. 29 taken along line 48-48 of FIG. 47.
Figure 50:
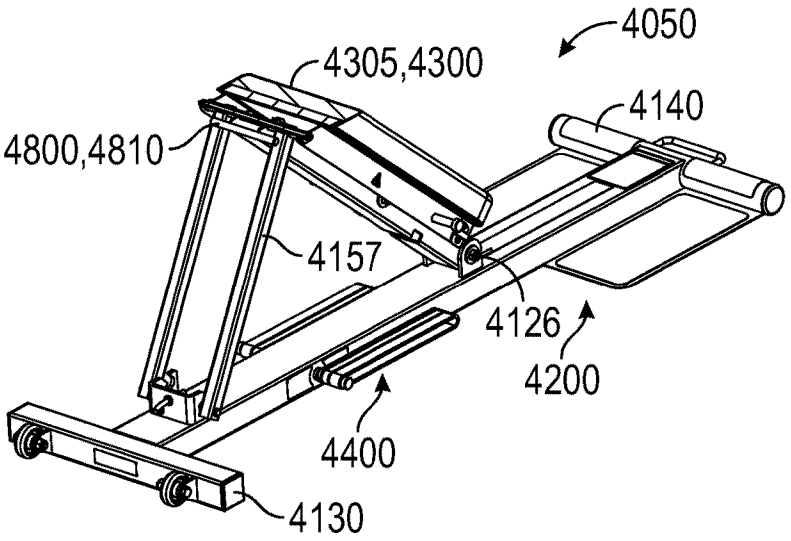
FIG. 50 is a perspective sectional view of the exercise apparatus of FIG. 29 taken along line 50-50 of FIG. 49.
Figure 49:
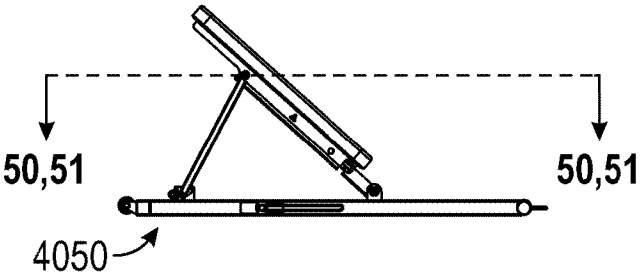
FIG. 49 is a side view of the exercise apparatus of FIG. 29 in the ready to use position.
Figure 51:
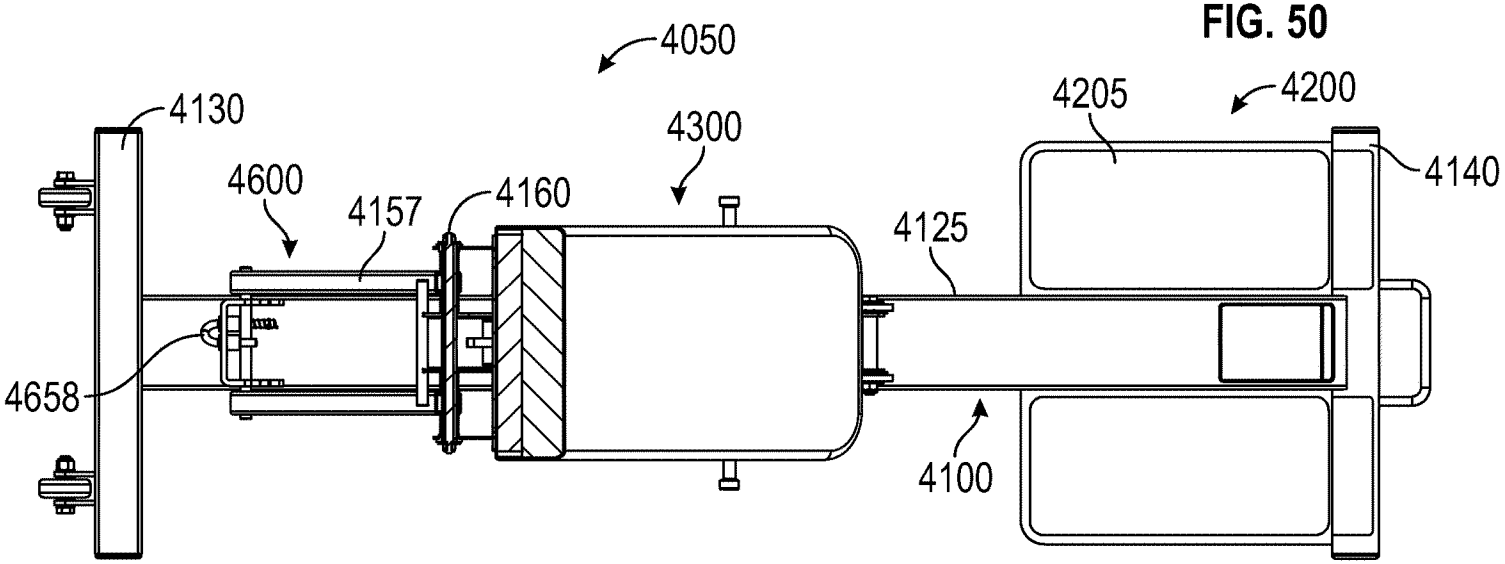
FIG. 51 is a top sectional view of the exercise apparatus of FIG. 29 taken along line 51-51 of FIG. 49.
Figure 54:
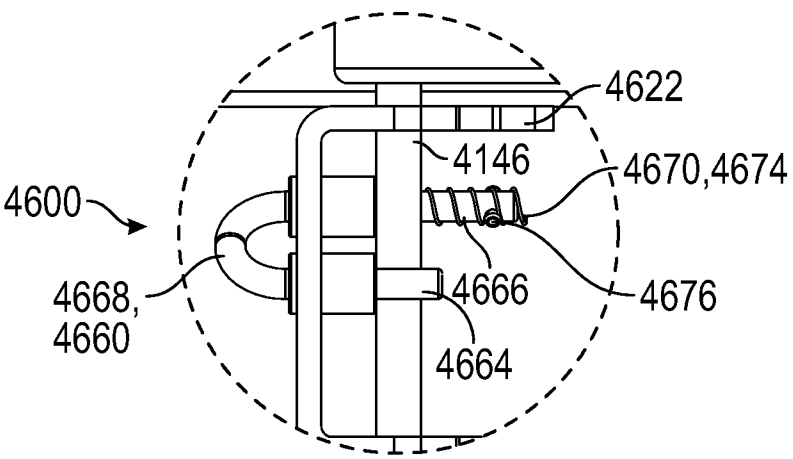
FIG. 54 is a zoomed-in view of FIG. 53 focusing on the rear retaining mechanism.
Figure 52:
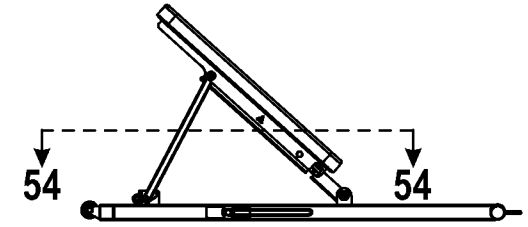
FIG. 52 is a side view of the exercise apparatus of FIG. 29 in the ready to use position.
Figure 53:
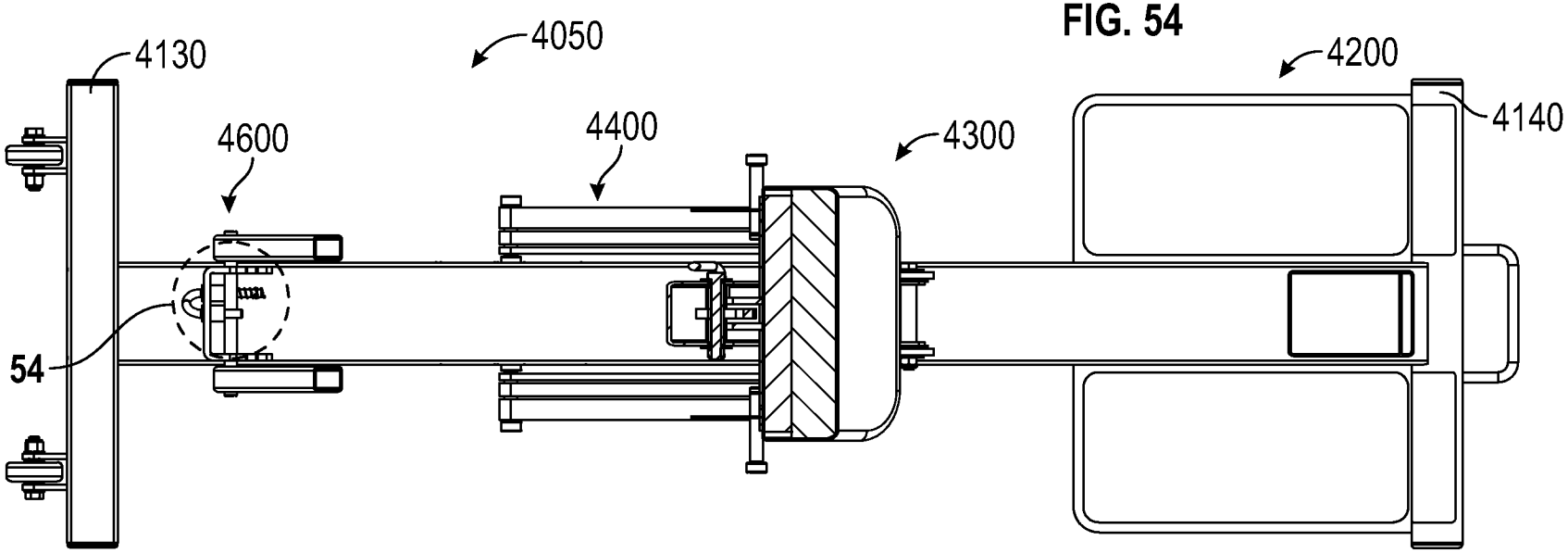
FIG. 53 is a top sectional view of the exercise apparatus of FIG. 29 taken along line 53-53 of FIG. 52.
Figure 56:
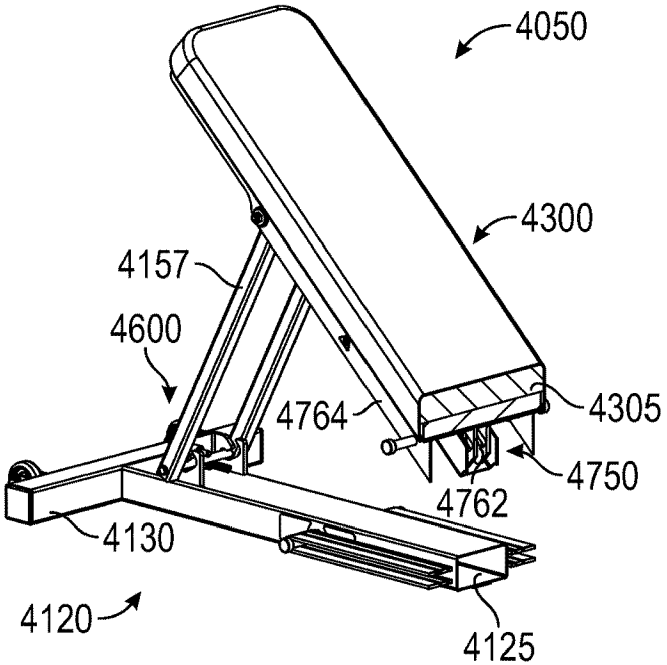
FIG. 56 is a perspective sectional view of the exercise apparatus of FIG. 29 taken along line 56-56 of FIG. 55.
Figure 57:
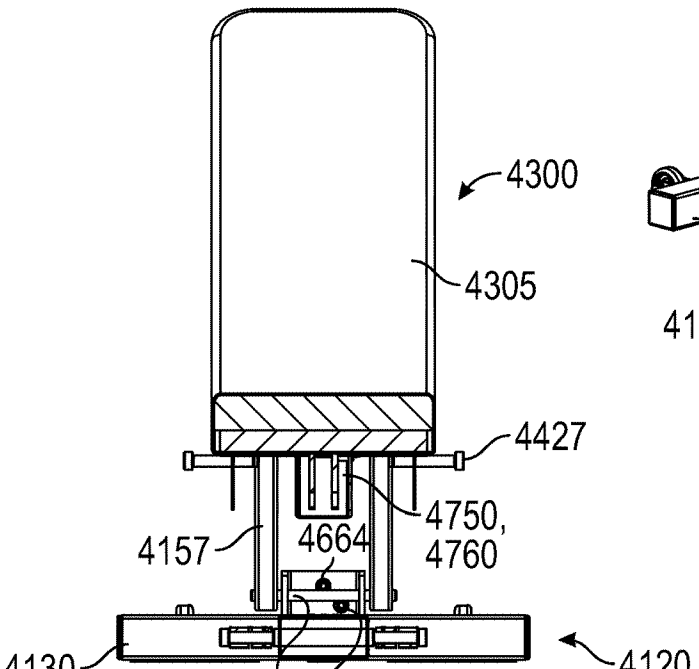
FIG. 57 is an end section view of the exercise apparatus of FIG. 29 taken along line 57-57 of FIG. 55.
Figure 55:
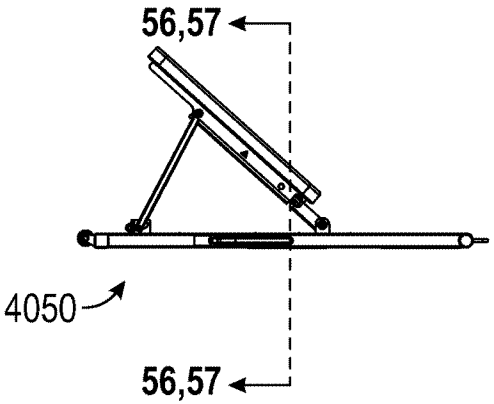
FIG. 55 is a side view of the exercise apparatus of FIG. 29 in the ready to use position.
Figure 59:
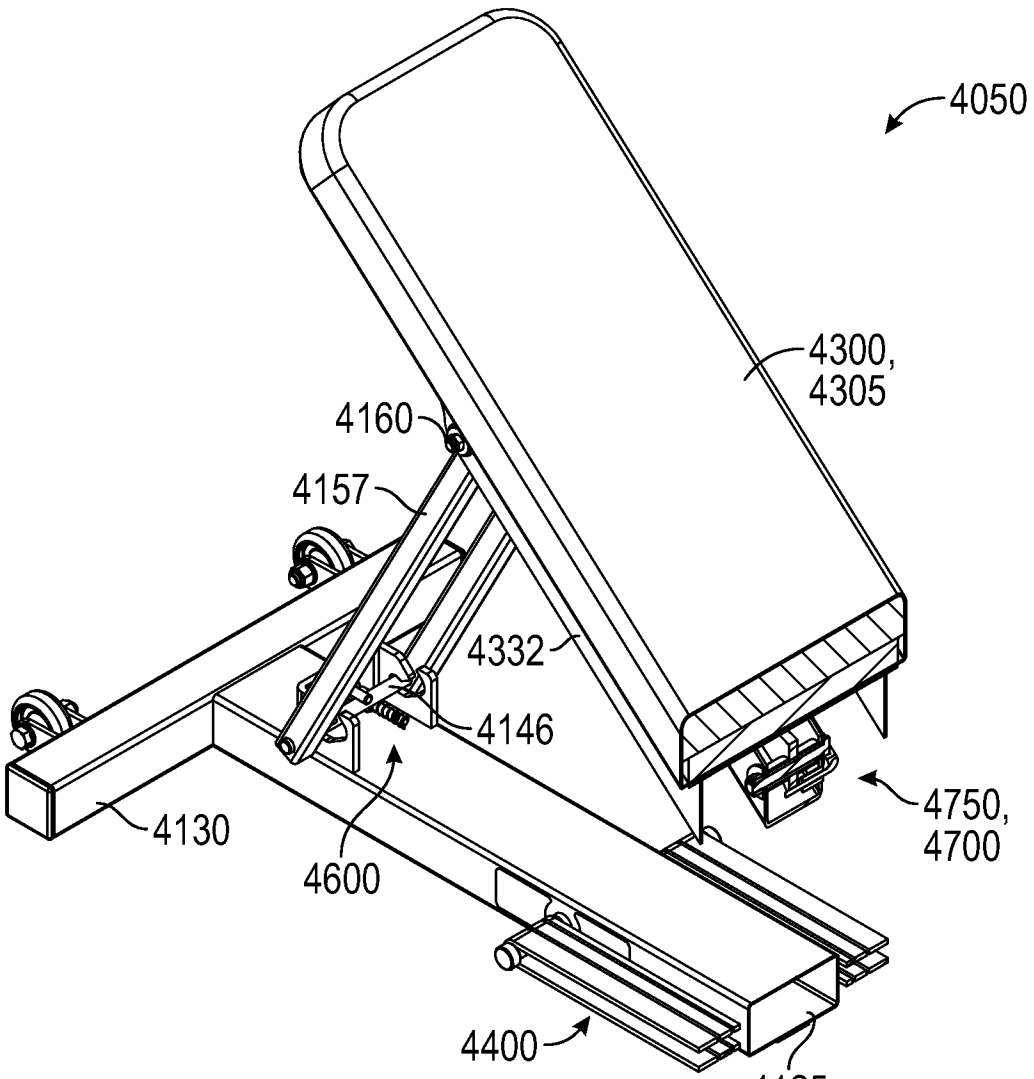
FIG. 59 is a perspective sectional view of the exercise apparatus of FIG. 29 taken along line 59-59 of FIG. 58.
Figure 58:
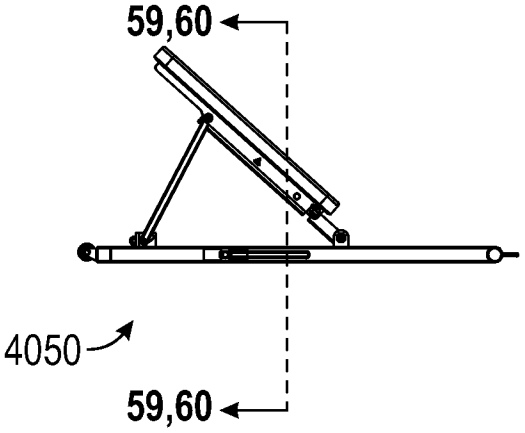
FIG. 58 is a side view of the exercise apparatus of FIG. 29 in the ready to use position.
Figure 61:
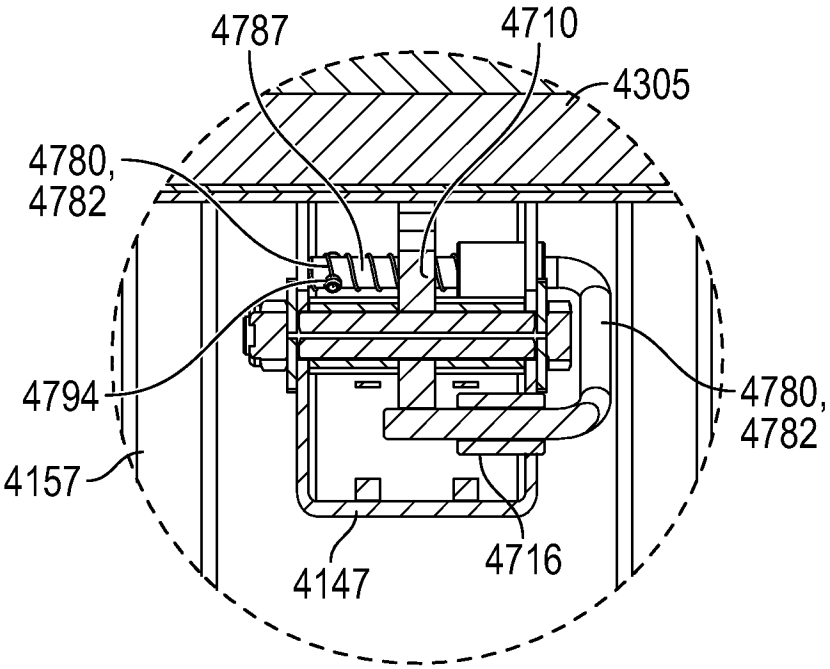
FIG. 61 is a zoomed-in sectional view of FIG. 60 focusing on front retaining mechanism.
Figure 60:
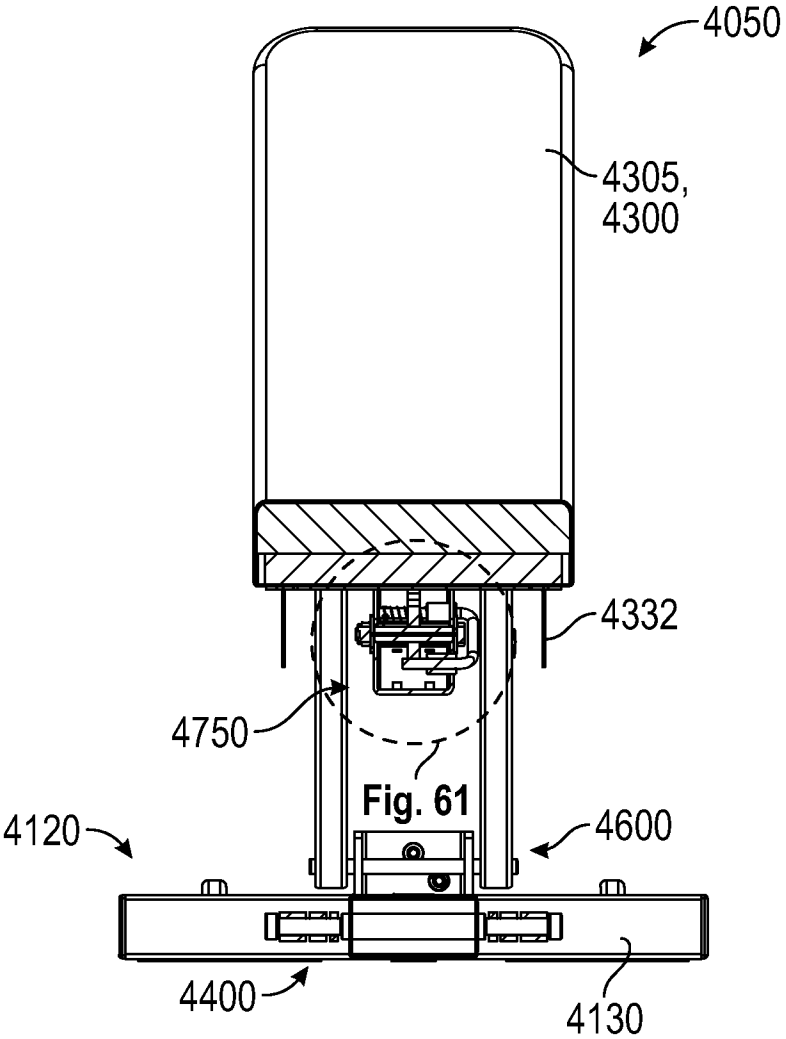
FIG. 60 is an end sectional view of the exercise apparatus of FIG. 29 taken along line 60-60 of FIG. 59.
Figure 62:
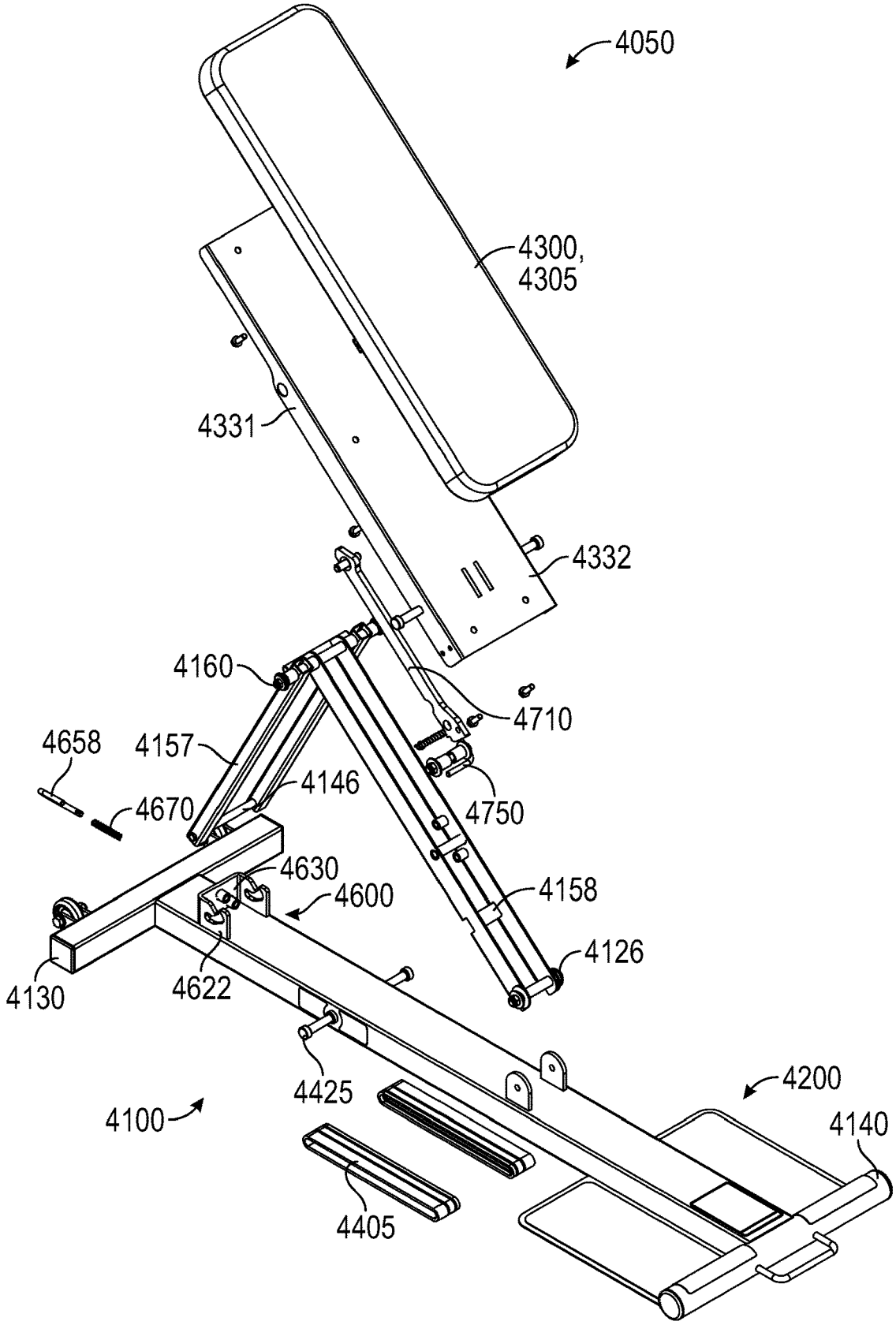
FIG. 62 is an exploded view of the exercise apparatus of FIG. 29.
Figure 63:
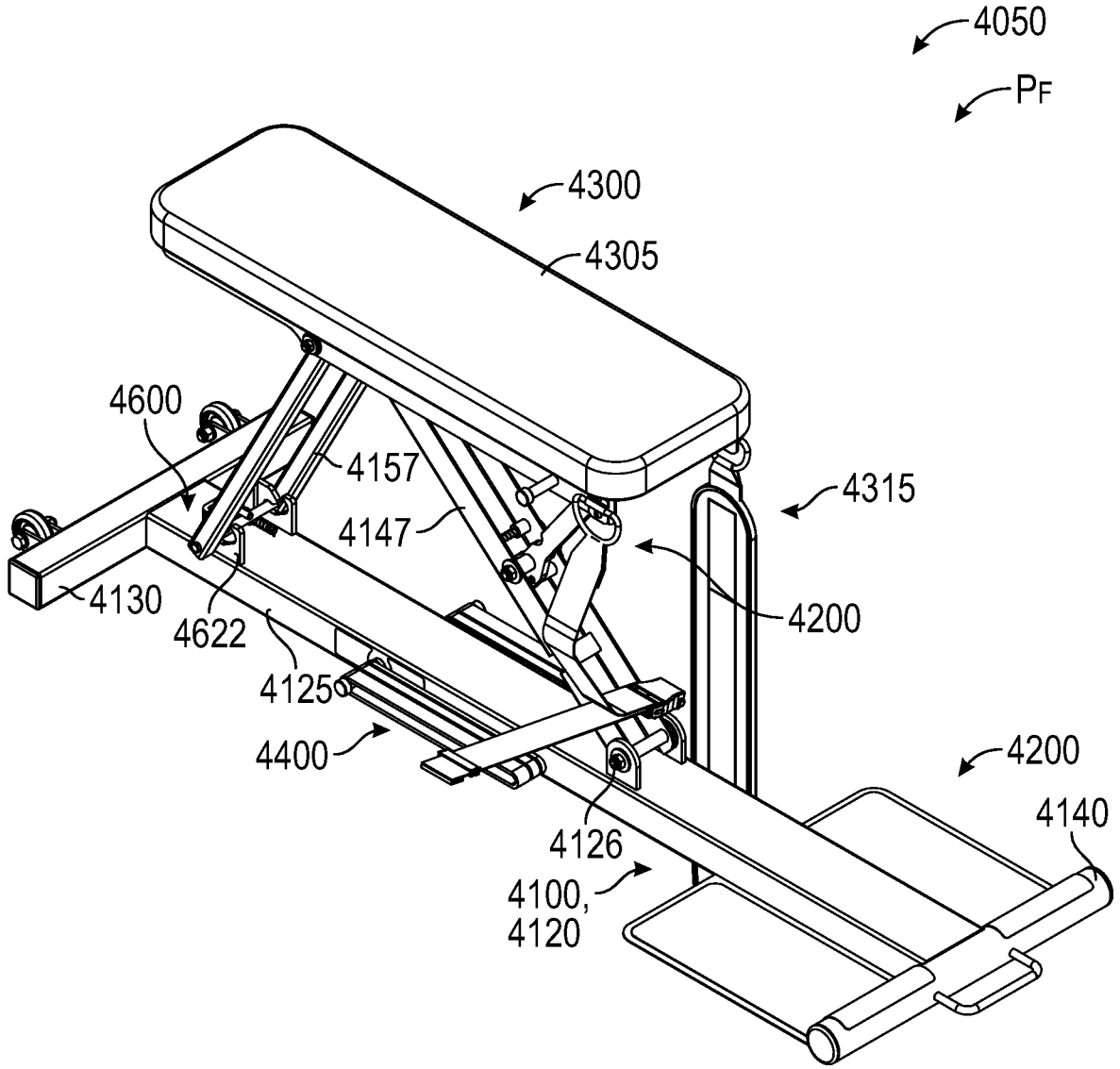
FIG. 63 is a perspective view of the first embodiment of an exercise apparatus for performing both a gluteal bridge movement and flat bench exercises, the exercise apparatus shown in a flat bench position.

As seen in at least FIGS. 3, 31, and 41, the front support member 4147 is pivotable affixed to: (i) the a lower portion of the frame assembly 4120 via a front elongated fastener 4126 and (ii) the bench assembly 4300 via pivot point fastener 4160 at the pivot point, PP. In other words, a lower extent of the front support member 4147 is pivotable affixed to central member 4125 and cannot be displaced along an extent of the frame assembly 4120. The front support member 4147 is coupled to the disclosed structures via mechanical, chemical, or a combination of these coupling methods. As best shown in FIGS. 17-18, 23-24, 28, 29, 56-57, 61, 62, 69, 72, and 90, the front support member 4147 is U-shaped. This U-shape configuration allows for the front support member 4147 to receive an extent of the bumper assembly 4900, which is disclosed in greater detail below. As shown in FIGS. 9, 17, 23, the front support member 4147 also includes a cross-bar aperture 4158 that is configured to receive an extent of the cross-bar 4146 when the apparatus 4050 is in the collapsed position. This cross-bar aperture 4158 allows the apparatus 4050 to further reduce the overall height of the apparatus 4050 in the collapsed position by over 2 inches (~30% reduction). This is beneficial when a user is attempting to store the apparatus 4050 under their bed within their home. In an additional embodiment, the front support member 4147 may be replaced with a pair of front support members.

As best shown in FIGS. 32, 41, 62, 66, and 72, the pair of rear support members 4157 are: (i) removably coupled to the central member 4125 via the cross-bar's 4146 interaction with the rear retaining mechanism 4600 and (ii) coupled to the bench assembly 4300 via pivot point fastener 4160 at the pivot point, PP. The pair of rear support members 4157 are coupled to the disclosed structures via mechanical, chemical, or a combination of these coupling methods. Once the pair of rear support members 4157 are released from the rear retaining mechanism 4600, a user can move the cross-bar 4146 towards the front of the apparatus 4050 and lower the top end of the bench assembly 4300 towards the floor, F. This motion finishes when the cross-bar 4146 is positioned within a cross-bar aperture 4158 and thus the apparatus 4050 is in the collapsed position. The frame assembly 4120 optionally includes at least one front wheel 4184 and preferably two wheels.

B. Rear Retaining Mechanism

As best shown in FIGS. 7, 14, 18, 32, 39, 45, 54, 66, 73, 82, 86, 92, and 96, coupled to the frame assembly 4120 is a rear retaining mechanism 4600, which allows the apparatus 4050 to be moved from the collapsed position, $P_C$, then move the apparatus 4050 into the read to use position, $P_U$, and then move the apparatus 4050 back into the collapsed position, $P_C$. This is desirable because this apparatus 4050 is typically used within a spa, studio, or home, where storage of an un-collapsed apparatus 4050 is undesirable due to space constrains and aesthetics.

The rear retaining mechanism 4600 includes: (i) a rear receiver 4610 and (ii) a rear coupler 4660. The rear receiver 4610 in the embodiment shown in the Figures is a rear retaining channel 4616 that is formed within a pair of opposed sidewalls 4622. The pair of opposed sidewalls 4622 are coupled to an extent from the top surface 4125*a* of the central member 4125. As such the sidewalls 4622 are positioned above the deck assembly 4200, but below the pivot point, PP. As best shown in FIGS. 39, 45, 51, 73, 78, 82, 86, 93, and 96, the rear retaining channel 4616 has multiple segments, which function together to retain the cross-bar 4146 of the pair of rear support members 4157 when it is positioned within the rear retaining channel 4616. These multiple segments include: (i) a first forward and downward slanting segment 4617, (ii) a second rearward and downward slanting segment 4618, and (iii) a third rearward facing segment 4619. This arrangement of these segments 4617, 4618, 4619 forms a first projection 4624 that helps ensure that the cross-bar 4146 cannot simply be removed from the rear retaining channel 4616 via a vertical force. In fact, to place the cross-bar 4146 at the end of the rear retaining channel 4616 or to remove the cross-bar 4146 from the end of the rear retaining channel 4616, the user, U, must apply a complex and curvilinear motion on the cross-bar 4146. It should be understood that the rear retaining channel 4616 may have other shapes, additional segments, or fewer segments. For example, the rear retaining channel 4616 may be substantially curvilinear or bi-linear (e.g., C-shaped, L-shaped, N-shaped, S-shaped, V-shaped, Z-shaped), a combination of these shapes, or a modified version of one or a combination of these shapes (e.g., the horizontal segment of the L-shaped channel may be slanted to form an obtuse angle with the bottom segment of the L-shaped channel).

In addition to the opposed sidewalls 4622 and the rear retaining channel 4616, the rear retaining mechanism 4600 includes a rear wall 4630 that adjoins the opposed sidewalls 4622. This rear wall 4630 is designed to provide additional rigidity to the combination of opposed sidewalls 4622 and to hold the rear coupler 4660 in the proper position. As best shown in FIGS. 14, 28, 86, 93, and 96, the rear wall 4630 includes two openings 4634, 4636 that are configured to receive the rear coupler 4660. The two openings 4634, 4636 are not aligned vertically or horizontally. Positioned within the two openings 4634, 4636 are bushings 4640, 4642, which are design to eliminate the metal on metal contact of the rear coupler 4660 and the rear wall 4630. This design attempts to: (i) reduce undesired noises, (ii) reduce the friction and thus the force required to move the coupler, (iii) allow for larger tolerances within manufacturing of these components. The combination of these beneficial attributes work together in an attempt to improve the user's interaction with the apparatus 4050. It should be understood that these bushings 4640, 4642 may be made from a plastic or polymeric material, may be smaller, or have an alternative shape. In an alternative embodiment, it should be understood that these bushings 4640, 4642 may be omitted.

As best shown in FIGS. 14, 17-18, 28, 43, 45, 54, 73, 78, 82, 86, 93, and 96, the rear coupler 4660 of the rear retaining mechanism 4600 include: (i) a U-shaped structure 4658 and (ii) a biasing assembly 4670. The U-shaped structure 4658 is comprised of: (i) a first extent 4664 that is designed to be positioned within the first opening 4634, a second extent 4666 that is designed to be positioned within the second opening 4636, and a third extent 4668 that couples the first and second extents to one another. When the apparatus 4050 is in the second ($P_U$), third ($P_B$), fifth ($P_E$) (see FIGS. 37, 45, 54, 73, 76, 78, 82, 86, 93, and 96), the first extent 4664 is configured to be positioned above the cross-bar 4146 and the second extent 4666 is configured to be positioned below the cross-bar 4146. In addition to this positional relationship, the first extent 4664 is cooperatively dimensioned with rear retaining channel 4616 such that the cross-bar 4146 cannot move within the rear retaining channel 4616 without the user's removal of the rear coupler 4660. Here, the length of the first extent 4664 is dimensioned such that it extends across the third segment 4619 of the rear retaining channel 4616 and into the second segment 4618 of the rear retaining channel 4616. It should be understood that the length of the first extent 4664 may be extended with the understanding that this will require the user to move the rear coupler 4660 a greater distance in order to setup or take down the apparatus 4050. Additionally, the length of the first extent 4664 may be reduced to just past the forward most part of the cross-bar 4146; however, reduction of the length much pass this point may limit the effectiveness of the rear coupler 4660.

The biasing assembly 4670 includes a spring 4674 and a rear biasing retainer 4676. The rear biasing retainer 4676 is designed to ensure that the spring 4674 remains connected to the U-shaped structure 4658. The spring 4674 applies a biasing force on the U-shaped structure 4658 to ensure that it remains in the fully engaged position (i.e., the position shown in the Figures) and does not accidently work its way to a unengaged position (i.e., where a majority of the first extent 4634 is positioned rearward of the rear wall 4630), which may allow for the cross-bar 4146 to be removed from the rear retaining channel 4616 without user intervention.

While the above paragraphs describe some aspects of the rear retaining mechanism 4600, it should be understood that other aspects are disclosed within the Figures. Additionally, the rear retaining mechanism 4600 may be an alternate mechanism that secures and maintains the apparatus 4050, when desired, in the second ($P_U$), third ($P_B$), fourth ($P_F$), and fifth ($P_E$), positions. Alternative rear retaining mechanisms 4600 may utilize the rear retaining channel 4616 and may replace the rear coupler 4660 with a different structure or may completely omit this structure. Potential replacement structures for the rear coupler 4660 include: (i) a spring loaded pin with a grasping element, such as a sphere, attached to one side, (ii) a pin that includes a retractable projection (e.g., quick release pin), (iii) a pin that is rotated into a locked position (e.g., ¼ turn), (iv) a structure that is rotated from a first position to a second position that is over the cross-bar 4146, wherein this rotation may be directed towards the front of the apparatus 4050 or may be directed to either side of the apparatus 4050, or any combination of the above described retaining mechanisms. Further alternative rear retaining mechanisms 4600 may replace both the rear retaining channel 4616 and the rear coupler 4660 with a different structure. For example, rear retaining mechanisms 4600 may be: (i) based on a quick release that is coupled to the cross-bar 4146 that is received by the central member 4125, (ii) two independent structures that receives the pair of rear support members 4157 and the cross-bar 4146 is omitted, or any combination of the structures that are disclosed herein.

C. Over-Rotation Mechanism

Figure 32:
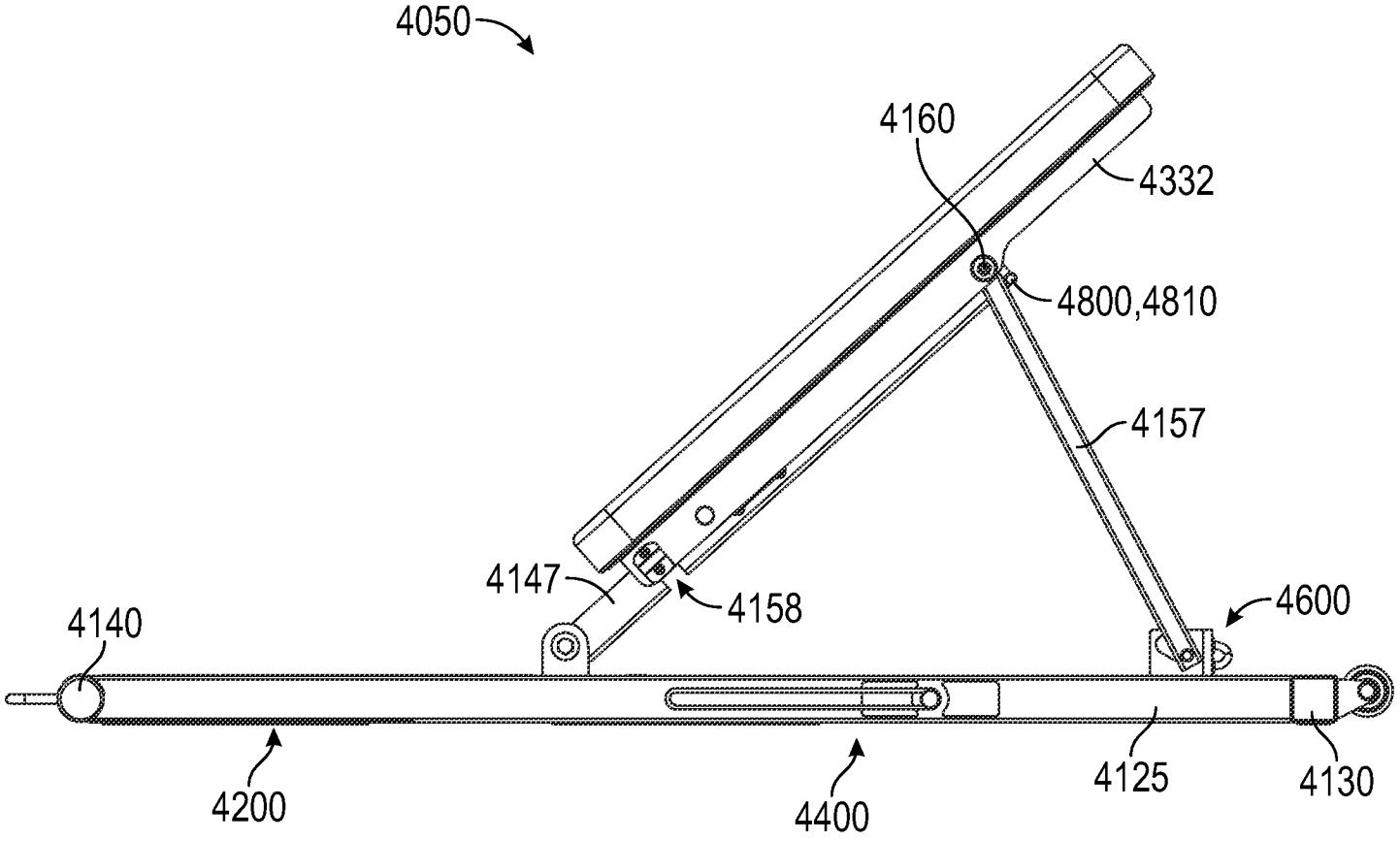
FIG. 32 is a left side view of the exercise apparatus of FIG. 29.
Figure 33:
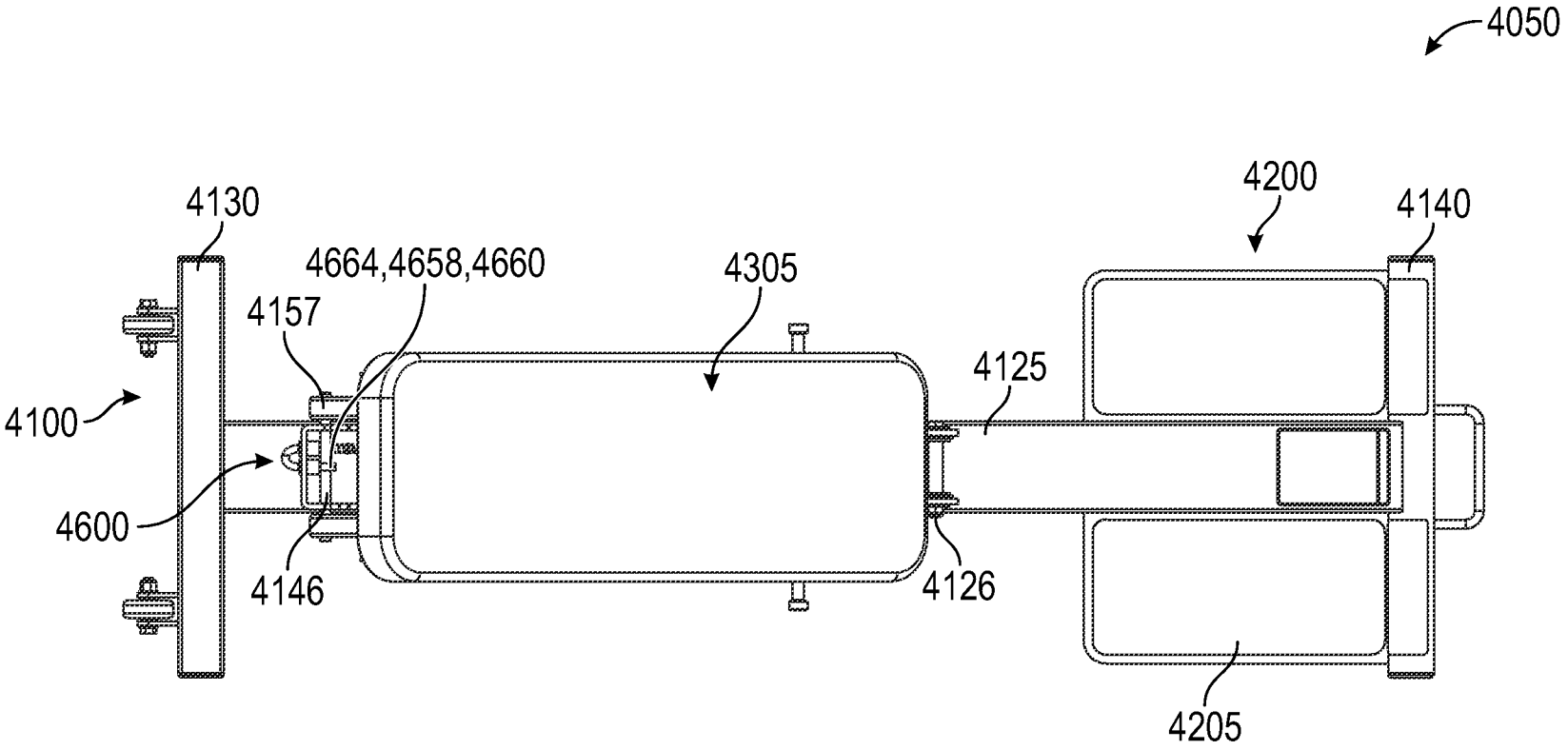
FIG. 33 is a top view of the exercise apparatus of FIG. 29.
Figure 34:
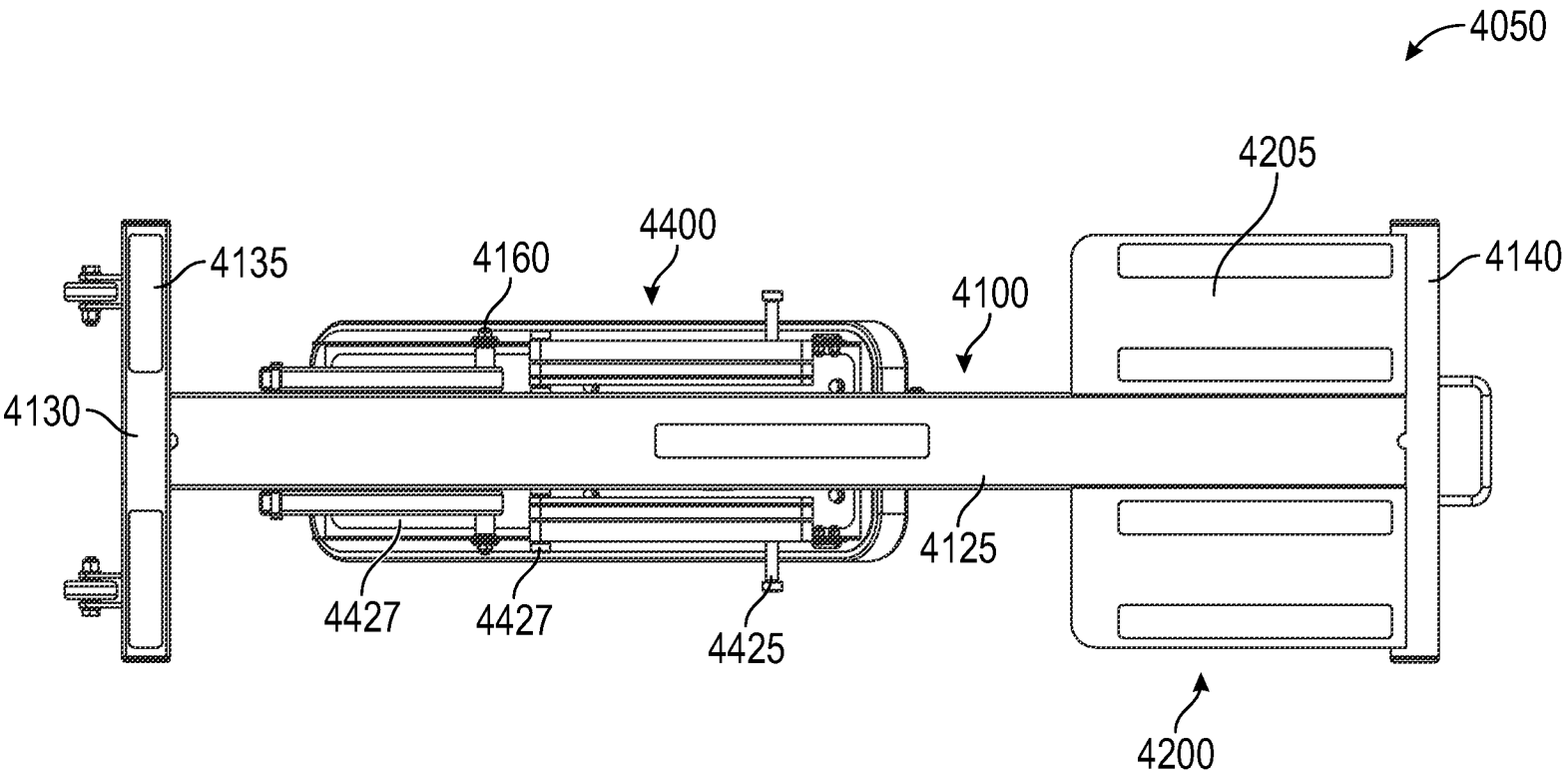
FIG. 34 is a bottom view of the exercise apparatus of FIG. 29.
Figure 36:
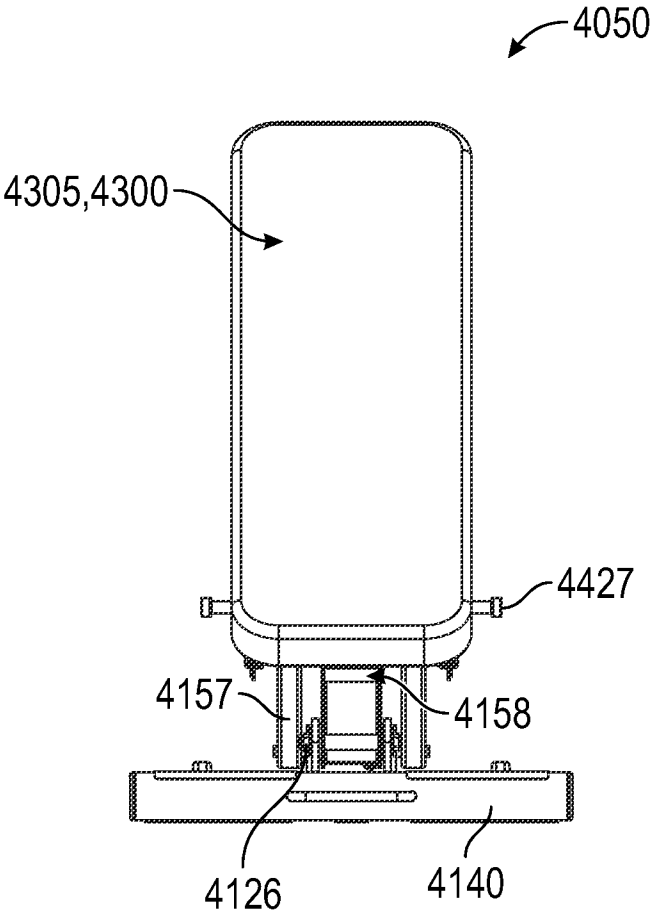
FIG. 36 is a front view of the exercise apparatus of FIG. 29.
Figure 35:
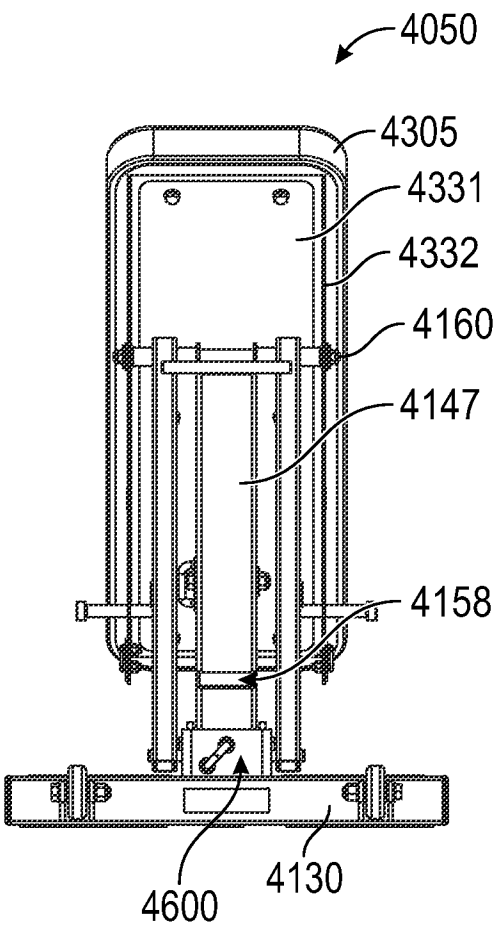
FIG. 35 is a rear view of the exercise apparatus of FIG. 29.
Figure 38:
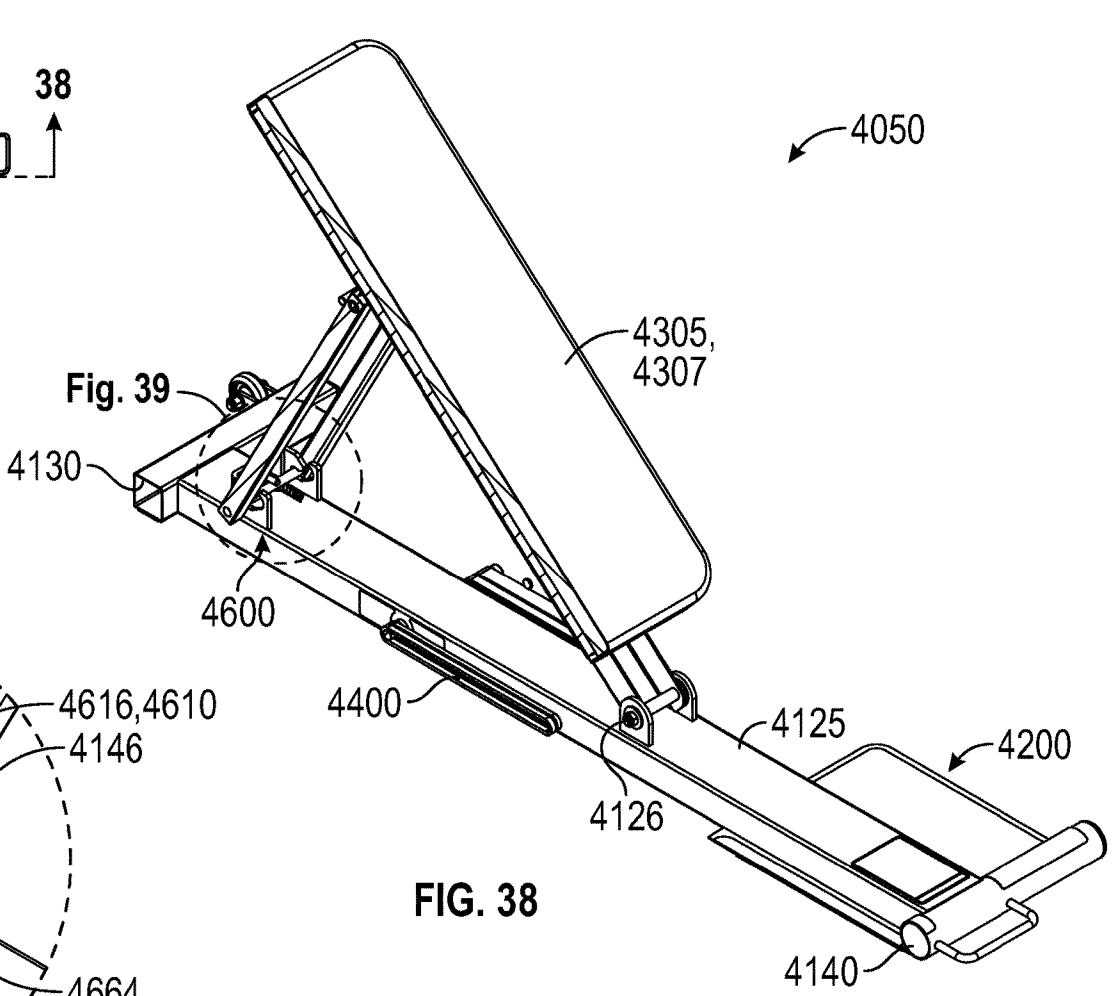
FIG. 38 is a perspective sectional view of the exercise apparatus of FIG. 29 taken along line 38-38 of FIG. 37.
Figure 37:
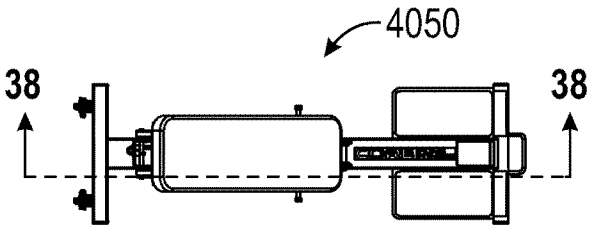
FIG. 37 is a top view of the exercise apparatus of FIG. 29 in the ready to use position.
Figure 39:
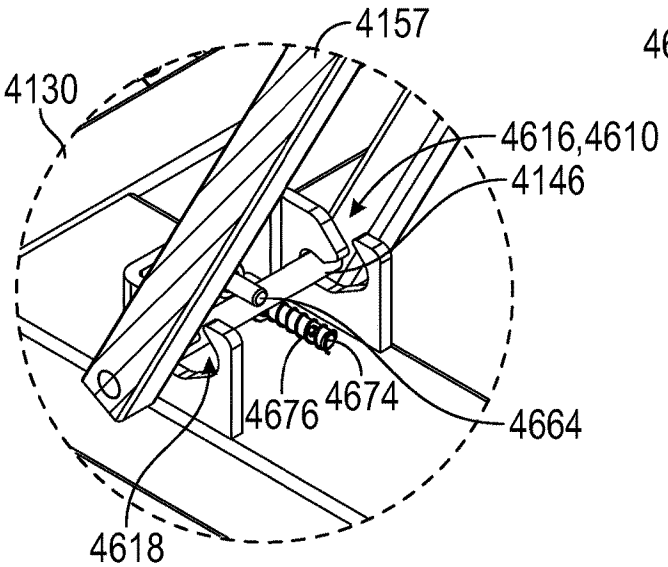
FIG. 39 is a zoomed-in sectional view of FIG. 38 focusing on the rear retaining mechanism in a secured state.
Figure 40:
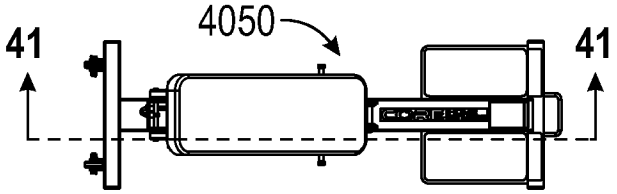
FIG. 40 is a top view of the exercise apparatus of FIG. 29 in the ready to use position.

As best shown in FIGS. 30, 41, 44, 65, and 79, an over-rotation mechanism 4800 is coupled to the frame assembly 4120 and more specifically the front support member 4147. As shown in FIG. 32, this over-rotation member 4810 is a rod or cylinder that has a width, $W_O$, that is: (i) larger than a width, $W_F$, of the front support member 4147 and (ii) smaller than a width, $W_R$, that extends between the outermost surfaces of the pair of rear support members 4157. This width along with the placement of the over-rotation mechanism 4800 prevents a user, U, from being able to move (e.g, swing) the cross-bar 4146 past the end of the apparatus 4050 and more preferably not past the rear retaining mechanism 4600. Along with other things, the over-rotation mechanism 4800 helps ensure that the user, U, properly sets up the apparatus 4050 for its use and storage.

D. Deck Assembly

The deck assembly 4200 comprises a lower plate member 4207, preferably horizontally arranged relative to the floor F, which extends substantially parallel with the lower surface of the central member 4125. The deck assembly 4200 is intended to be a low-profile structure to facilitate the user's U ingress and egress from the apparatus 4050. As such, the deck plate member 4205 is positioned on or near to the support surface or floor F upon which the apparatus 4050 is placed. The deck assembly 4200 may have a non-skid surface placed over the lower plate member 4207 to help ensure that a user's feet do not slide during use of the apparatus 4050. In an alternative embodiment, an adjustable foot rest assembly provides a foot rest surface that may be connected to the deck assembly 4200 and configured to engage the feet of the user that is using the apparatus 4050.

As shown herein, the plate member 4207 is positioned below a pivot point PP and below the bottom edge of the bench assembly 4300.

E. Bench Assembly

The bench assembly 4300 of the exercise apparatus 4050: (i) comprises a bench 4305, (ii) a bench support frame assembly 4310, and (iii) a belt assembly 4315. The bench 4305 has a substantially rectangular configuration with internal pad member residing within an external housing 4307. The bench support frame assembly 4310 includes: (i) a plate 4331 that is coupled to the bench 4305 via elongated fasteners and (ii) a pair of opposed rails 4332 that are coupled to the plate 4331. The belt assembly 4315 includes a first member 4320, a second member 4325 and a buckle 4330 to operably connect the first and second members 4330, 4325. The belt assembly 4315 is operably connected by a belt coupler 4337 to the pair of opposed rails 4332 of the bench support frame assembly 4310 near a lower end 4305*a* of the bench 4305. As explained below, the user secures the belt assembly 4315 across his/her lower abdomen before commencing the gluteal bridge exercise. Unlike some conventional devices, the apparatus 4050 does not require additional structures above the bench assembly 4300 and the belt assembly 4315 to secure the user U to the bench 4305, such as mechanical linkages. The bench 4305 is affixed to the bench support frame assembly 4310 via elongated fasteners.

The bench assembly 4300 is pivotally connected to the frame assembly 4120 to allow for pivotal movement of the bench 4305 and the bench support frame assembly 4310 during the user's performance of the gluteal bridge exercise. The bench assembly 4300 includes at least one bushing assembly 4360 that receives an extent of the pivot point fastener 4160 that extends through the pair of opposed rails 4332, the pair of rear support members 4157, and the front support member 4147. The pivot point fastener 4160 defines a pivot point PP where the bench assembly 4300 is pivotally connected to the frame assembly 4120 to allow for pivotal movement of the bench 4305 during performance of the gluteal bridge exercise. The pivot point PP is in an elevated vertical position relative to: (i) the support surface upon which the apparatus 4050 rests, (ii) the lower plate member 4207, and (iii) a resistance point RP (as detailed below). This does not mean that the pivot point PP is directly above these other components; instead, the pivot point PP is located at a higher vertical elevation compared to these components. Accordingly, the vertical elevation of pivot point PP is greater than the resistance point RP and the deck plate member 4205. When the apparatus 4050 is in the second position $P_U$ or third position $P_B$, the engagement between the front support member 4147 and the pair of opposed rails 4332, and between the pair of opposed rails 4332 and the pair of rear support members 4157, as provided by the bushing assembly 4360, ensures that both the bench 4305 and the pair of opposed rails 4332 are substantially parallel to the front support member 4147. This positional arrangement improves the stability of the bench 4305 both when the user lays on the bench 4305 prior to securing the belt assembly 4315 and beginning the first repetition of the gluteal bridge movement, and when the user is laying on the bench 4305 while performing gluteal bridge movements.

F. Resistance Assembly

The resistance assembly 4400 includes a resistance band 4405 and a means for releasably securing 4410 the resistance band 4405 to both the frame assembly 4120 and bench assembly 4300. The resistance assembly 4400 provides a resistance force, in addition to the effects of gravity, that the user U must overcome in order to pivotally move the bench 4305 from a second position to a fifth position about the pivot point, PP. In particular, the means for securing 4410 includes an upper securement means 4415 and a lower securement means 4420. These securement means 4415, 4420 can include a projection or combination of projections, a hook, a channel, a recess, a spring-loaded pin or a quick-release pin, or an aperture. The upper securement means 4415 is an upper projection 4427 that extends from the bench assembly 4300, wherein the upper projection 4427 has a raised outer lip 4431 that helps ensure that the resistance assembly 4400 does not disengage projection 4427 during use of the exercise apparatus 4050. This upper projection 4427 is preferably positioned near the belt coupler 4337 and does not extend outwardly past the end walls 4157*a* of the pair of rear support members 4157. The center of the upper projection 4427 forms a resistance point RP, which is angularly displaced about the pivot point PP when the exercise apparatus 4050 moves from the ready for use position $P_U$ through the hip extended position $P_E$ and back to the bottom position $P_B$. The resistance point RP is in an elevated vertical position relative to: (i) the support surface upon which the apparatus 4050 rests and (ii) the deck plate member 4205. The resistance point RP is in a lower vertical position relative to the pivot point PP. This does not mean that the resistance point RP is aligned directly above or directly below these other components; instead, the resistance point RP is located at different vertical elevations compared to these components. Accordingly, the vertical elevation of resistance point RP is between the pivot point PP and the deck plate member 4205.

The lower securement means 3420 includes a lower projection 4425 that extends outwardly from the central member 4125. The lower projection 4425 does not extend past the end wall 4157*a* of the pair of rear support members 4157. The resistance band 4405 is operatively connected to the lower projection 4425. Additionally, the lower projection 4425 may have a raised outer lip 4430 that helps ensure that the resistance assembly 4400 does not disengage the lower projection 4425 during use of the exercise apparatus 4050. The user U may change the resistance band 4405 of the exercise apparatus 4050 by sliding an additional or alternative resistance band on the upper securement means 4415 and lower securement means 3420.

When the resistance band 4405 is connected to the upper and lower securement means 4415, 3420, the resistance bands 4405 are positioned on an angle relative to the central member 4125 (i.e., not parallel with the central member 4125) and external to or beyond the central member 4125. This angular arrangement of the resistance bands 4405 is due to the width of the central member 4125 in comparison to the width of the pair of opposed rails 4332, as the upper and lower securement means 4415, 4420 extend therefrom. This relative positioning provides a number of benefits, including the rapid exchange of different resistance bands 4405 that provide varying levels of resistance during the performance of the gluteal bridge movement. Overall, this arrangement of the resistance assembly 4400 and its components ensures smooth and consistent elastic deformation of the resistance assembly 4400 during the bridge movement, which facilitates proper operation of the exercise apparatus 4050. It should be understood that the lower securement means 3420 may be connected to various other locations, which include the pair of rear support members 4157. However, these alternate connection locations should be selected in a manner that does not impact or compromise the elastic deformation of the assembly 4400 during the bridge movement, or comprise the proper operation of the exercise apparatus 4050.

It should be understood that in alternative embodiments, the resistance assembly 4400 could be a chain, a weight plate, dumbbell, electric, hydraulic, pneumatic, spring, weight stack, any combination of these embodiments, or any other structure that could be configured to resist the movement of the bench (e.g., bending of rod). For example, the resistance assembly 4400 could include both a weight plate and resistance bands. In other alternative embodiments, the resistance assembly 4400 may be springs that are permanently or releasably coupled to the lower end 4305*a* of the bench 4305. In further alternative embodiments, the resistance assembly 4400 may be omitted for the apparatus 4050.

G. Flat Bench Assembly

As best shown in FIGS. 13, 15, 17-18, 20-21, 43, 46, 61, 65, 69, 74, 77, 83, 87, and 89, the flat bench assembly 4700 includes: (i) a locking member 4710 and (ii) a front retaining mechanism 4750. The locking member 4710 is an elongated member that is pivotally coupled to the frame assembly 4120 and more specifically the front support member 4147. This pivotal connection allows a majority of the locking member 4710 to be located within the front support channel 4147*a* when the apparatus 4050 is in the first ($P_C$), second ($P_U$), third ($P_B$), and fifth ($P_E$) positions and a majority of the locking member 4710 to be removed from the front support channel 4147*a* when the apparatus 4050 is in the fourth ($P_E$) position. This allows the apparatus 4050 to conceal this feature until the user decides to put the bench within this position. To facilitate this pivotal connection, the locking member 4710 is coupled to the front support member 4147 via the front elongated locking member fastener 4723 that is surrounded by a front bushing 4716. The front bushing 4716 may be from any material, including plastic, silicon, or rubber.

The locking member 4710 has an irregular shape that is comprised of three primary sections: (i) a first or lower section 4720, (ii) a second or middle section 4730, and (iii) a third or top section 4740. The first or lower section 4720 is best shown in FIGS. 15, 48, 74, 83 and 87, wherein the lower section 4720 includes: (i) a pivotal coupling opening 4722, (ii) a securement opening 4724, (iii) a securement recess 4726, and (iv) a retaining mechanism recess 4728. As discussed above, the pivotal coupling opening 4722 is designed and configured to receive the front elongated fastener 4723 and the bushing 4716. The securement opening 4724 is designed and configured to receive an extent of a front coupler 4780 of the front retaining mechanism 4700. This configuration can best be seen in connection with FIGS. 69, 74, 83, 87, and 90. The securement recess 4726 is designed and configured to have the same radius as the front coupler 4780 because this recess 4726 is designed to interact with an extent of the front coupler 4780 when the locking member 4710 is in retained within the front support channel 4147*a* in order to secure the locking member 4710 within the front support channel 4147*a*. This configuration can best be seen in connection with FIGS. 15, 48, 50-61. In general, this configuration is beneficial because it ensures that the locking member 4710 is retained within the front support channel 4147*a* when the apparatus 4050 is in the first three positions. Finally, the retaining mechanism recess 4728 is an arched shape recess that is designed and configured to allow the locking member 4710 to avoid contact with an extent of the front coupler 4780. It should be understood that in other embodiments, the configuration of this first or lower section 4720 may be altered or omitted to interact with the structures associated with that embodiment. For example, the securement recess 4726 may be omitted, if the front coupler 4780 is a spring loaded pin instead of the front coupler 4780 in the figures.

The second or middle section 4720 extends between and is integrally formed with the first and third sections 4710, 4730. The middle section 4720 is substantially linear and is configured to place the third section 4730 in the proper location when the bench 4305 is placed in the flat bench position. As best shown in FIGS. 64, 69, 76-78, 97, the third or upper section 4730 is configured to interact with the front receiver 4760 of the front retaining mechanism 4750. Specifically, the upper section 4730 includes a locking rod 4744 that is coupled to the locking member 4710. The locking rod 4744 is designed to fit within a front retaining channel 4764 of the front retaining mechanism 4750. To ensure that the locking rod 4744 does not hinder the performance of the apparatus 4050 in the first three positions, the width of the locking rod 4744 is less than the width of the front support channel 4147*a* of the front support member 4147. It should be understood that a majority of the weight that is placed on the lower end 4305*a* of the bench 4305 will be resting against this locking rod 4744. To ensure that the locking rod 4744 does not fail under stress of this weight, the locking rod 4744 is a solid rod that is inserted through the locking member 4710 and then welded thereto. This design provides additional reliability over designs that simply weld the projections to the locking member 4710. Nevertheless, other methods of coupling (e.g., welding) the projections to the locking member 4710 instead of using a single solid rod are contemplated by this disclosure, even if such methods are not as reliable.

Figure 64:
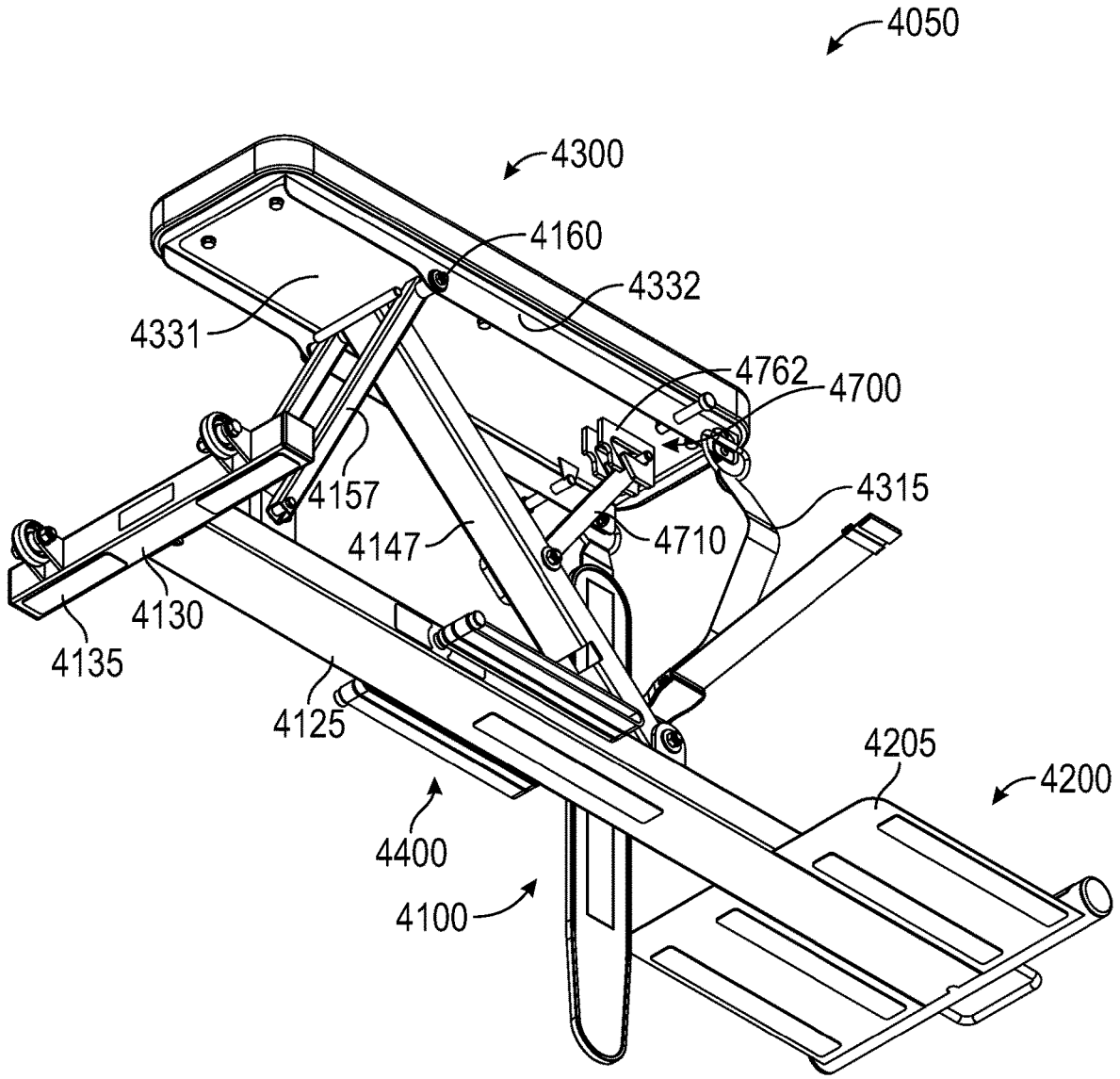
FIG. 64 is a lower perspective view of the exercise apparatus of FIG. 63.
Figure 65:
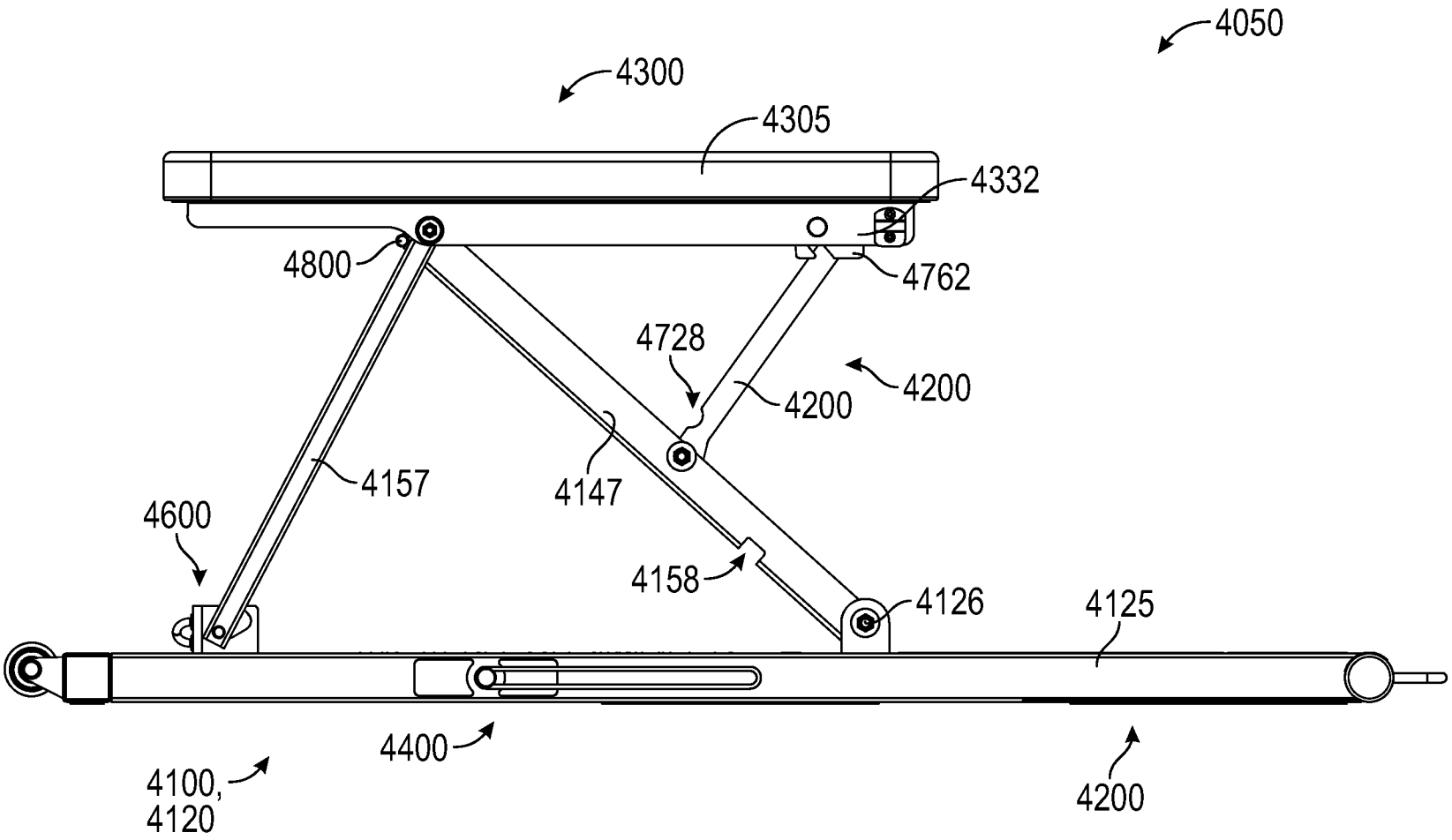
FIG. 65 is a right side view of the exercise apparatus of FIG. 63.
Figure 66:
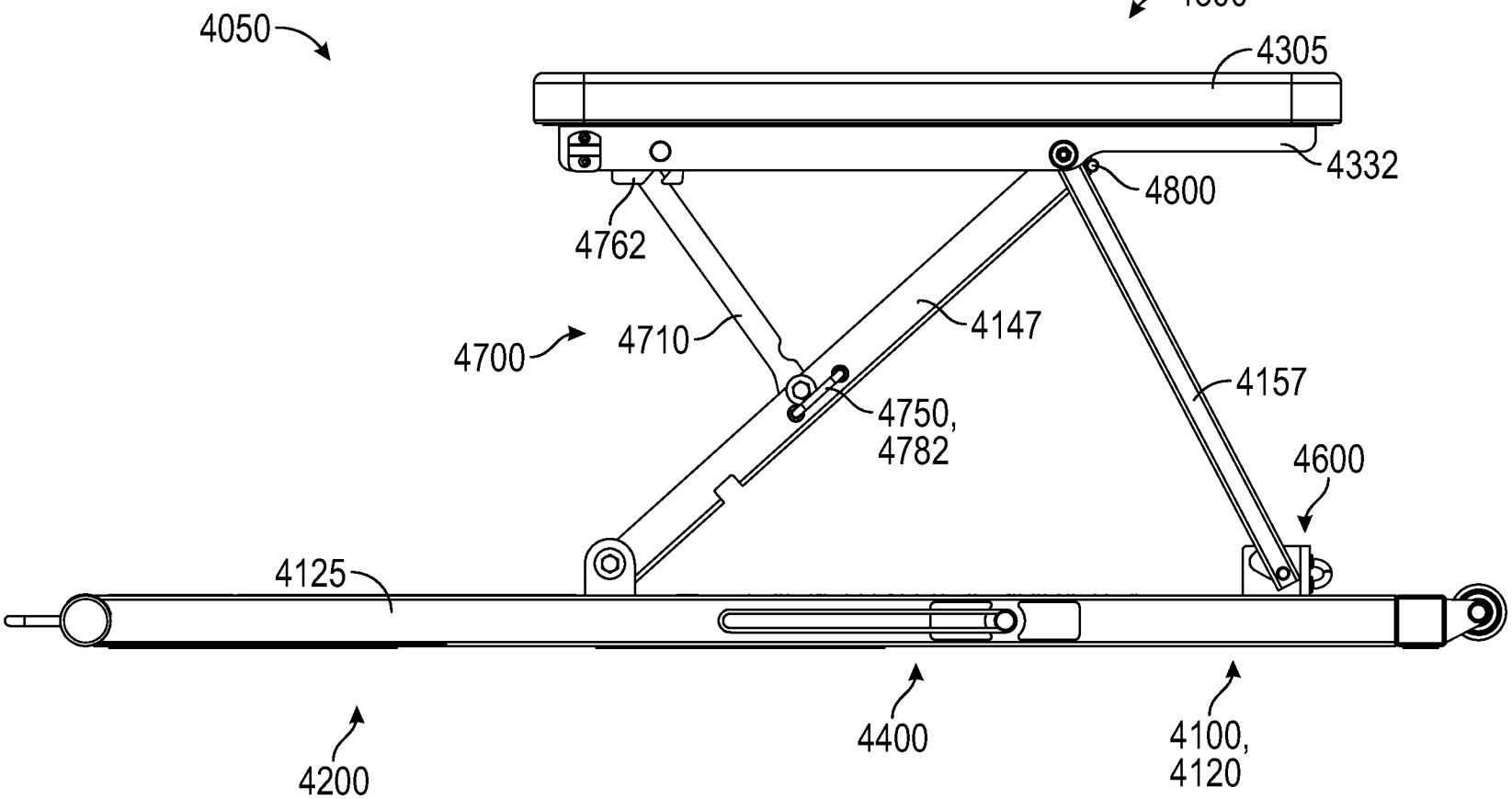
FIG. 66 is a left side view of the exercise apparatus of FIG. 63.
Figure 67:
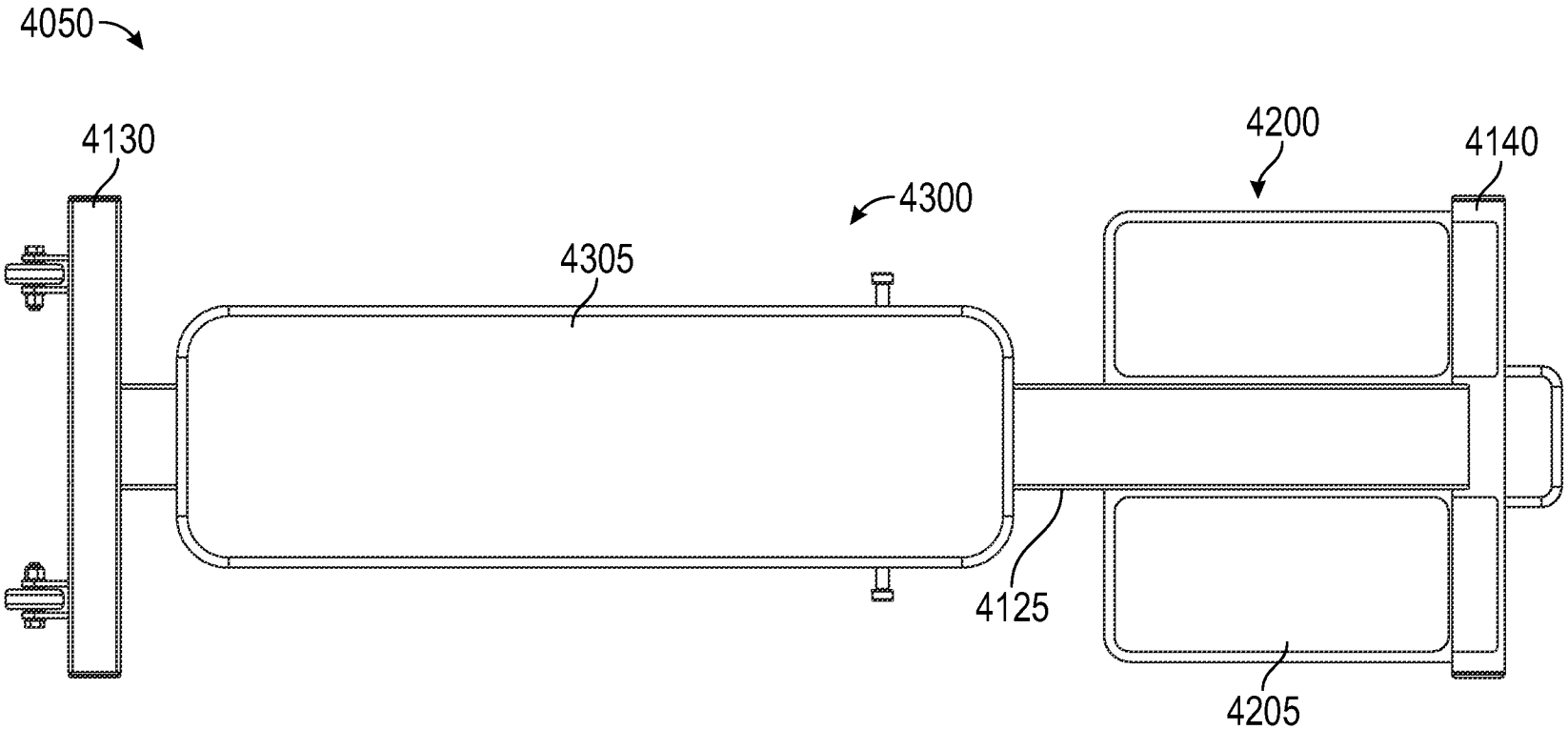
FIG. 67 is a top view of the exercise apparatus of FIG. 63.
Figure 68:
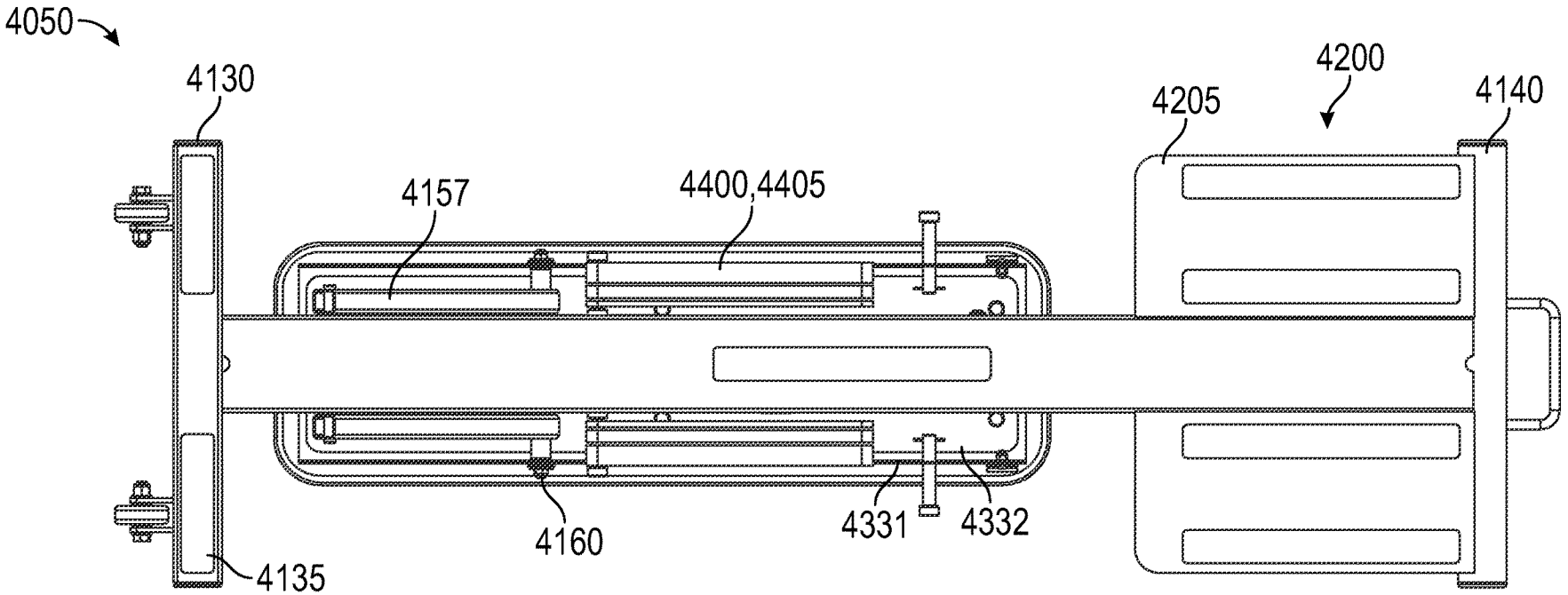
FIG. 68 is a bottom view of the exercise apparatus of FIG. 63.
Figure 69:
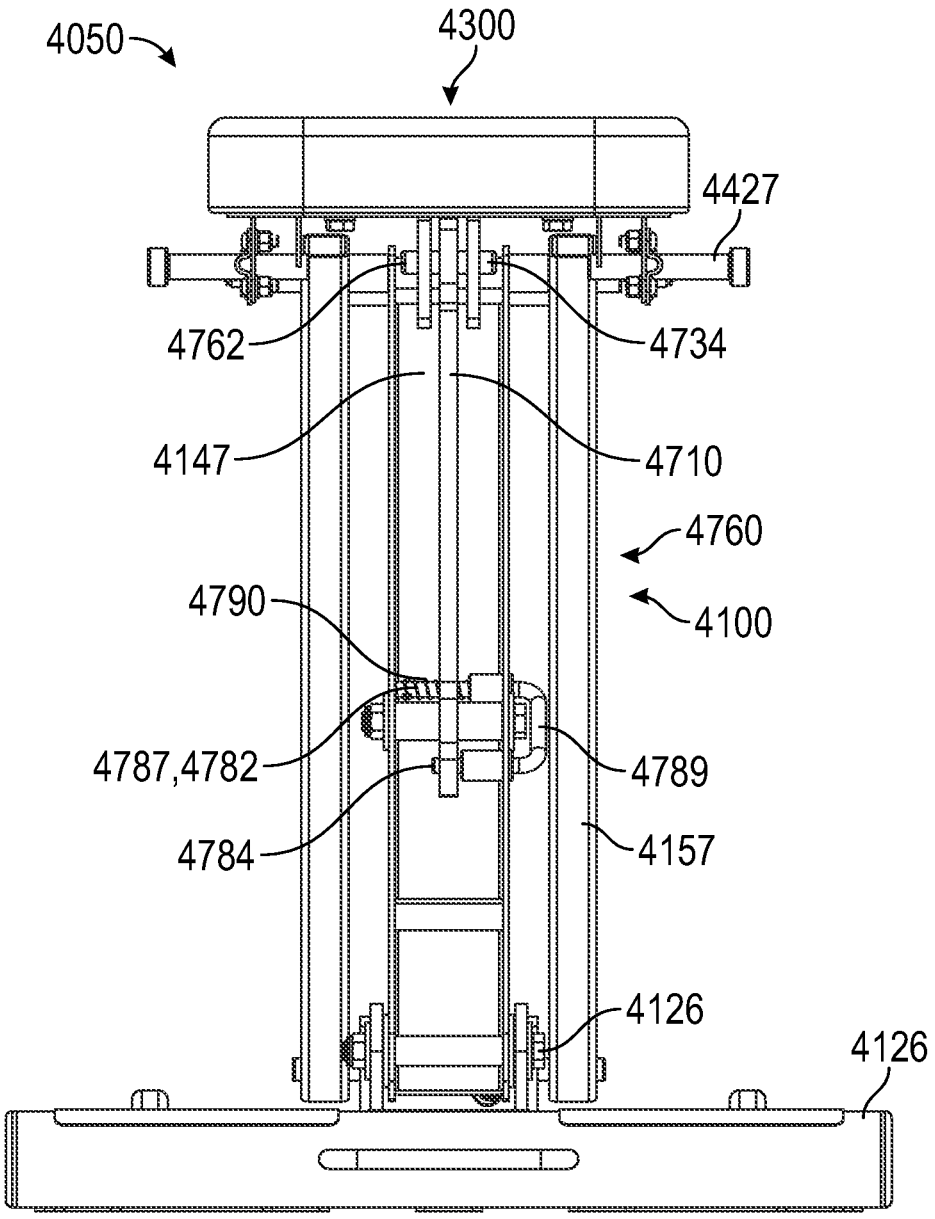
FIG. 69 is a front view of the exercise apparatus of FIG. 63.
Figure 70:
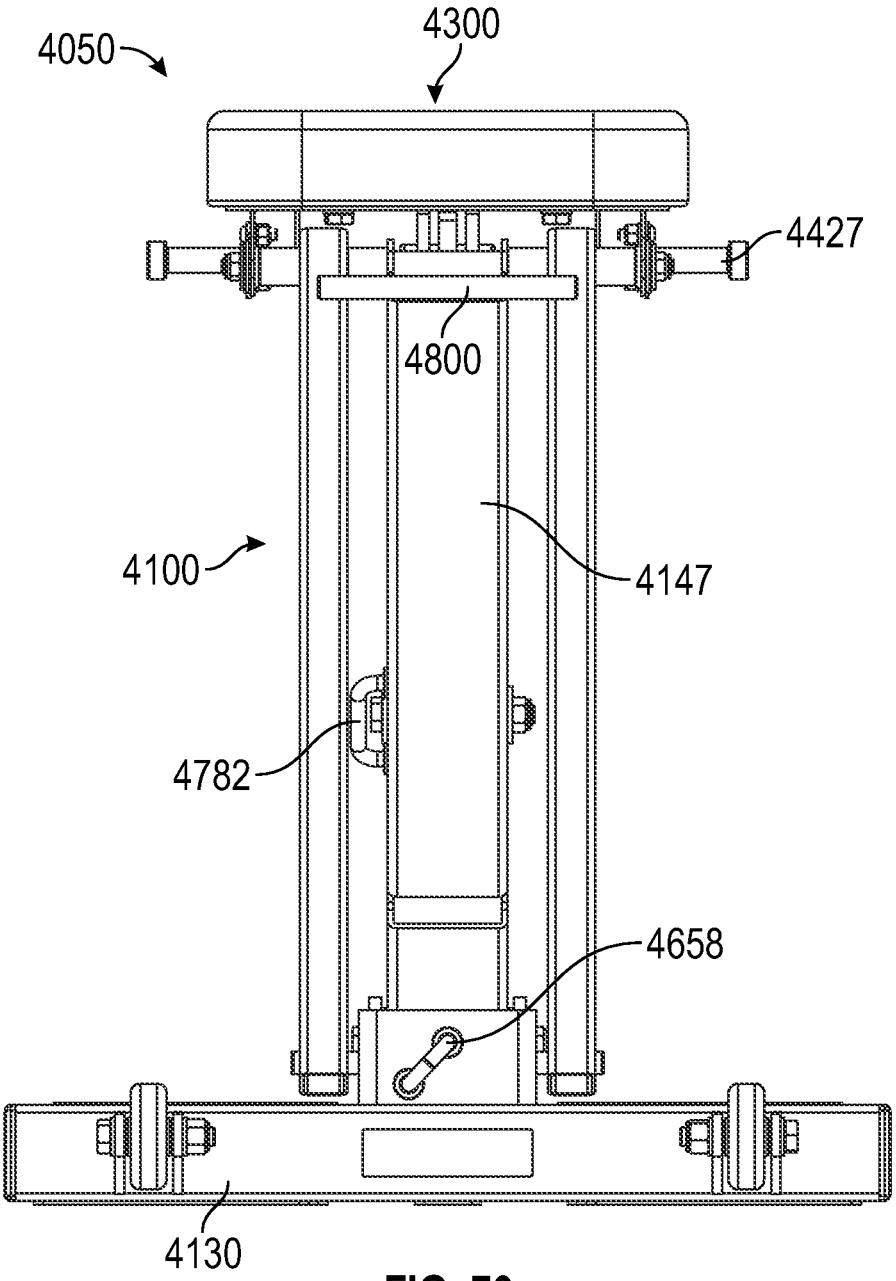
FIG. 70 is a rear view of the exercise apparatus of FIG. 63.
Figure 71:
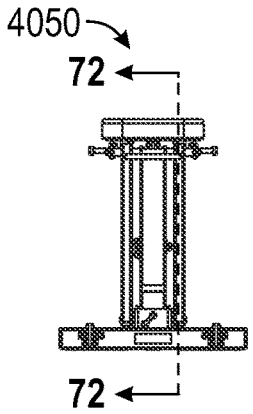
FIG. 71 is a rear view of the exercise apparatus of FIG. 63 in the flat bench position.
Figure 72:
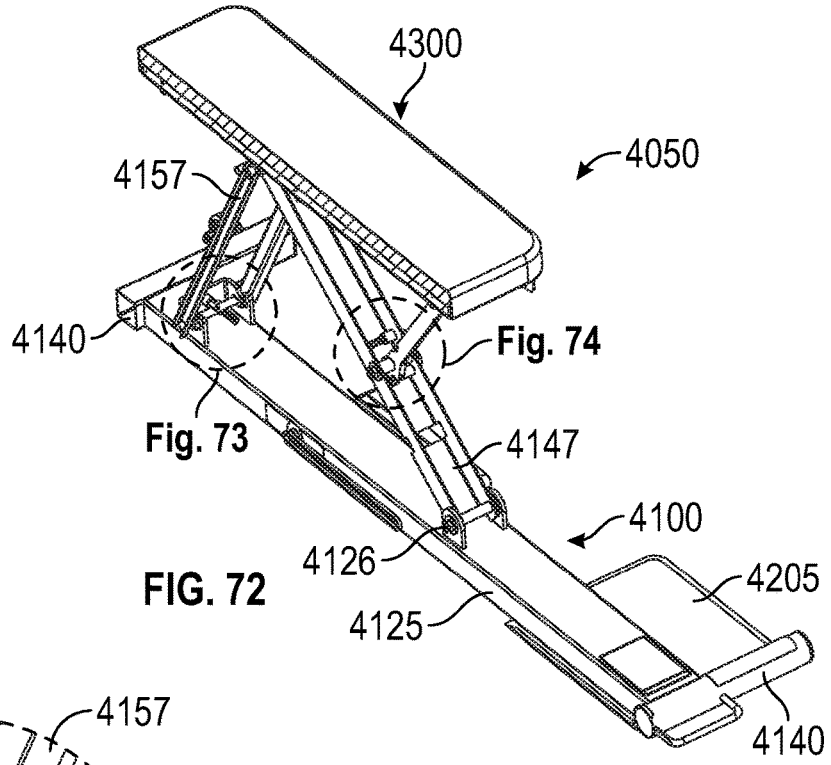
FIG. 72 is a perspective sectional view of the exercise apparatus of FIG. 63 taken along line 72-72 of FIG. 71.
Figure 73:
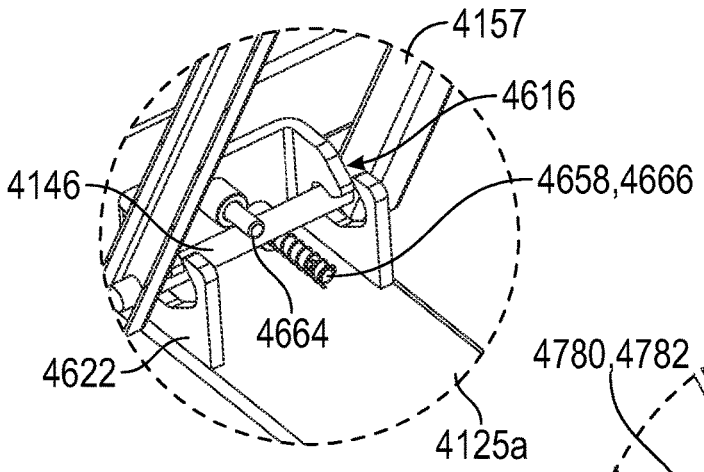
FIG. 73 is a first zoomed-in view of FIG. 72 focusing on the rear retaining mechanism.
Figure 74:
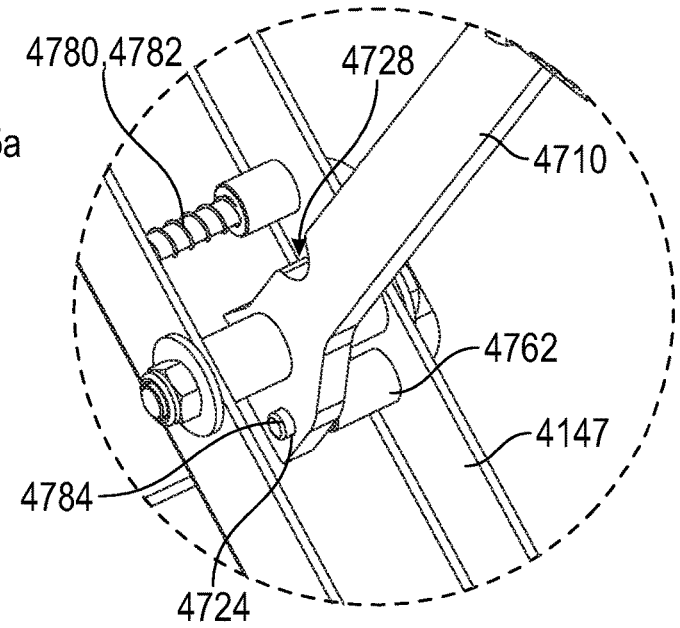
FIG. 74 is a second zoomed-in view of FIG. 72 focusing on the interaction between the locking member and the front retaining mechanism.
Figure 75:
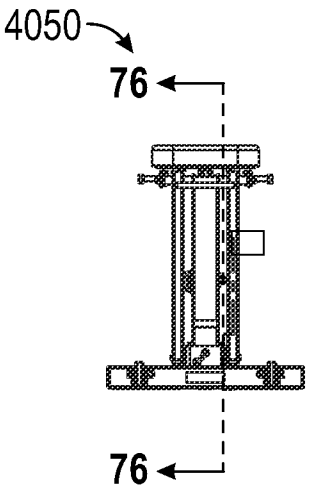
FIG. 75 is a rear view of the exercise apparatus of FIG. 63 in the flat bench position.
Figure 76:
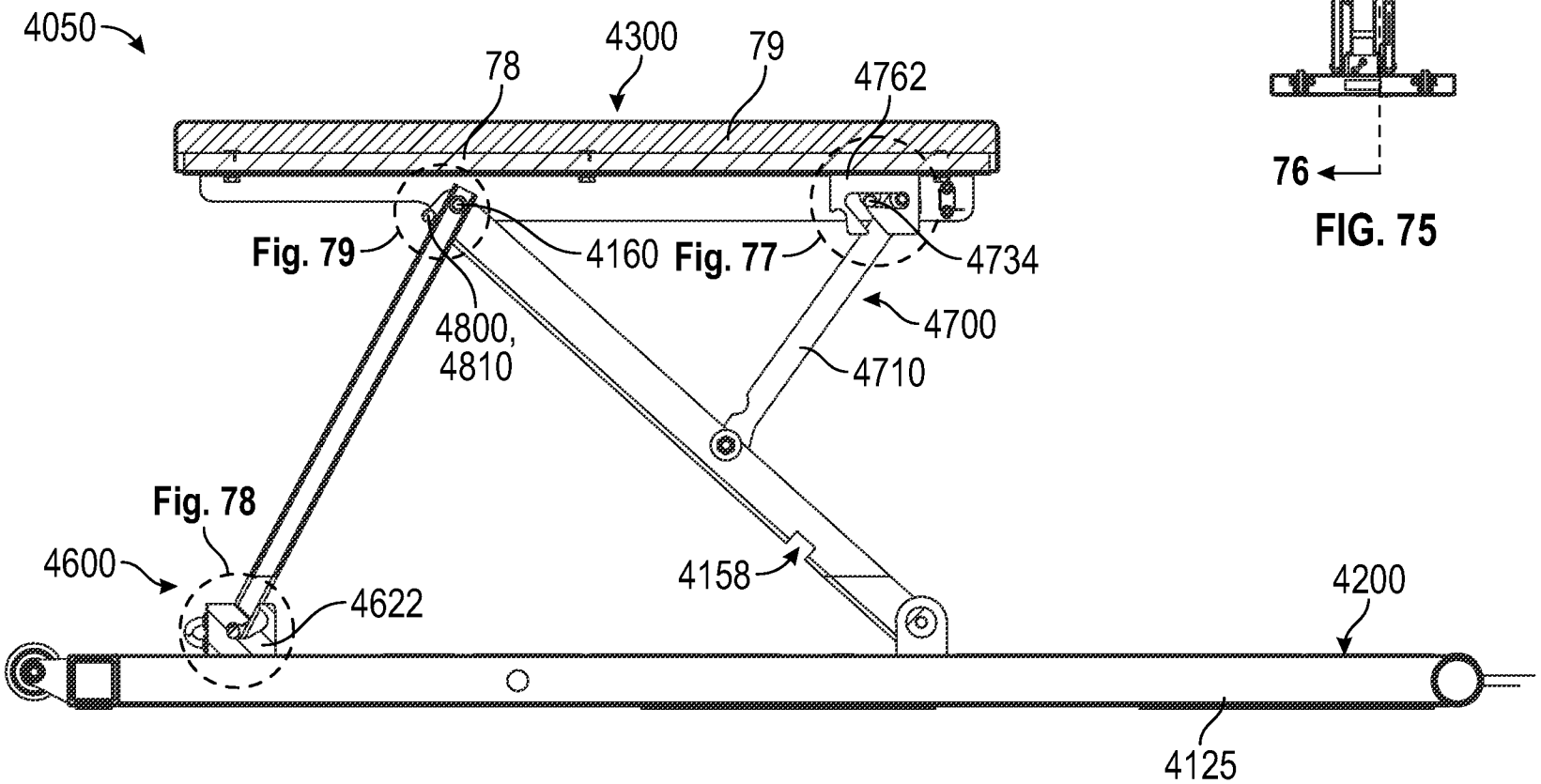
FIG. 76 is a side sectional view of the exercise apparatus of FIG. 63 taken along line 76-76 of 75.
Figure 77:
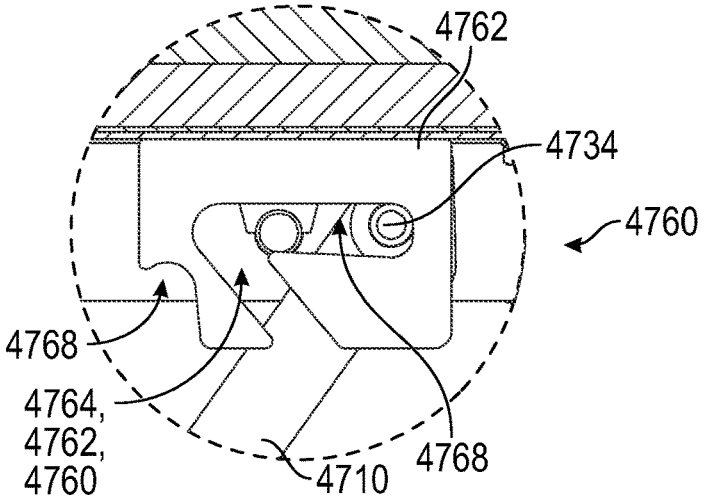
FIG. 77 is a first zoomed-in sectional view of FIG. 76 focusing on the front retaining mechanism in the secured state.
Figure 78:
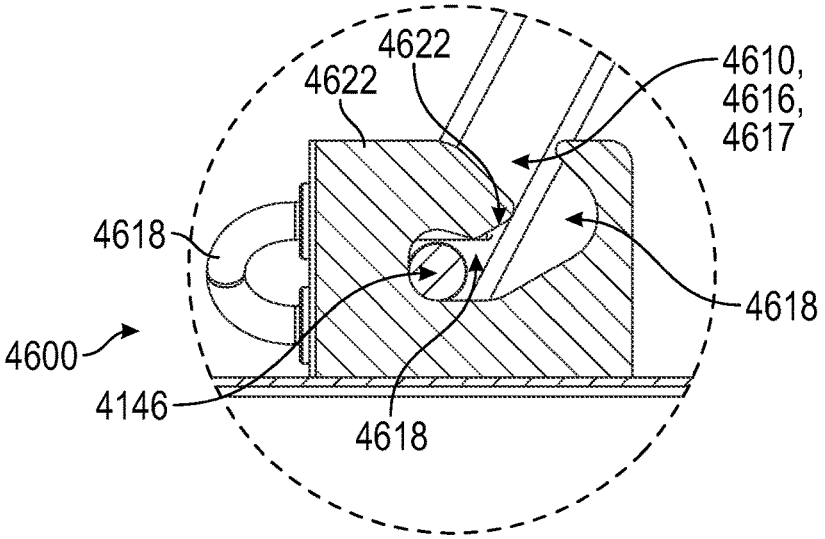
FIG. 78 is a second zoomed-in sectional view of FIG. 76 focusing on the rear retaining mechanism in the secured state.
Figure 79:
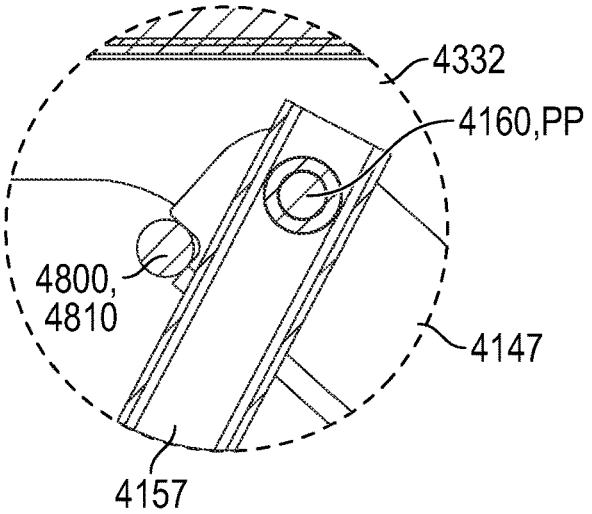
FIG. 79 is a third zoomed-in sectional view of FIG. 76 focusing on the elevated pivot point.
Figure 80:
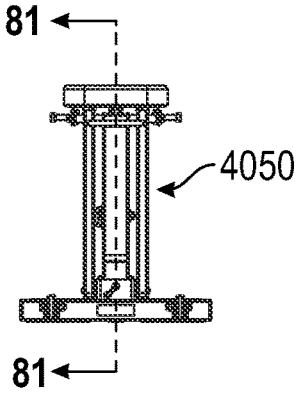
FIG. 80 is a rear view of the exercise apparatus of FIG. 63 in the flat bench position.
Figure 81:
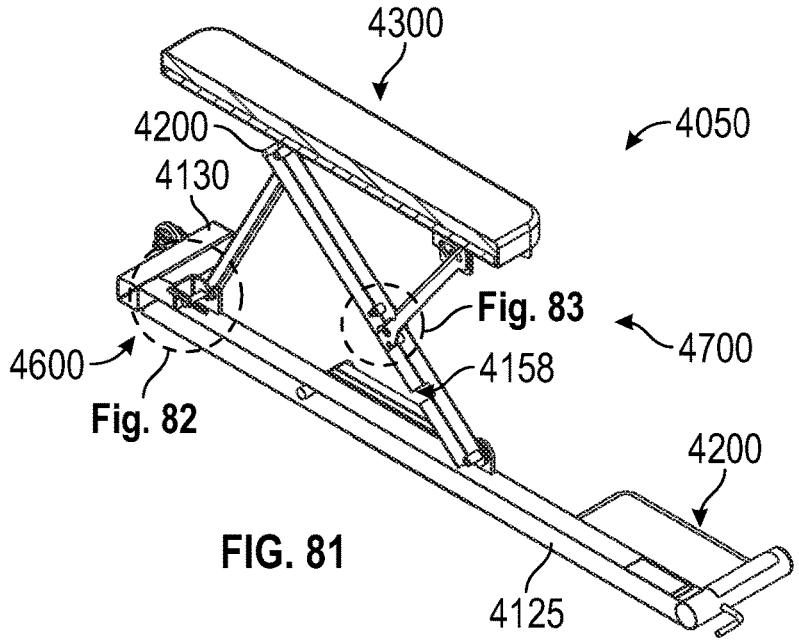
FIG. 81 is a perspective sectional view of the exercise apparatus of FIG. 63 taken along line 81-81 of FIG. 80.
Figure 82:
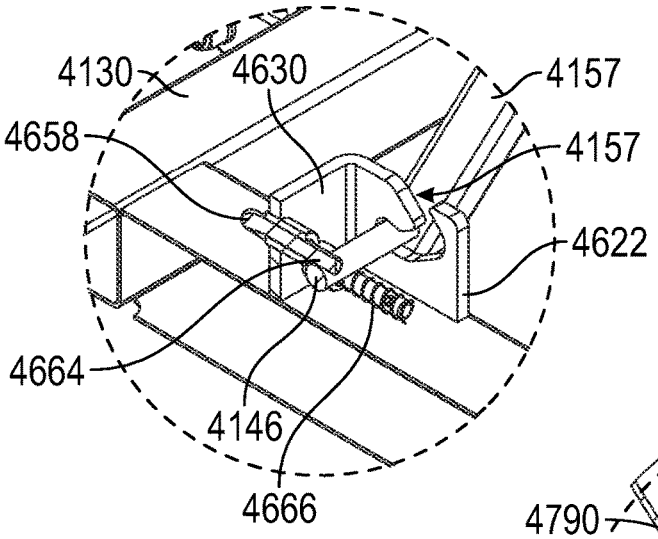
FIG. 82 is a first zoomed-in sectional view of FIG. 81 focusing on the rear retaining mechanism in the secured state.
Figure 83:
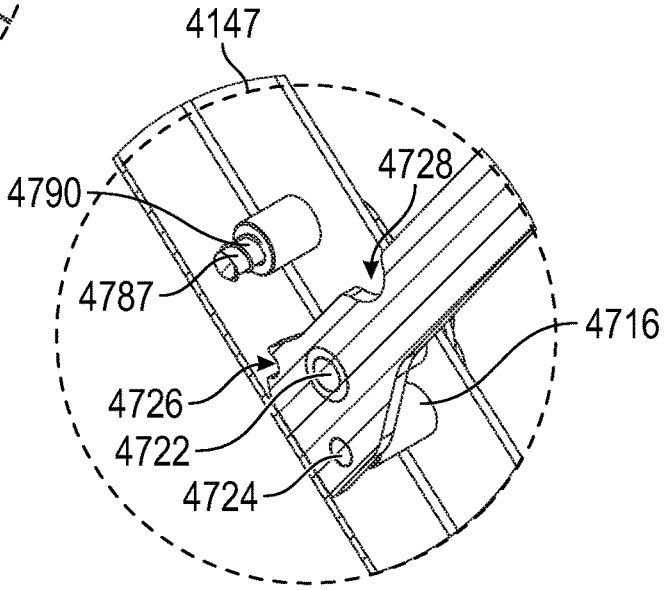
FIG. 83 is a second zoomed-in sectional view of FIG. 81 focusing on the interaction between the locking member and the front retaining mechanism.
Figure 84:
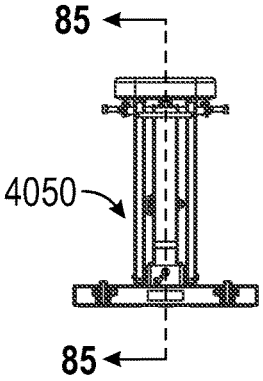
FIG. 84 is a rear view of the exercise apparatus of FIG. 63 in the flat bench position.
Figure 85:
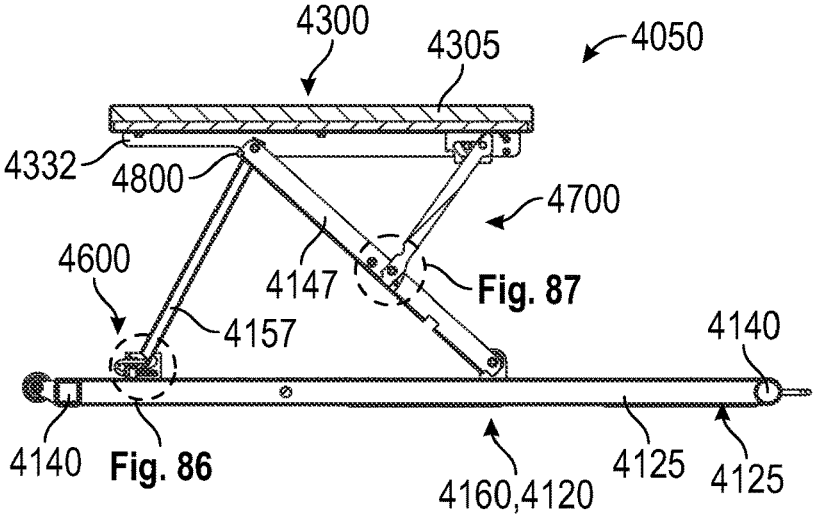
FIG. 85 is a side sectional view of the exercise apparatus of FIG. 63 taken along line 85-85 of FIG. 84.
Figure 86:
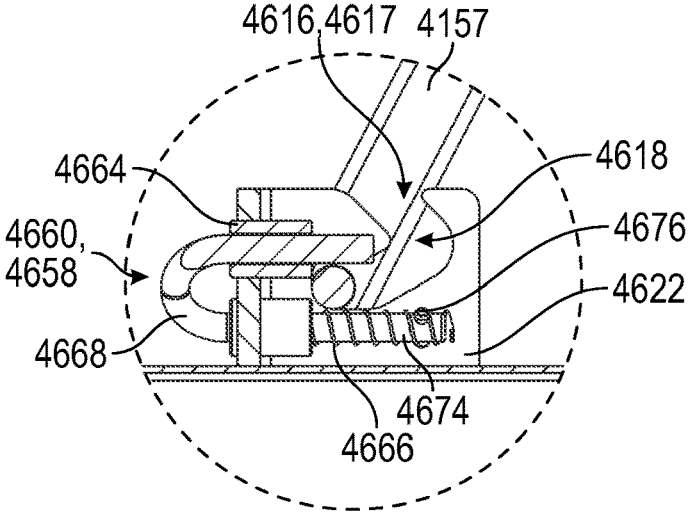
FIG. 86 is a first zoomed-in sectional view of FIG. 85 focusing on the rear retaining mechanism in the secured state.
Figure 87:
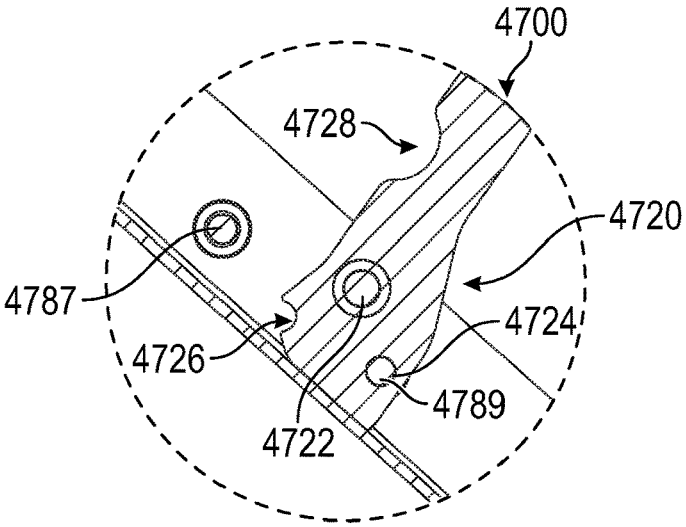
FIG. 87 is a second zoomed-in sectional view of FIG. 85 focusing on the interaction between the locking member and the front retaining mechanism.
Figure 88:
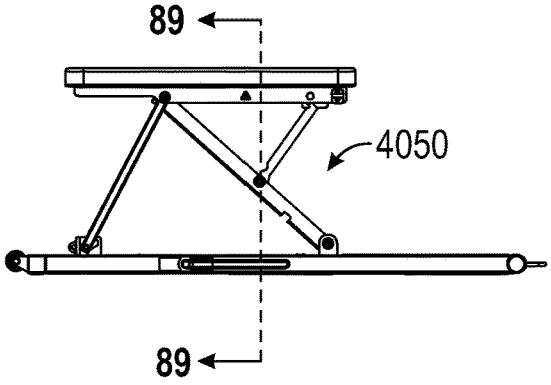
FIG. 88 is a side view of the exercise apparatus of FIG. 63 in the flat bench position.
Figure 89:
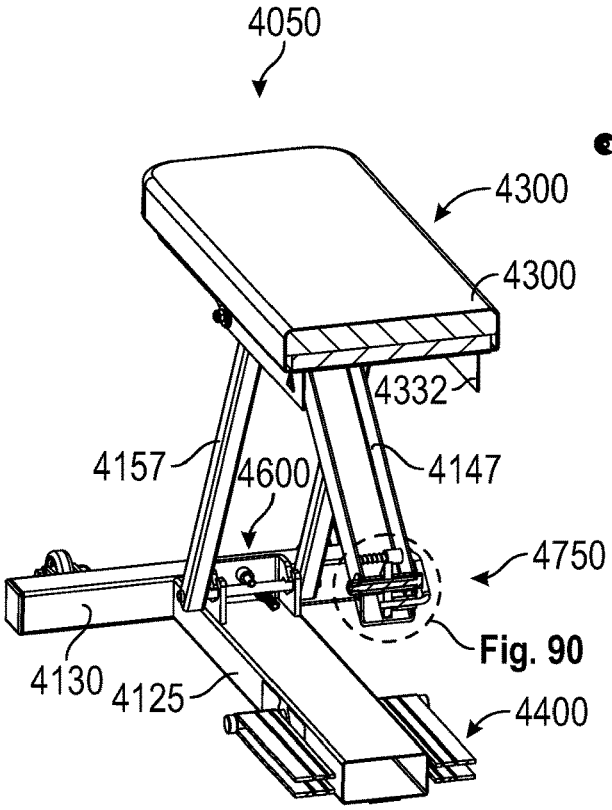
FIG. 89 is a perspective sectional view of the exercise apparatus of FIG. 63 taken along line 89-89 of FIG. 88.
Figure 90:
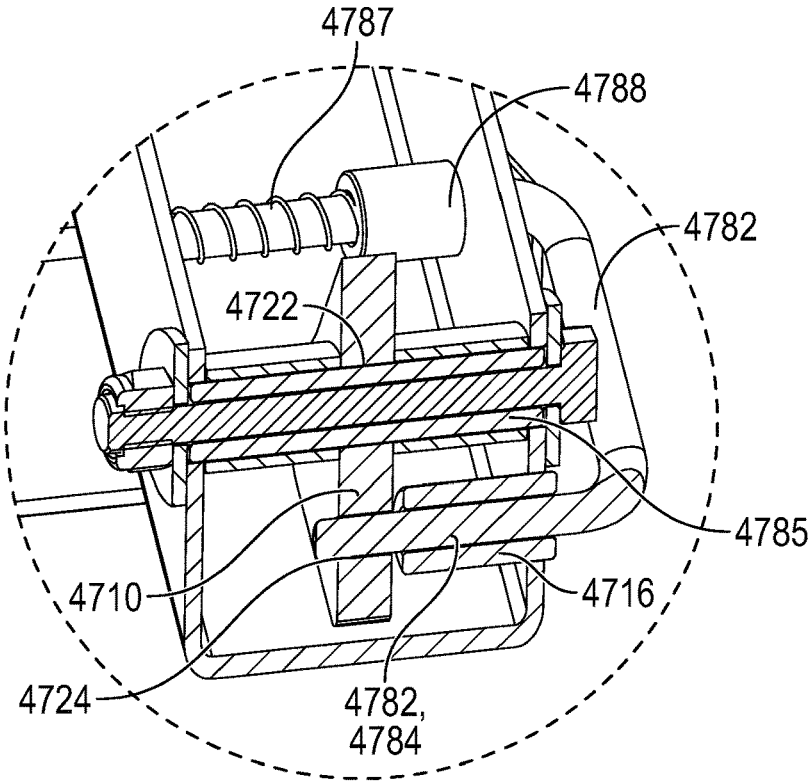
FIG. 90 is a zoomed-in sectional view of FIG. 89 focusing on the front retaining mechanism.
Figure 91:
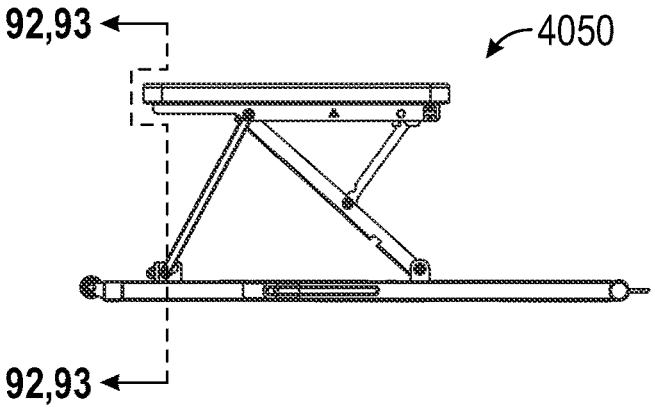
FIG. 91 is a side view of the exercise apparatus of FIG. 63 in the flat bench position.
Figure 92:
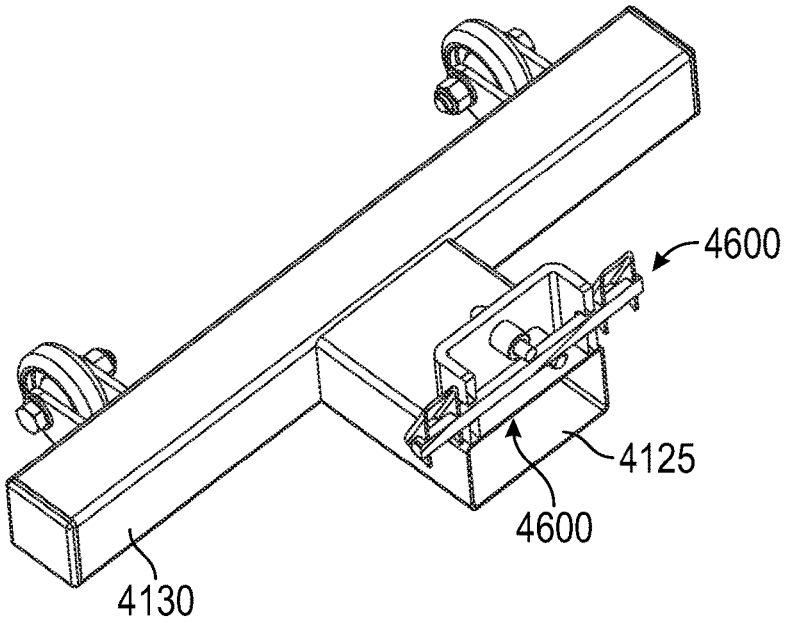
FIG. 92 is a perspective sectional view of the exercise apparatus of FIG. 63 taken along line 92-92 of FIG. 91, showing the rear retaining mechanism.
Figure 93:
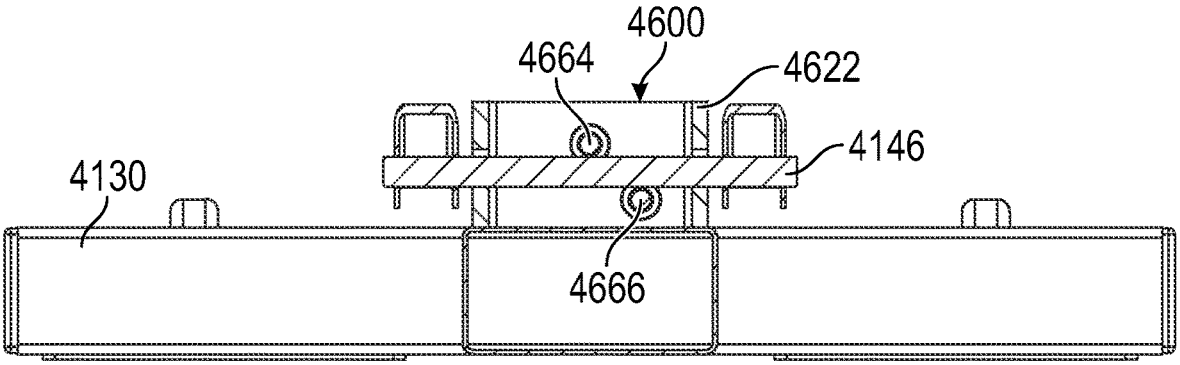
FIG. 93 is an end sectional view of the exercise apparatus of FIG. 63 taken along line 93-93 of FIG. 91, showing the rear retaining mechanism.
Figure 94:
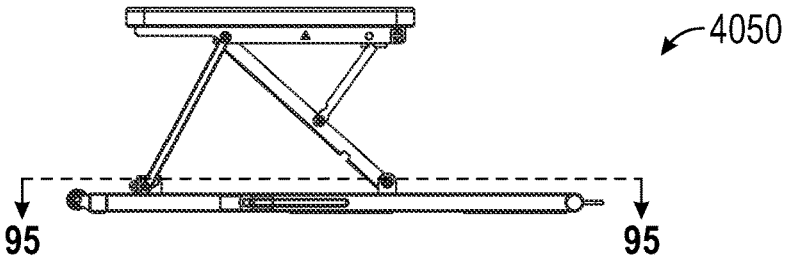
FIG. 94 is a side view of the exercise apparatus of FIG. 63 in the flat bench position.
Figure 95:
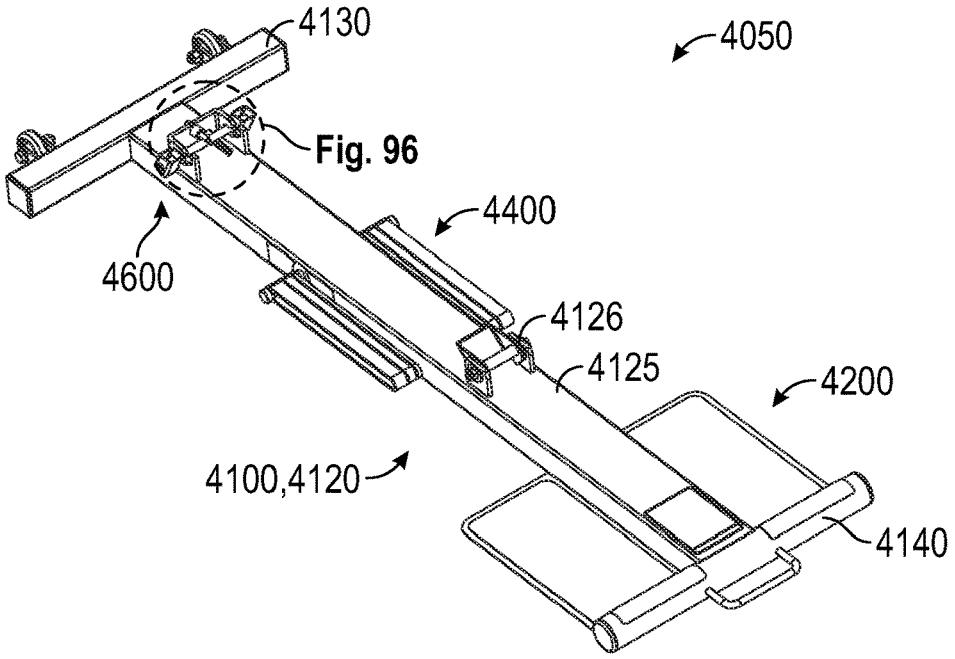
FIG. 95 is a perspective sectional view of the exercise apparatus of FIG. 63 taken along line 95-95 of FIG. 94.
Figure 96:
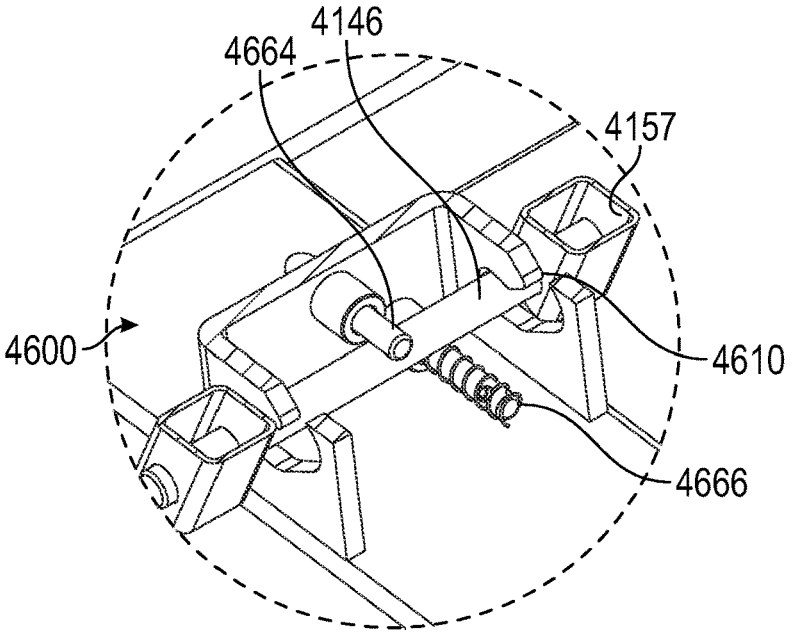
FIG. 96 is a zoomed-in sectional view of FIG. 95 focusing on the rear retaining mechanism in the secured state.

The front retaining mechanism 4750 includes: (i) the front receiver 4760 and (ii) a front coupler 4780. The front receiver 4760 in the embodiment shown in the Figures is a front retaining channel 4764 that is formed within a pair of opposed sidewalls 4762. The pair of opposed sidewalls 4762 are coupled to and extent from the bottom surface 4331*a* of the plate 4331 of the bench support frame assembly 4310. As such the sidewalls 4476 are positioned below the bench 4305. As best shown in FIGS. 64 and 77, the front retaining channel 4764 has multiple segments, which function together to aid to retain the locking rod 4744 when it is positioned within the front retaining channel 4764. These multiple segments include: (i) a first rearward and upward slanting segment 4766 and (ii) a second forward directed segment 4768. This arrangement helps ensure that the locking rod 4744 cannot simply be removed from the front retaining channel 4764 via a vertical force. In fact, to place the locking rod 4744 at the end of the front retaining channel 4764 or to remove the locking rod 4744 from the end of the front retaining channel 4764, the user, U, must apply a complex motion on the locking rod 4744. It should be understood that the front retaining channel 4764 may have other shapes, additional segments, or fewer segments. For example, the front retaining channel 4764 may be substantially curvilinear or bi-linear (e.g., C-shaped, L-shaped, N-shaped, S-shaped, V-shaped, Z-shaped), a combination of these shapes, or a modified version of one or a combination of these shapes (e.g., the horizontal segment of the L-shaped channel may be slanted to form an obtuse angle with the bottom segment of the L-shaped channel).

In addition to the front retaining channel 4764, the opposed sidewalls 4762 include a front coupler cutout 4769 that is configured to ensure that the opposed sidewalls 4762 avoid contact with an extent of the front coupler 4780, when the apparatus 4050 is in the second and fourth positon. It should be understood that this front coupler cutout 4769 and the front coupler 4780 may be modified such that this cutout interacts with a bushing that is secured by the front coupler 4780. This design will allow for the busing to act as a bumper to absorb some of the energy that is transmitted from the lower end 4305*a* of the bend 4305 to the frame assembly 4120. This may be desirable because it will decrease potential damage to the frame assembly 4120 and will reduce noise that is associated with the operation of the apparatus 4050.

The front coupler 4780 of the front retaining mechanism 4700 includes: (i) a U-shaped structure 4782 and (ii) a biasing assembly 4790. The U-shaped structure 4782 is comprised of: (i) a first extent 4784 that is designed to be positioned within a first opening 4785 within the front support member 4147, a second extent 4787 that is designed to be positioned within the second opening 4788 within the front support member 4147, and a third extent 4789 that couples the first and second extents to one another. When the apparatus 4050 is in the first ($P_C$), second ($P_U$), third ($P_B$), fifth ($P_E$) positions, a portion of the first extent 4784 is configured to be positioned directly adjacent to the securement recess 4726 in order to secure the locking member 4710 within the front support channel 4147*a*. Additionally, when the apparatus 4050 is in the fourth ($P_E$) position, a portion of the first extent 4784 is configured to be positioned within the securement opening 4724.

The biasing assembly 4790 includes a spring 4792 and a front biasing retainer 4794. The front biasing retainer 4794 is designed to ensure that the spring 4792 remains connected to the U-shaped structure 4782. The spring 4792 applies a biasing force on the U-shaped structure 4782 to ensure that is remains in the fully engaged position (i.e., the position shown in the Figures) and does not accidently work its way to a unengaged position (i.e., where a majority of the first extent 4784 is positioned outside of the front support channel 4147*a*).

While the above paragraphs describe some aspects of the front retaining mechanism 4750, it should be understood that other aspects are disclosed within the Figures. Additionally, the front retaining mechanism 4750 may be an alternate mechanism that secures and maintains the apparatus 4050 in their desired positions. Alternative front retaining mechanisms 4750 may utilize the front retaining channel 4764 and may replace the front coupler 4780 with a different structure or may completely omit this structure. Potential replacement structures for the front coupler 4780 include: (i) a simple spring loaded pin with a grasping element, such as a sphere, attached to one side, (ii) a pin that includes retractable projection (e.g., quick release pin), (iii) a pin that is rotated into a locked position (e.g., ¼ turn), (iv) a structure that is rotated from a first position to a second positon that is over the locking rod 4744, wherein this rotation may be directed towards the front of the apparatus 4050 or may be directed to either side of the apparatus 4050, or any combination of the above described retaining mechanisms. Further alternative front retaining mechanisms 4750 may replace both the front retaining channel 4764 and the front coupler 4780 with a different structure. For example, front retaining mechanisms 4750 may be: (i) based on a quick release that is coupled to the locking rod 4744, (ii) a structure that receives the locking member 4710 and the locking rod 4744 is omitted, or any combination of the structures that are disclosed herein.

3) Second Embodiment of the Exercise Apparatus

Unlike the first exercise apparatus 4050, the second exercise apparatus 5050 utilizes: (i) an alternative flat bench or stabilization assembly 5700, (ii) an alternative rear retaining mechanism 5600, and (iii) a bumper assembly 5900. As discussed below in connection with FIGS. 147-148, this alternative flat bench assembly 5700 reduces the height of the bench in this configuration from approximately 20 inches to approximately 17 inches. This lower configuration provides substantial benefits for shorter users U having a height of 5'5" or less because it allows them to properly utilize the bench while substantially avoiding mounting/dismounting and/or usability issues. FIGS. 98-99 show the second exercise apparatus 5050 in the collapsed position $P_C$. FIGS. 100-105 show the second exercise apparatus 5050 in the extended position $P_E$ where the bench assembly 5300 is at the uppermost extent of the gluteal bridge movement, although the user has been omitted from these Figures.

Figure 105:
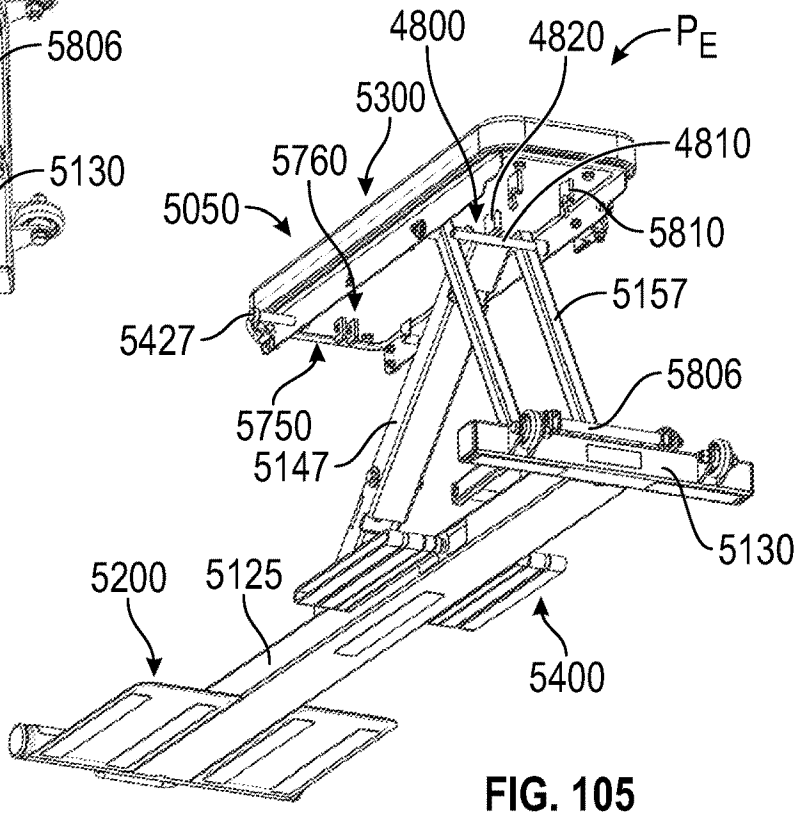
FIG. 105 is a bottom prospective view of the exercise apparatus of FIG. 100.
Figure 104:
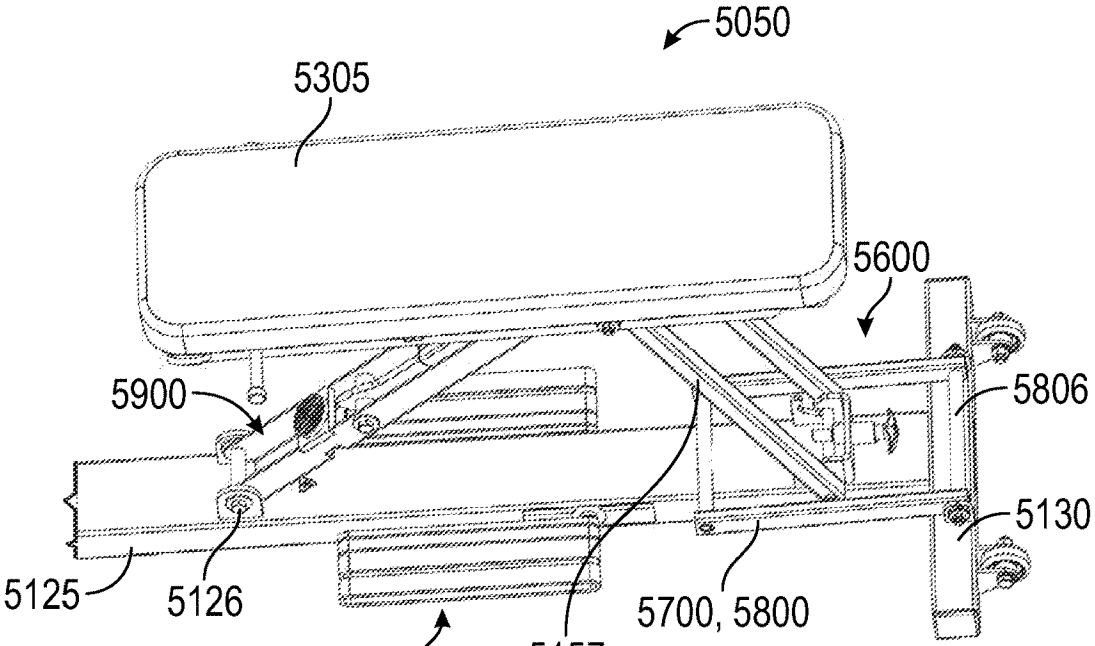
FIG. 104 is a top prospective view of the exercise apparatus of FIG. 100.

Referring to FIG. 105, the over-rotation mechanism 5800 in this second embodiment includes an over-rotation member 4810 and an over-rotation projection 5820. As described above in the first embodiment of the apparatus 4050, the over-rotation member 5810 is coupled to the frame assembly 5120 and more specifically the front support member 5147 and primarily designed to prevent the rear the user, U, from being able to move (e.g, swing) the cross-bar 5146 past the end of the apparatus 5050 and more preferably not past the rear retaining mechanism 5600. In this embodiment, the over-rotation mechanism 5800 has a secondary purpose, which includes help prevent the user, U, from being able over-rotate the bench 5305. The over-rotation of the bench 5305 is prevented because the over-rotation projection 5820 that is coupled to the bottom of the bench assembly 4300 and specifically the plate 4331 will make contact with the over-rotation member 4810. Thus, the user, U, cannot rotate the bench 5305 in a manner that enlarges the interior angle (that extends through the front support member 5147) between the bench 5305 and the rear support members 5157 more than 130 degrees.

A. Flat Bench Assembly

FIGS. 106-145 show the exercise apparatus 5050, including its support assembly 5100, deck assembly 5200 and the bench assembly 5300, in the flat bench position $P_F$. As shown in at least FIGS. 106, 107, 119, 124, 132, and 143, the stabilization assembly 5700 is operably p connected to the bench assembly 5300 and includes: (i) a front locking member 5710, (ii) a front retaining mechanism 5750, (iii) a rear locking mechanism 5800, and (iv) upper retaining mechanism 5810. The front locking member 5710 is an elongated member that is pivotally coupled by an elongated locking member fastener 5723 to the frame assembly 5120 and more specifically the front support member 5147. This pivotal connection allows a majority of the front locking member 5710 to be located within the front support channel 5147*a* when the apparatus 5050 is in the first ($P_C$), second ($P_U$), fourth ($P_B$), fifth ($P_E$) positions. A majority of the front locking member 5710 is manually removed from the front support channel 5147*a* to attain the fifth ($P_E$) position. This allows the apparatus 5050 to conceal the front locking member 5710 until the user U decides to put the bench assembly 5300 in the fifth or flat bench position $P_F$. To facilitate this pivotal connection, the front locking member 5710 is coupled to the front support member 5147 via the elongated locking member fastener 5723 that is surrounded by a front bushing 5716. The front bushing 5716 may be from any material, including plastic, silicon, or rubber.

1) Front Locking Member

Figure 117:
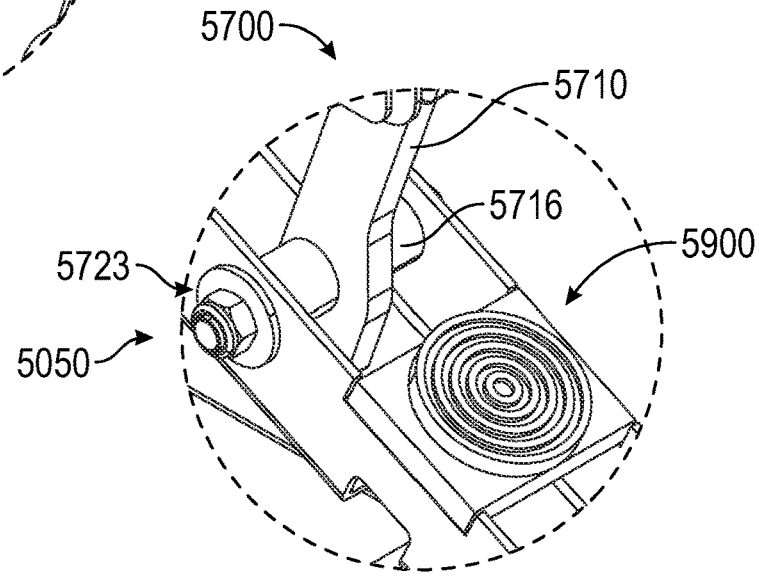
FIG. 117 is a second zoomed-in sectional view of FIG. 115 focusing on the front energy absorbing structure.
Figure 118:
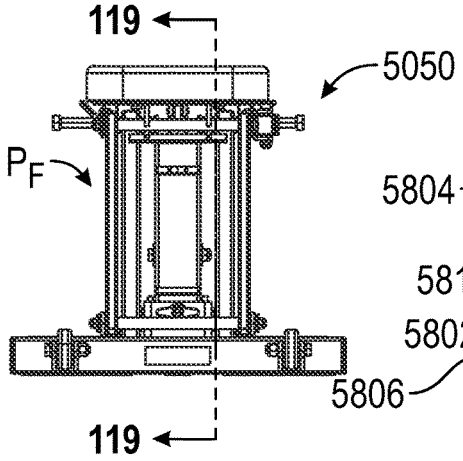
FIG. 118 is a rear view of the exercise apparatus of FIG. 106.
Figure 119:
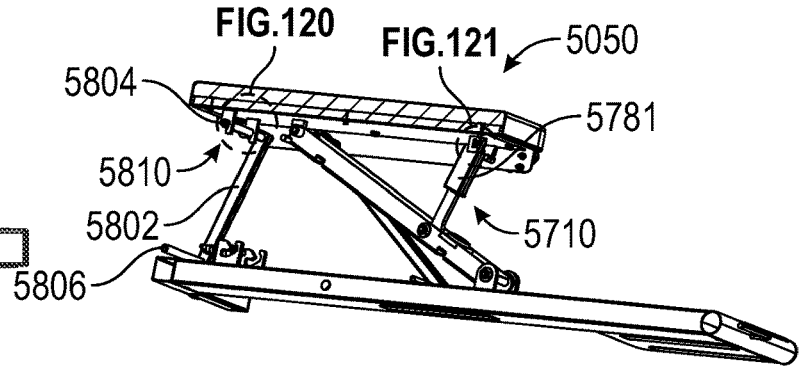
FIG. 119 is a perspective sectional view of the exercise apparatus of FIG. 106 taken along line 119-119 of FIG. 118.
Figure 126:
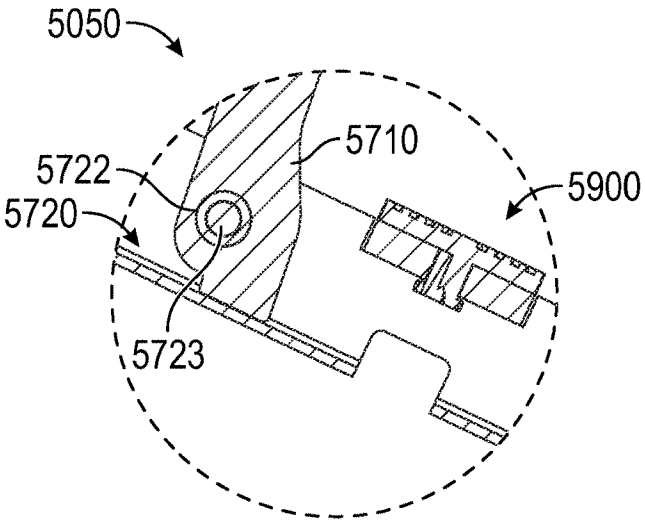

The front locking member 5710 has an irregular shape and comprised of three primary sections: (i) a first or lower section 5720, (ii) a second or middle section 5730, and (iii)

a third or top section 5740. The first or lower section 5720 is best shown in FIGS. 117, 126, and 136, wherein the lower section 5720 includes a pivotal coupling opening 5722. As discussed above, the pivotal coupling opening 5722 is configured to receive the elongated locking member fastener 5723 and the bushing 5716. Unlike the first embodiment of the exercise apparatus 4050, the lower section 5720 does not include: (i) a securement opening 4724, (ii) a securement recess 4726, or (iii) a retaining mechanism recess 4728. Nevertheless, it should be understood that the exercise apparatus 5050 can be modified to include these features, for example, to aid in the retention of the front locking member 5710 within the front support channel 5147*a* when the apparatus 5050 is in the first four positions.

Figure 125:
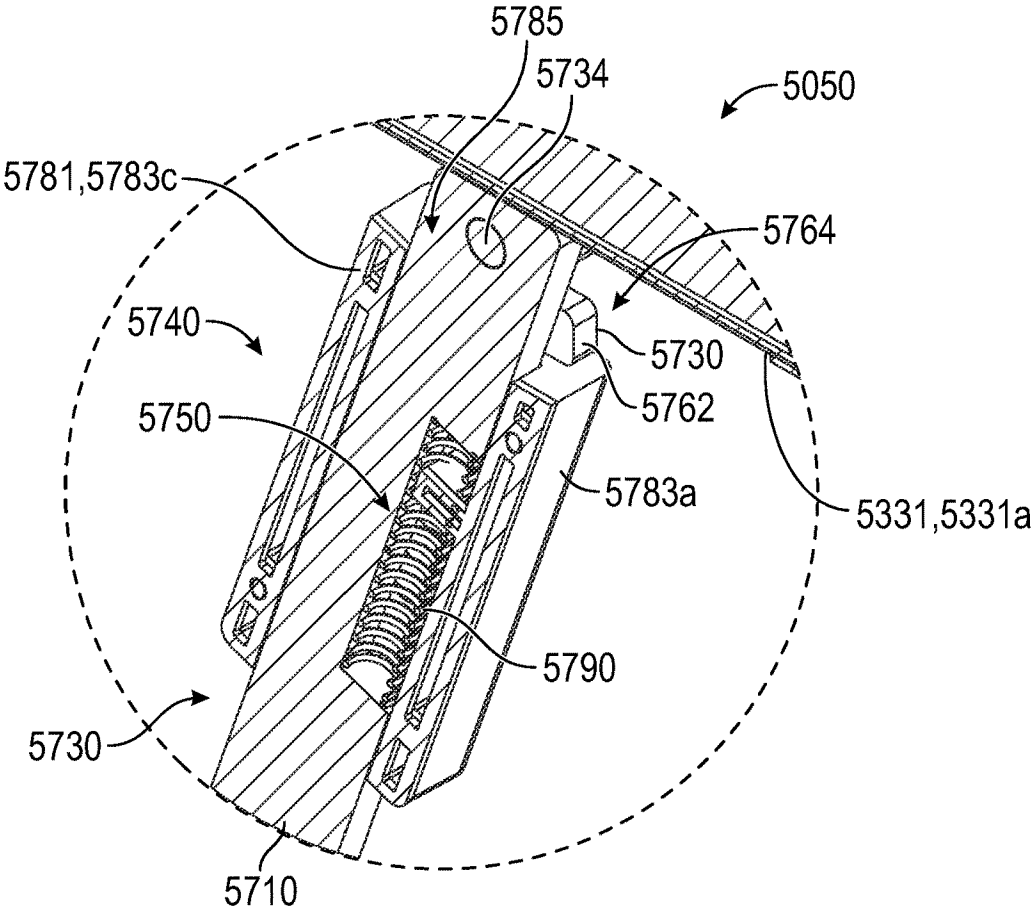

The second or middle section 5730 extends between and is integrally formed with the first and third sections 5710, 5740. The middle section 5730 is substantially linear and is configured to place the third section 5740 in the proper location when the bench 5305 is in the flat bench position $P_F$. As best shown in FIGS. 107, 112, 121, 125, 129-130, 133, the third or upper section 5740 includes a first portion 5740*a* that interacts with a first extent of the front retaining mechanism 5750 and a second portion 5740*b* that is configured to interact with a second extent of the front retaining mechanism 5750. Referring to FIG. 125, the first portion 5740*a* of the third or upper section 5740 includes a biasing receiver 5742 that is designed to receive a biasing member 5790 of the front retaining mechanism 5750, which is described in greater detail below. Referring now to FIGS. 130-131, the second portion 5730*b* of the third or upper section 5730 includes a locking rod 5744 that is coupled to the front locking member 5710 and is designed to fit in a front retaining channel 5764 of the front receiver 5760. To ensure that the locking rod 5744 does not hinder the performance of the apparatus 5050 in the first four positions, the width of the locking rod 5744 is less than the width of the front support channel 5147*a* of the front support member 5147. It should be understood that a majority of the weight that is placed on the lower end 5305*a* of the bench 5305 will be resting against this locking rod 5744. To ensure that the locking rod 5744 does not fail, the locking rod 5744 can be a solid rod that is inserted through the front locking member 5710 and then welded thereto. This design provides additional reliability over a conventional design that simply welds the projections to the front locking member 5710. Nevertheless, other methods of coupling (e.g., welding) the projections to the front locking member 5710 instead of using a single solid rod are contemplated by this disclosure, even if such methods are not as reliable.

2) Front Retaining Mechanism

Figure 121:
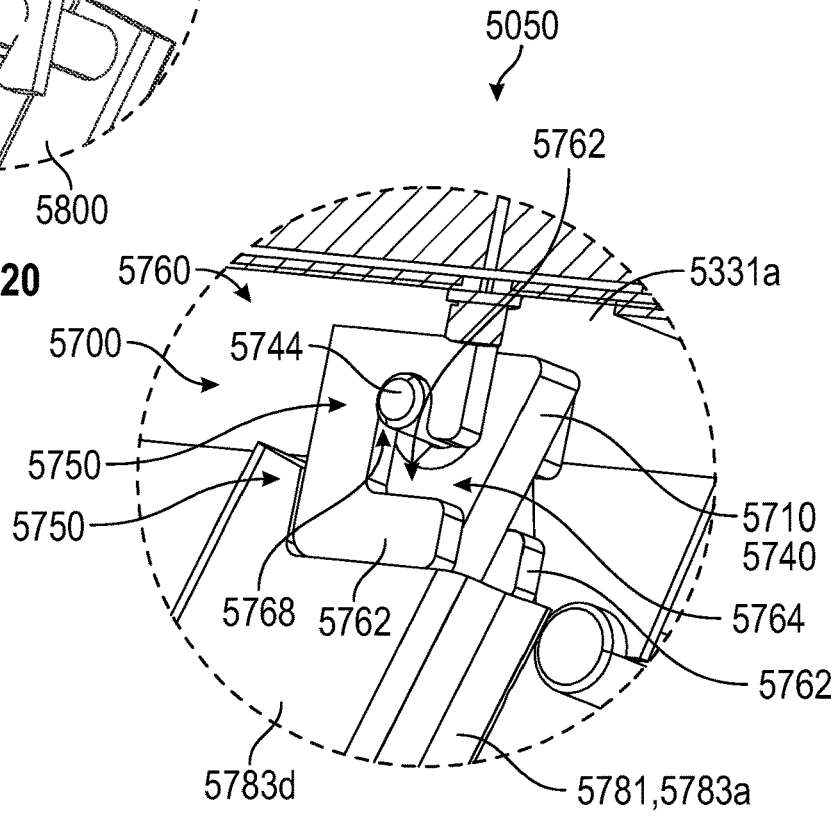
Figure 123:
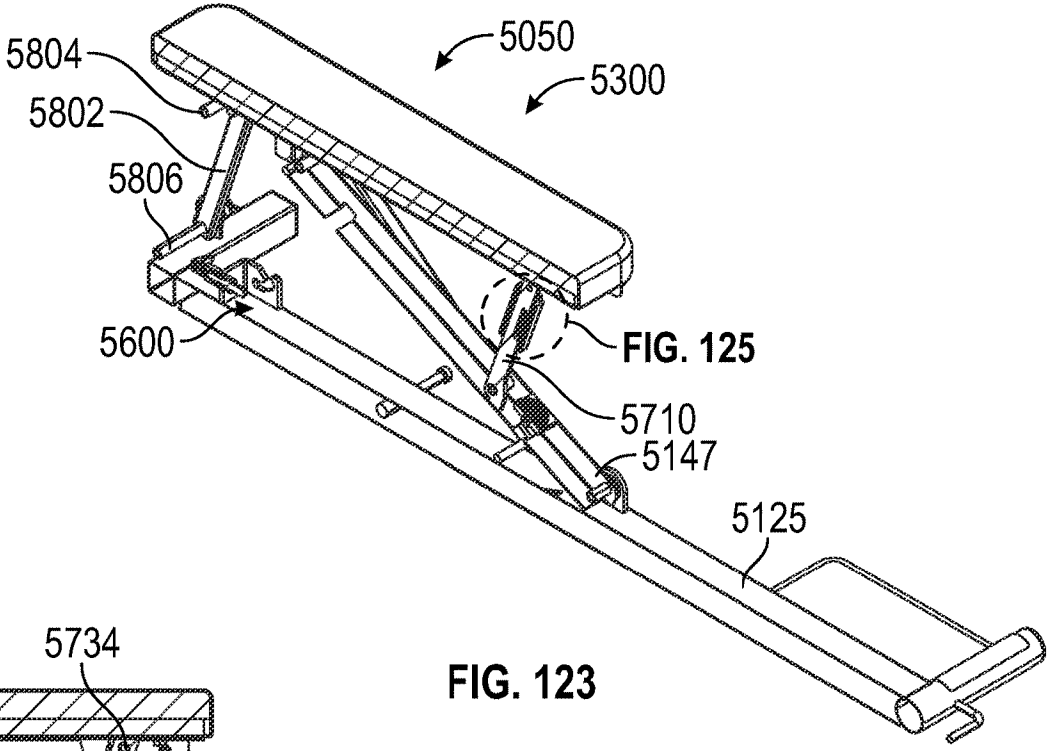
Figure 122:
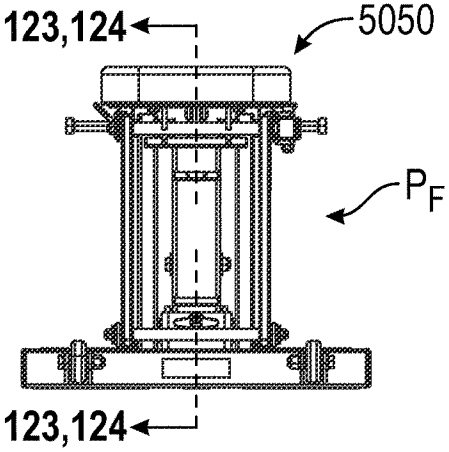
Figure 124A:
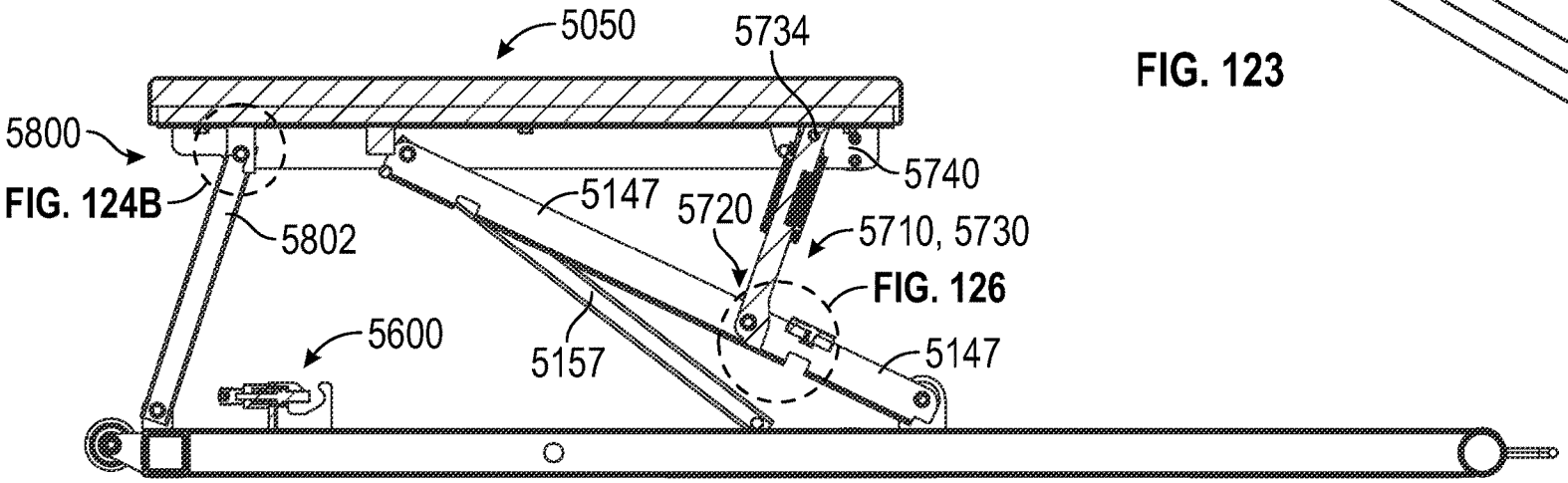
Figure 124B:
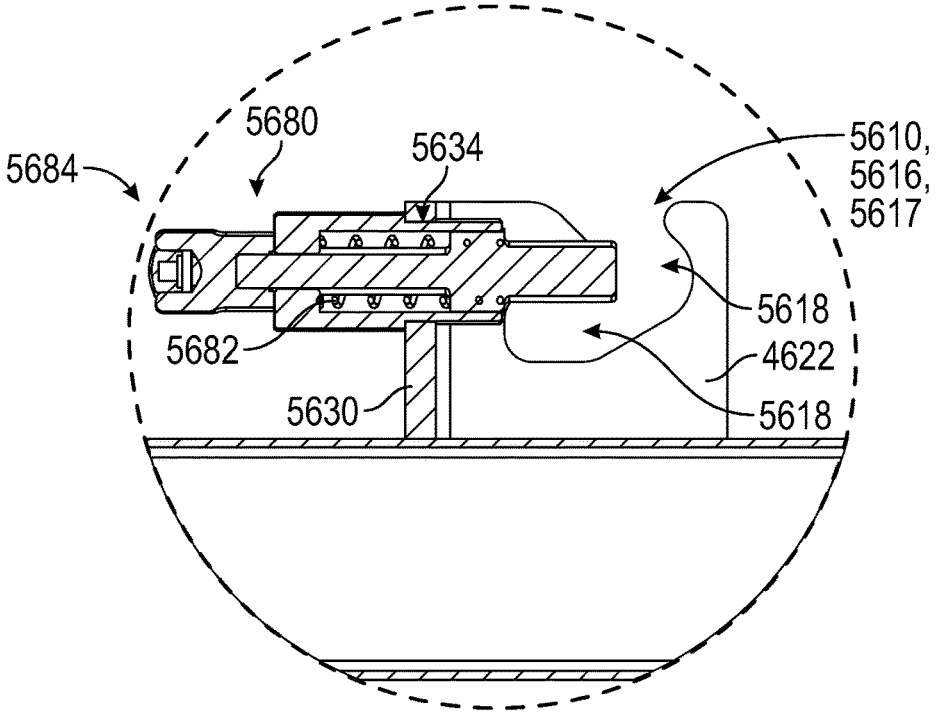

Referring to FIGS. 121, 130, 133, the front retaining mechanism 5750 includes: (i) the receiver 5760 and (ii) a front coupler 5780. The receiver 5760 in the embodiment shown in the Figures is the retaining channel 5764 that is formed with a pair of opposed sidewalls 5762. The pair of opposed sidewalls 5762 are coupled to an extent from the bottom surface 5331*a* of the plate 5331 of the bench support frame assembly 5310. As such the sidewalls 5762 are positioned below the bench 5305. As best shown in FIGS. 121, 130, 133, the retaining channel 5764 has multiple segments, which function together to aid to retain the locking rod 5744 when it is positioned within the retaining channel 5764. These multiple segments include: (i) a first rearward segment 5766 and (ii) a second upwardly directed segment 5768. This arrangement helps ensure that the locking rod 5744 cannot simply be removed from the retaining channel 5764 via a vertical force. In fact, to place the locking rod 5744 at the end of the retaining channel 5764 or to remove the locking rod 5744 from the end of the retaining channel 5764, the user, U, must apply a complex motion on the locking rod 5744. It should be understood that the retaining channel 5764 may have other shapes, additional segments, or fewer segments. For example, the retaining channel 5764 may be substantially curvilinear or bi-linear (e.g., C-shaped, N-shaped, S-shaped, V-shaped, Z-shaped), a combination of these shapes, or a modified version of one or a combination of these shapes (e.g., the horizontal segment of the L-shaped channel may be slanted to form an obtuse angle with the bottom segment of the L-shaped channel). The opposed sidewalls 5762 are configured to interact with a bumper assembly 5900. As described below, this may be desirable because it will decrease potential damage to the frame assembly 5120 and will reduce noise that is associated with the operation of the apparatus 5050.

The front coupler or biased front coupler 5780 of the front retaining mechanism 5750 includes: (i) an engaging and locking member 5781 and (ii) a biasing member 5790. The engaging and locking member 5781 includes a plurality of sidewalls 5783*a*-5783*d* that are arranged to form a receptacle 5785 that receives the front locking member 5710. The rear wall 5783*c* and side walls 5783*b*, 5783*d* include projections 5787*b*-5787*d* that are designed to engage with the receiver 5760 and more specifically the rear and lower edges of the opposed sidewalls 5762. When this engagement is made between these structures, the bench assembly 5300 is locked in the flat bench position $P_F$ and cannot be removed from this position until the user applies a disengagement force on the engaging and locking member 5781. This disengagement force that the user applies on the engaging and locking member 5781 is a downwardly directed force, which compresses the biasing member 5790 that is positioned within the receptacle 5785. In particular, the biasing member 5790 is a spring 5792 that is positioned within the biasing receiver 5742 that is formed in the front locking member 5710 and is configured to interact with an inwardly extending projection 5779 that is coupled to the front wall 5783*a* of the engaging and locking member. Accordingly, the downwardly directed force moves the inwardly extending projection 5779 downward towards the lower central member 5125, which thereby compresses the biasing member 5790 within the biasing receiver 5742. It should be understood that this disengagement force must be sufficient to position the projections 5787*b*-5787*d* below the lowermost extent of the opposed sidewalls 5762. Once the projections 5787*b*-5787*d* to be positioned below the opposed sidewalls 5762, the user can apply a forwardly directed force on the front locking member 5710 to remove the locking rod 5744 from the retaining channel 5764. Once this occurs, the front locking member 5710 may be positioned within the channel that is formed in the front support member 5147.

3) Rear Locking Member

The rear locking mechanism 5800 includes a pair of flat bench supports 5802, a locking cross-bar 5804, and an elongated fastener 5806. The pair of flat bench supports 5802 are similar to the pair of rear support members 5157, except for the fact that the pair of flat bench supports 5802 are coupled to the frame assembly 5120 via the elongated fastener 5806 and are not coupled to the bench assembly 5300 via pivot point fastener 4160. The cross-bars 5146, 5804 are similar structures as both of them extend between the supports 5157, 5802 and are designed to interact with a retaining mechanism 5600, 5810. The inclusion of this rear locking mechanism 5800 may be desirable over solely relying on the rear support members 5157 because, as described below, the overall height of the bench assembly 5300 in the flat bench position $P_F$ can be reduced in the flat bench position $P_F$ which improves the utility of the exercise apparatus 5050.

4) Upper Retaining Mechanism

Figure 107:
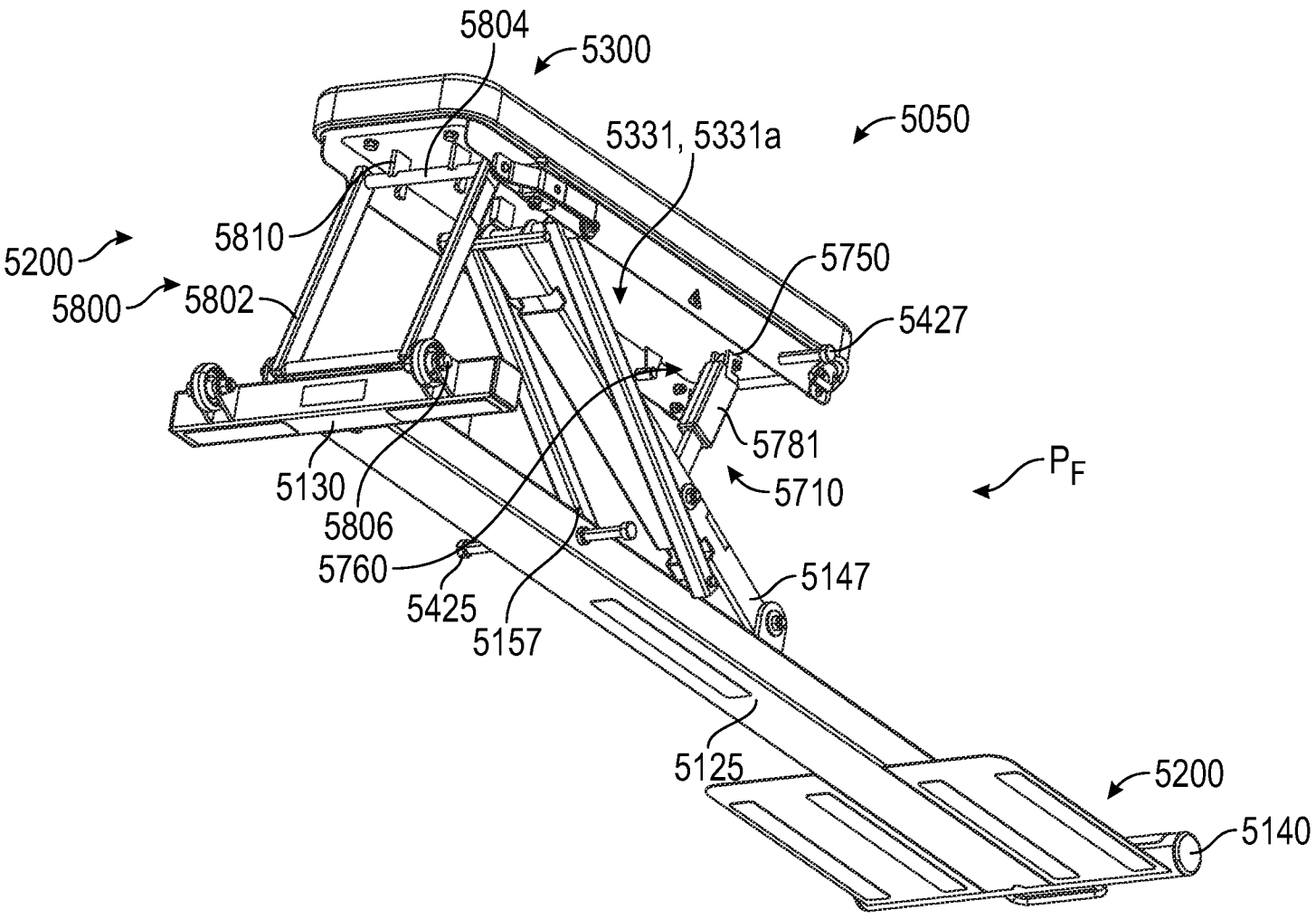
FIG. 107 is a bottom perspective view of the exercise apparatus of FIG. 106.
Figure 108:
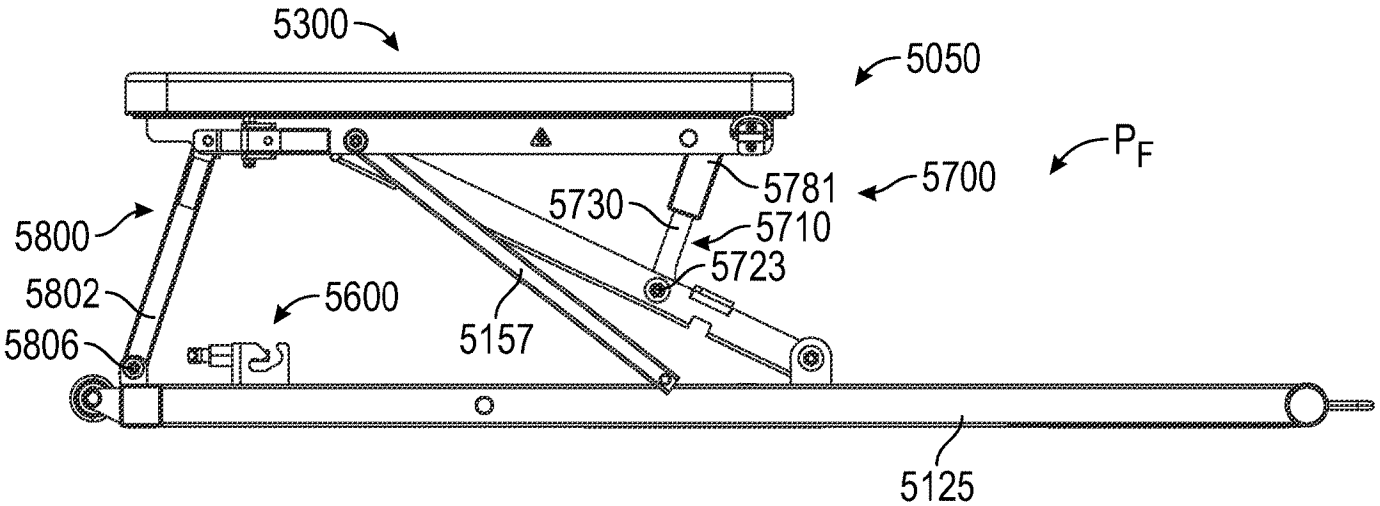
FIG. 108 is a right view of the exercise apparatus of FIG. 106.
Figure 109:
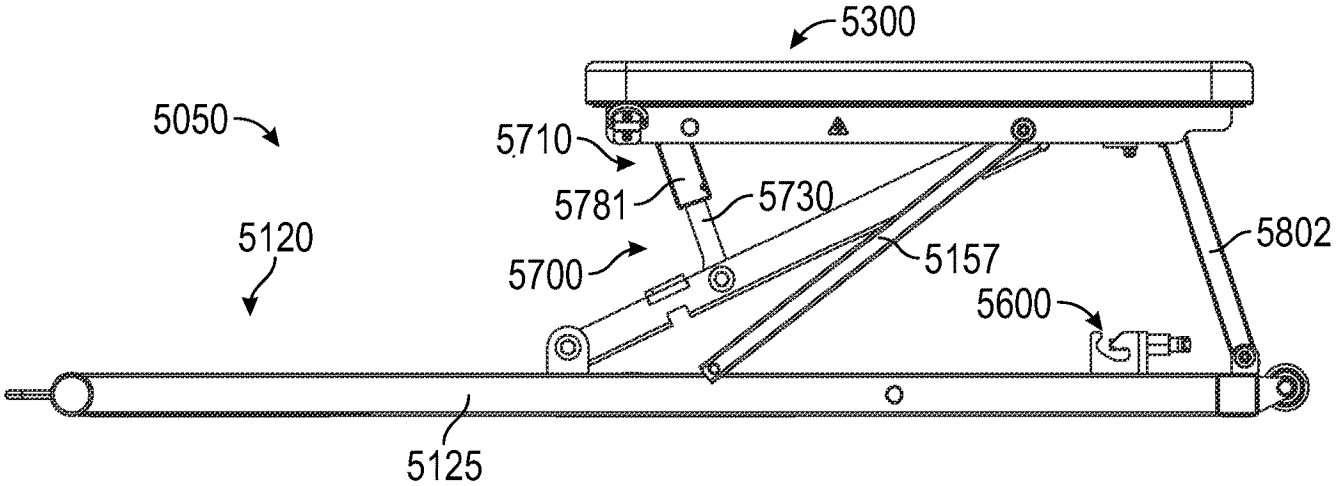
FIG. 109 is a left view of the exercise apparatus of FIG. 106.
Figure 110:
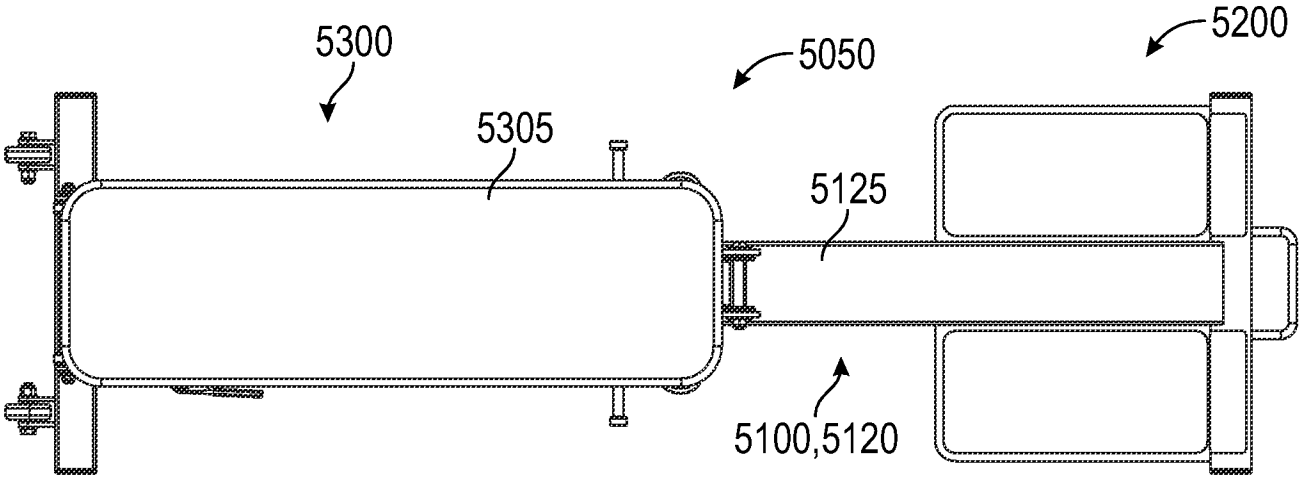
FIG. 110 is a top view of the exercise apparatus of FIG. 106.
Figure 111:
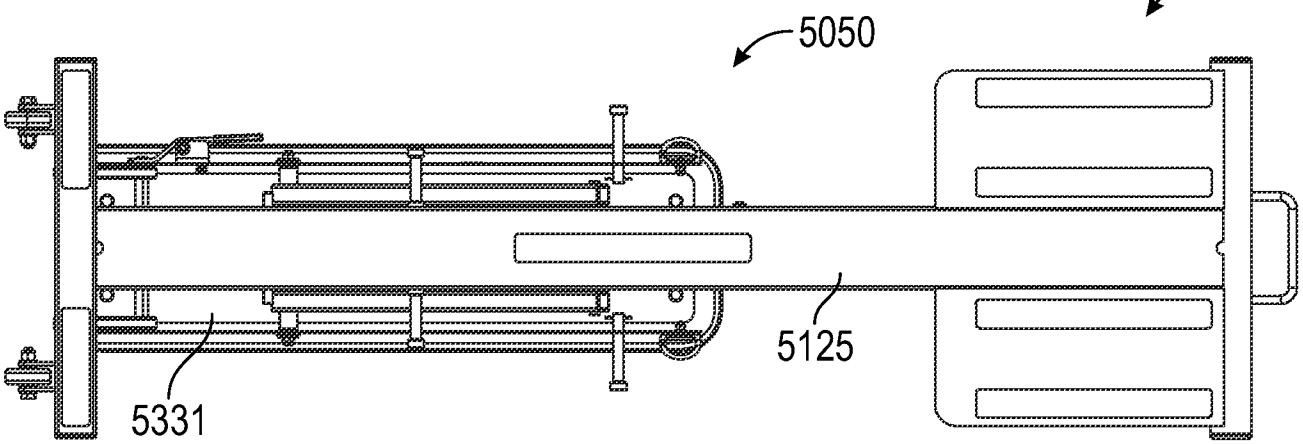
FIG. 111 is a bottom view of the exercise apparatus of FIG. 106.
Figure 112:
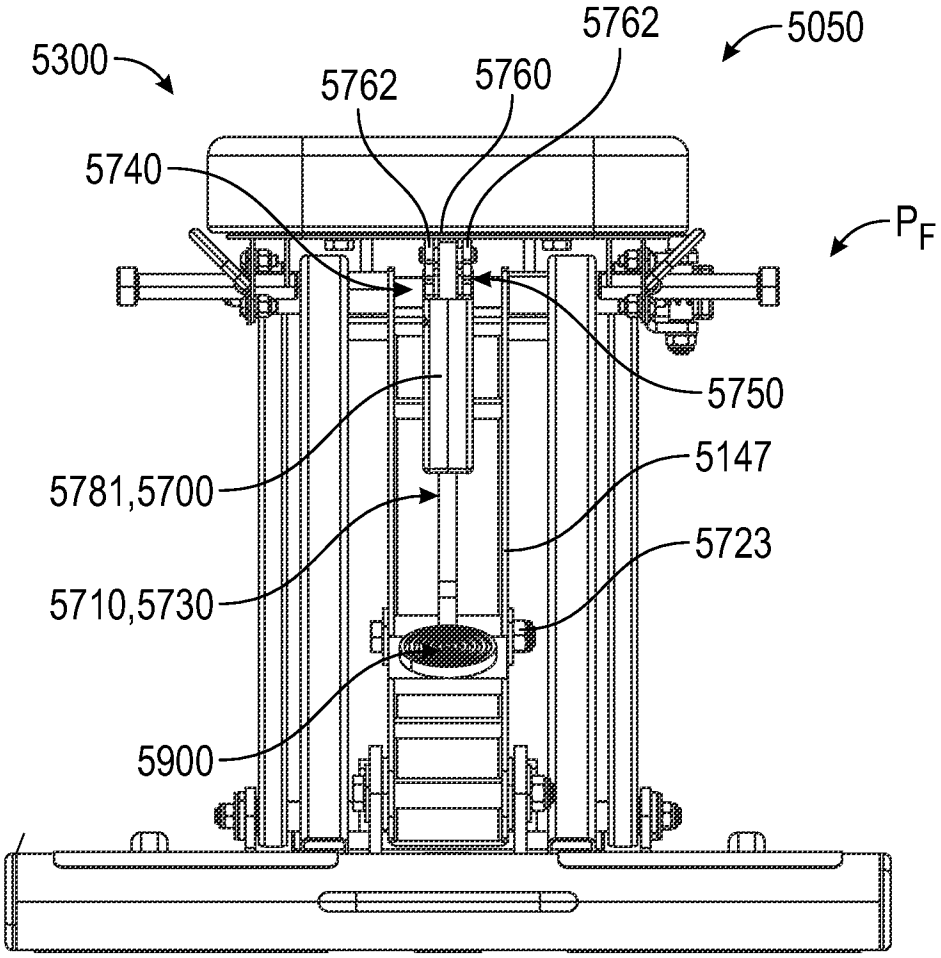
FIG. 112 is a front view of the exercise apparatus of FIG. 106.
Figure 113:
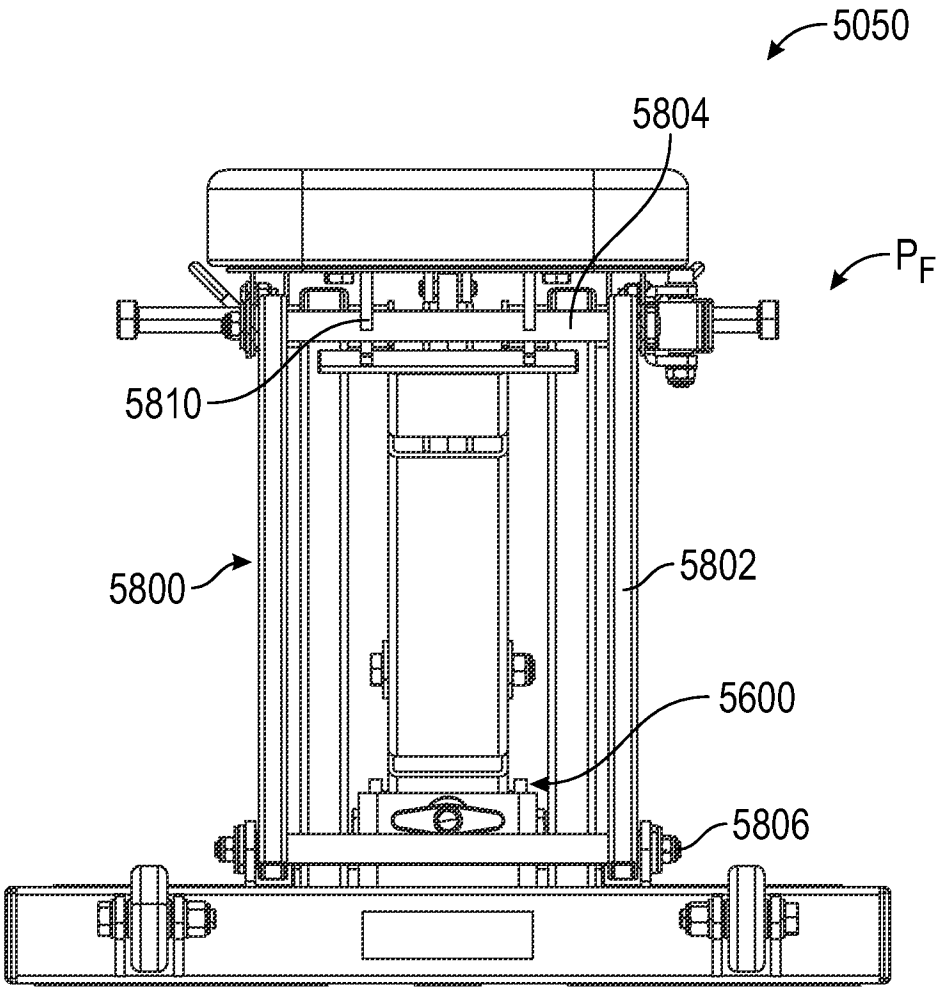
FIG. 113 is a rear view of the exercise apparatus of FIG. 106.
Figure 114:
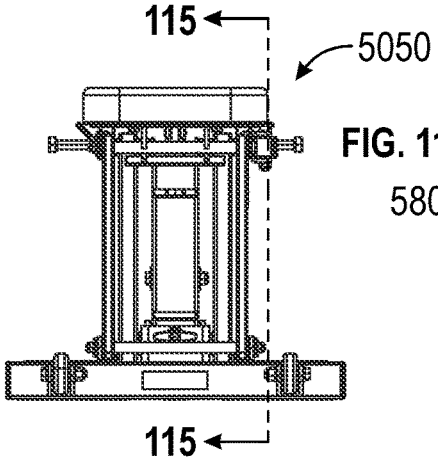
FIG. 114 is a rear view of the exercise apparatus of FIG. 106.
Figure 115:
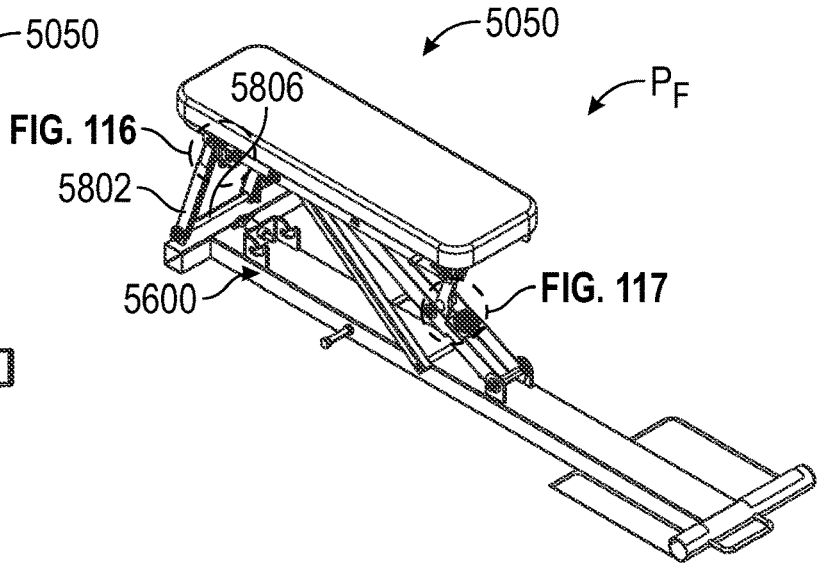
FIG. 115 is a perspective sectional view of the exercise apparatus of FIG. 106 taken along line 115-115 of FIG. 114.
Figure 116:
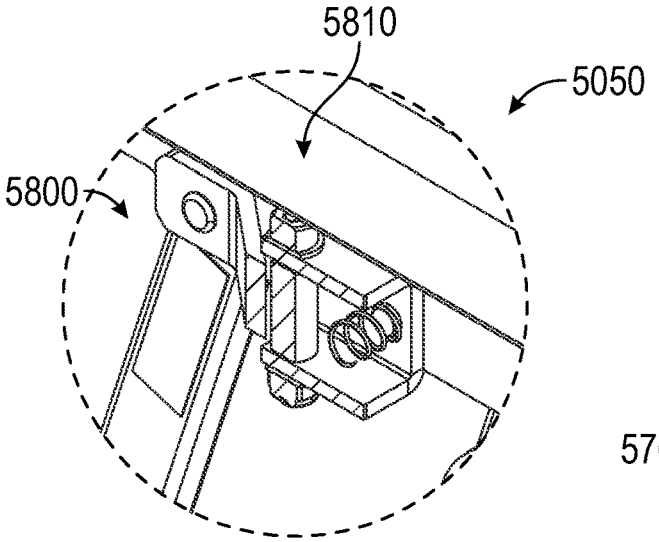
FIG. 116 is a first zoomed-in sectional view of FIG. 115 focusing on upper retaining mechanism in the secured state.
Figure 120:
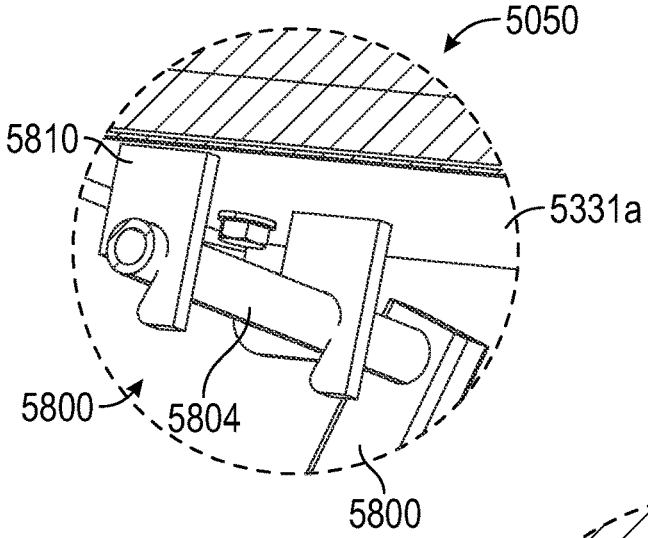
Figure 127:
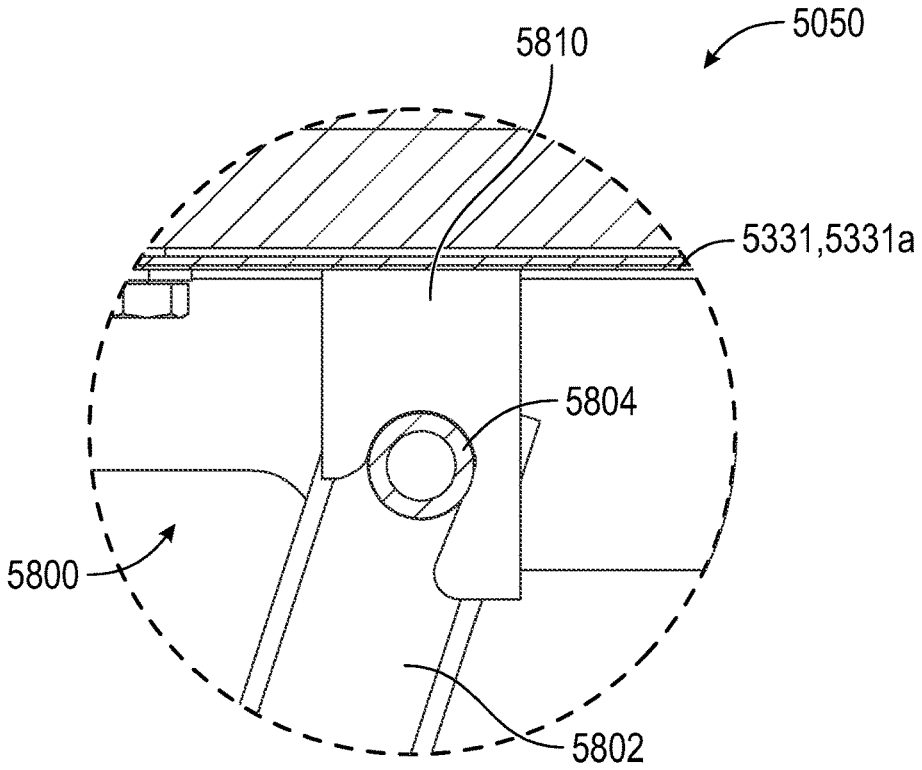

The upper retaining mechanism 5810 includes: (i) receiver 5812 and (ii) an upper coupler 5840. The receiver 5812 in the embodiment shown in the Figures is a retaining recess 5814 that is formed within a pair of opposed sidewalls 5816. The pair of opposed sidewalls 5816 are coupled to an extent of the bottom surface 5331*a* of the plate 5331 of the bench support frame assembly 5310. As such the sidewalls 5816 are positioned below the bench 5305. As best shown in FIGS. 107, 120, and 127 the retaining recess 5814 has multiple segments, which function together to aid to retain the locking cross-bar 5804 when it is positioned within the within recess 5814.

The upper coupler 5840 of the upper retaining mechanism 5810 includes: (i) retaining pin 5842, (ii) a handle 5844, and (iii) a biasing assembly 5846. The retaining pin 5842 is configured to be received by the locking cross-bar 5744, as best shown in FIGS. 141 and 145. The handle 5844 is coupled to the retaining pin 5842 and allows a user to move the retaining pin 5842 out of the locking cross-bar 5804 in order to disengage the upper retaining mechanism 5810. Once disengaged, the flat bench supports 5802 can be laid flat on the support frame 5120 and the bench can be moved to a different position. The handle 5844 is biased in the engaged or locked position by the biasing assembly 5846. In particular, the biasing assembly 5846 includes a spring member 5848 and a pivot point that is provided by an elongated projection that is coupled to the bench 5305. The user can engage or disengage the retaining pin 5842 by applying an inwardly directed force on the handle 5844 that is strong enough to overcome the biasing force of the spring 5848. It should be understood that other methods of retaining these structure or coupling these structures to one another may be utilized.

B. Energy Absorbing Structure

As best shown in FIGS. 112, 117, 126, and 144, a bumper assembly 5900 is coupled to the frame assembly 5120 and more specifically the front support member 5147. The bumper assembly 5900 includes an energy absorbing structure 5910 and a mounting structure 5920. The mounting structure 5920: (i) is welded to the front support member 5147, (ii) extends between the two sides of the front support member 5147, and (iii) is positioned within the front support channel 5147*a* that is formed by the front support member 5147 and proximate to the cross-bar aperture 5158 (see FIG. 103), and (iv) is positioned proximate to the lower end 5305*a* of the bench 5305. This placement of the mounting structure 5920 properly positions the energy absorbing structure 5910 in a position to reduce the bench 5305 from: (i) striking and potentially damaging the frame assembly 5120 and (ii) minimize the creation of a pinch point for a user's, U, finger. In other words, the bumper assembly 5900 is configured to absorb energy that would otherwise be transferred from the bench assembly 5305 to the first support member 5147.

The energy absorbing structure 5910 is coupled to the mounting structure 5920 via an elongated fastener. The energy absorbing structure 5910 is approximately 1 inch thick and an extent of the energy absorbing structure 5910 includes deformable projections 5912, which are shown as concentric rings in the Figures. These deformable projections 5912 are configured such that they: (i) slightly deform as a result of the gravitational pull on a user, when a user is in the ready to use position, (ii) have a larger deformation as a result of the acceleration of dropping the bench 5305 and the user from the extended position, and (iii) preferably do not fully deform or bottom out when a user drops the bench 5305 along with themselves from the extended position. To achieve this configuration, the energy absorbing structure 5910 may be made from rubber or another deformable plastic substance. It should be understood that energy absorbing structures 5910 may be used, which may led to different levels of deformation. Further, it should be understood that the deformable projections 5912 may be omitted and replaced by an extent of the energy absorbing structure 5910.

The height of the energy absorbing structure 5910 along with the positioning of the mounting structure 5920 are design to create a gap 5950 between: (i) an upper most extent of the two sides of the front support member 5147 and (ii) a lower most extent of the plate 5331. This gap 5950 is at least 0.5 inches and preferably more than 1.5 inches. This gap 5950 is designed to help eliminate the potential finger pinch point. While the pair of opposed rails 5332 of the bench support frame assembly 5310 act as a guard to help prevent a user from accessing this potential finger pinch point, this gap 5950 reduces the likelihood that a potential finger pinch point is created by the apparatus 5050 while the user is properly using the apparatus 5050. Regardless of the reduction in the likelihood that a potential finger pinch point is created, while the apparatus is in use, users are instructed to keep their hands above the bottom of the bench 5305 to avoid all potential finger pinch points. In other words, placing your hands below the bottom of the bench 5305, while using the apparatus 5050, is not advised and my lead to injury.

C. Dimensions of the Bench Assembly

FIGS. 146-148 show: (i) the exercise apparatus 2050 from U.S. Pat. No. 10,226,665, (ii) the exercise apparatus 4050 from the first embodiment of this Application and the second embodiment from U.S. Provisional Application No. 63/038,338, and (iii) the exercise apparatus 5050 from the second embodiment of this Application and the second embodiment from U.S. Provisional Application No. 63/115,929. Referring first to FIG. 146, the exercise apparatus 2050 has four height measurements and three length measurements. In particular, the exercise apparatus 2050 has a: (i) flat bench height $H_{A1}$ that extends between the lowermost extent of the exercise apparatus 2050 and the uppermost extent of the exercise apparatus 2050 and is between 19-21 inches and is preferably 20 inches, (ii) a second height $H_{A2}$ that extends between the upper surface of the rear lateral member 2130 and the uppermost extent of the exercise apparatus 2050 and is between 17-19 inches and is preferably 18 inches, (iii) a third height $H_{A3}$ that extends between the lowermost extent of the exercise apparatus 2050 and lower surface of the bench 2305 and is between 18-20 inches and is preferably 19 inches, and (iv) a fourth height $H_{A4}$ that extends between an upper surface of the rear lateral member 2130 and the lower surface of the bench 2305 and is between 16-18 inches and is preferably 17 inches. Additionally, the exercise apparatus 2050 has: (i) a length $L_{A1}$ that is defined between a rear edge of the bench 2305 to pivot point PP that is between 11-13 inches and is preferably 12 inches, (ii) a length $L_{A2}$ defined between the pivot point PP and the front edge of the bench 2305 that is between 21-23 inches and is preferably 22 inches, (iii) a length $L_{A3}$ defined between the front edge of the bench 2305 and the forwardmost point of the front lateral member 2140 that is between 18-23 inches and is preferably 21 inches, and (iv) a length $L_{A4}$ that is defined between a forwardmost point of the front lateral member 2140 and the forwardmost point of the exercise apparatus 2050 that is between 1-5 inches and is preferably 3 inches.

Referring to FIG. 147, the exercise apparatus 4050 has four height measurements and three length measurements. In particular, the exercise apparatus 4050 has a: (i) flat bench height $H_{B1}$ that extends between the lowermost extent of the exercise apparatus 4050 and the uppermost extent of the exercise apparatus 4050 and is between 22-24 inches and is preferably 23 inches, (ii) a second height $H_{B2}$ that extends between the upper surface of the rear lateral member 4130 and the uppermost extent of the exercise apparatus 4050 and is between 20-22 inches and is preferably 21 inches, (iii) a third height $H_{B3}$ that extends between the lowermost extent of the exercise apparatus 4050 and lower surface of the bench 4305 and is between 20-22 inches and is preferably 21 inches, and (iv) a fourth height $H_{B4}$ that extends between an upper surface of the rear lateral member 4130 and the lower surface of the bench 4305 and is between 17.5-19.5 inches and is preferably 18.5 inches. Additionally, the exercise apparatus 4050 has a: (i) rear edge of the bench 4305 to pivot point PP length $L_{B1}$ that is between 10-12 inches and is preferably 11 inches, (ii) a PP to front edge of the bench 4305 length $L_{B2}$ that is between 19-22 inches and is preferably 21 inches, and (iii) front edge of the bench 4305 to forward most point of the front lateral member 4140 length $L_{B3}$ that is between 16.75-20.75 inches and is preferably 18.75 inches, (iv) forward most point of the front lateral member 4140 to forward most point of the exercise apparatus 4050 length $L_{B4}$ that is between 0-3.5 inches and is preferably 2.25 inches.

Referring first to FIG. 148, the exercise apparatus 5050 has four height measurements and three length measurements. In particular, the exercise apparatus 5050 has a: (i) flat bench height $H_{C1}$ that extends between the lowermost extent of the exercise apparatus 5050 and the uppermost extent of the exercise apparatus 5050 and is between 16-18 inches and is preferably 17 inches, (ii) a second height $H_{C2}$ that extends between the upper surface of the rear lateral member 5130 and the uppermost extent of the exercise apparatus 5050 and is between 14-16 inches and is preferably 15 inches, (iii) a third height $H_{C3}$ that extends between the lowermost extent of the exercise apparatus 5050 and lower surface of the bench 5305 and is between 14-16 inches and is preferably 15 inches, and (iv) a fourth height $H_{C4}$ that extends between an upper surface of the rear lateral member 5130 and the lower surface of the bench 5305 and is between 12-14 inches and is preferably 13 inches. Additionally, the exercise apparatus 5050 has: (i) a rear edge of the bench 5305 to pivot point PP length $L_{C1}$ that is between 10-12 inches and is preferably 11 inches, (ii) a PP to front edge of the bench 5305 length $L_{C2}$ that is between 19-22 inches and is preferably 21 inches, (iii) front edge of the bench 5305 to forward most point of the front lateral member 5140 length $L_{C3}$ that is between 23-27 inches and is preferably 25.5 inches, (iv) forward most point of the front lateral member 5140 to forward most point of the exercise apparatus 5050 length $L_{C4}$ that is between 0-3.5 inches and is preferably 2.25 inches, (v) a rear edge of the bench 5305 to pin 5842 length $L_{C1A}$ that is between 3-5 inches and is preferably 4 inches, and (vi) a pin 5842 to PP length $L_{C1B}$ that is between 7-9 inches and is preferably 7 inches.

The overall height $H_{C1}$ of the exercise apparatus 5050 in the flat bench position $P_F$ is: (i) preferably 3 inches shorter than the flat bench height Hal of exercise apparatus 2050, and (i) preferably 6 inches shorter than the flat bench height $H_{B1}$ of exercise apparatus 4050. The reduction in the overall height $H_{C1}$ of the exercise apparatus 5050 as compared to that in the exercise apparatus 2050 was accomplished despite increasing the thickness or height of the bench 5305 to 2 inches as compared to the 1 inch thickness of the bench 2305. The increase in the thickness of the bench 5305 improves the utility and comfort of the exercise apparatus 5050, especially as the user U utilizes the apparatus 5050 over time. Additionally, the fourth height $H_{C4}$ of exercise apparatus 5050 is: (i) preferably 4 inches shorter than the flat bench height $H_{A4}$ of exercise apparatus 2050, and (i) preferably 5.5 inches shorter than the flat bench height $H_{B4}$ of exercise apparatus 4050. The reduction of the bench height helps reduce potential difficulties for shorter users U regarding stabilization, mounting and/or dismounting the exercise apparatus 5050. For example, a user who is under 5'5" may not be able to place his/her feet on the ground or support surface (upon which the apparatus 5050 rests) while using the apparatus 5050. Accordingly, it is desirable to lower the height of the bench 2305, 4305 to enable a large number of users U to properly utilize the apparatus 5050. However, reducing the height of the bench 5305 to the optimal overall height—provided by $H_{C1}$—is not a simple revision; instead, reducing the overall height $H_{C1}$ presents substantial challenges because the apparatus 5050 has a complex configuration with numerous components, various users U interact differently with the apparatus 5050, and the packaging and shipping constraints for the apparatus 5050. For example, simply moving the rear retaining mechanism 5600 to the interior rear edge of the rear lateral member 5130 does not achieve the necessary reduction in the optimal overall height $H_{C1}$. Additionally, moving the front elongated fastener 5126 forward towards the front lateral member 5140 is not feasible because it reduces the area that accommodates user's legs which makes usage of the apparatus 5050 uncomfortable and impossible for users U that are tall. In order to properly reduce the overall height $H_{C1}$, a completely new structure—namely, the rear locking mechanism 5800 and upper retaining mechanism 5810—was added to the apparatus 5050. A skilled designer of exercise equipment for use in home or light-gym applications tries to minimize the extent and bulk of components and structures in an exercise apparatus because excessive components and structures increases the manufacturing, packaging and shipping costs of the exercise apparatus. Also, excessive components and structures adversely increase the weight and the complexity of use of the exercise machine, which reduces its utility. Therefore, inclusion of the new the rear locking mechanism 5800 and upper retaining mechanism 5810 provides a unique apparatus 5050 with substantial benefits over conventional exercise machines.

Additionally, the distance between a front edge of the bench 5305 and the forwardmost point of the exercise apparatus 5050, preferably at the frontal handle near the lower central member 5125 and the front lateral member 5140, defines a third length $L_{C3}$ of the exercise apparatus 5050 that is: (i) preferably 4 inches longer than the third $L_{A3}$ of exercise apparatus 2050, and (i) preferably 7 inches longer than the third $L_{B3}$ of exercise apparatus 4050. This substantial increase in the length of the support assembly 5100, namely the lower central member 5125, ensures that the user U properly and safely interacts with and is supported by the exercise apparatus 5050 while performing the gluteal bridge movement. As described above, extending the length of the support assembly 5100, including the lower central member 5125, is unconventional because it increases the overall size, weight, and material cost of the apparatus 5050, which are design constraints for the exercise apparatus 5050. Nonetheless, due to careful design and engineering, the apparatus 5050 has an arrangement of unique dimensions that enable the apparatus 5050 to appeal to a broad segment of users U having different heights and body types in order to maximize the utility of the apparatus 5050.

FIG. 149 shows the exercise apparatus 5050 in the ready to use position $P_U$ and other important dimensions that result from the unique design and layout of various components of the apparatus 5050 that provide the functionality between the five positions: the collapsed position, $P_C$, the ready to use position, $P_U$, the hip extended position $P_E$, the bottom position, $P_B$, and the flat bench position, $P_F$. A fifth height $H_{C5}$ is defined between the upper edge of the bench 5305 and the ground G, and this height ranges from 24-34 inches, preferably 26-32 inches and most preferably 28-30 inches. A sixth height $H_{C6}$, is defined between the ground G and the pivot point PP, and this height ranges from 14.5-24.5 inches, preferably 16.5-22.5 inches and most preferably 18.5-20.5 inches. A seventh height $H_{C7}$, is defined between the ground G and the lowermost edge of the bench 5305, and this height ranges from 3-10 inches, preferably 4-9 inches and most preferably 5.5-7.5 inches. The seventh height or gap height is beneficial because it ensure that the bench 5305 does not make contact with the central frame member 5125 during use of the apparatus 5050.

As shown in FIGS. 146 and 148, the angles between components are significantly different between apparatus 2050 and apparatus 5050 in the flat bench position $P_F$. Specifically, these angles are defined between: (i) the central member 2125, 5125 and the front support member 2147, 5147 and (ii) the central member 2125, 5125 and the rear support members 2157, flat bench supports 5802. For example and referring to FIG. 146 (showing the flat bench position $P_F$), angle alpha $\alpha_A$ is defined between the central member 2125 and the front support member 2147 and is between 39 and 45 degrees and is preferably 42 degrees. Referring to FIG. 148 (showing the flat bench position $P_F$), angle alpha $\alpha_C$ that extends between the central member 5125 and the front support member 5147 and is between 20.5 and 30.5 degrees and is preferably 25.5 degrees. Additionally, angle beta $\beta_A$ is defined between the central member 2125 and the rear support members 2157 and is between 60 and 64 degrees and is preferably 62 degrees. In comparison, angle beta $\beta_C$ is defined between the central member 5125 and the flat bench supports 5802 and is between 70 and 74 degrees and is preferably 72 degrees. Finally, the second embodiment of the apparatus 5050 has another angle theta θ, which extends between the central member 2125 and the rear support members 5157 and is between 20 and 45 degrees and preferably 37 degrees. These significant angular difference allow the exercise apparatus 5050 to properly function in the ready to use position $P_U$ and extended position $P_E$, while enabling the bench 5300 to be placed at the optimal height in the flat bench position $P_F$, all the while appealing to a broad segment of users U having different heights and body types in order to maximize the utility of the apparatus 5050.

D. Other Changes Between the Apparatuses

In addition to the dimensional changes between the apparatuses and the inclusion of the rear locking mechanism 5800 in the second embodiment of the apparatus 5050, both apparatuses 4050, 5050 have a significant number of additional or alternative structures in comparison to apparatus 2050. These additional or alternative structures contained within 4050, 5050 provide significant advantages over apparatus 2050. First, apparatuses 4050, 5050 include an over-rotation mechanism 4800, 5800 that helps ensure that the user U cannot over rotate the bench 4300, 5300 while using the apparatuses 4050, 5050, which improves both safety and utility of the apparatuses 4050, 5050. Second, the apparatuses 4050, 5050 include energy attenuation structures 4716, 5900 that are designed to absorb energy that is transmitted from the lower end 4305*a*, 5305*a* of the bench 4305, 5305 to the frame assembly 4120, 5120. These structures 4716, 5900 reduce wear and tear on the frame assembly 4120, 5120 that could impact its reliability as compared to the apparatus 2050 that lacks the energy absorbing components. Third, moving the location of the attachment points between the rear support members 4157, 5147 and the central member 4125, 5125 forward and away from the rear lateral member 4130, 5130 increases usability and stability of the bench 4305, 5305. Fourth, the uncoupling of the rear support members 4157, 5147 from the central member 4125, 5125 is beneficial over the sliding frontal fastener 2126 of apparatus 2050 because it eliminates potential finger pinch points and increases the stability of the bench 4305, 5305. Fifth, using a rectangular shaped central member 4125, 5125 over the U-shaped member 2025 is beneficial because it increases rigidity and durability of the frame assembly 4120, 5120. Sixth, using an upper securement means 4415, 5415 that is permanently affixed to the bench 4305, 5305 is beneficial over a removable upper securement means because it reduces the changes that the securement means could be misplaced and increase the durability of the securement means. Finally, extending the lower plate member 4207, 5207 to the front lateral member 4140, 5140, utilizing a circular frontal lateral member 4140, 5140, including a handle, and positioning the wheels 4184 on the opposite side of the apparatus 4050, 5050 provides increased clearance for the user U, as compared to conventional exercise apparatuses.

4) The Third Embodiment of the Exercise Apparatus

While the above paragraphs describe some aspects of the components (e.g., rear locking mechanism 5800) that are designed to reduce the overall height $H_{C1}$ of the exercise apparatus 5050, namely the overall height of the bench 5305, in the flat bench position $P_F$, it should be understood that alternate structures/configurations may be utilized. For example, in a third embodiment shown in FIGS. 155-156, the exercise apparatus 6050 includes a first rear retaining mechanism 6600 and a second rear retaining mechanism 6615 that is adjacent to the exterior rear edge of the rear lateral support member 6130 of the frame assembly 6100. This second rear retaining mechanism 6615 is designed to receive an extent of the frame assembly 5120, namely the cross-bar 6146 extending between the rear support members 6157 in the flat bench position $P_F$. In the flat bench position $P_F$, the lowermost ends of the rear support members 6157: (i) extend beyond the perimeter of the rear lateral support member 6130, and (ii) are located between the pair of wheels 6184 affixed to the lateral support member 6130. Due to the arrangement and configuration of these components, the overall height He of the bench 6305 is approximately 17 inches without using the rear locking mechanism 5800 found in the exercise apparatus 5050. This is beneficial because it provides the usability of the second embodiment, while minimizing the number of components and structures.

5) Functionality and Operation of the Exercise Apparatus

Referring to FIGS. 150-151, the exercise apparatus 4050, 5050, 6050 facilitates the performance of the gluteal bridge movement, typically with resistance, by a user U in a safe, controlled and efficient manner. While FIGS. 150-151 only show exercise apparatus 5050, it should be understood that the functionality described below applies to exercise apparatus 4050 and 6050. The operable configuration of the bench 4305, 5305, 6305 to the pair of rear support members 4157, 5157, 6157 and the front support member 4147, 5147, 6147 provides a pivot point PP generally aligned with an inferior aspect of the user's U scapulae and the user's U thoracic spine. When the user is properly positioned on the bench 4305, 5305, 6305, the pivot point PP is located between thoracic vertebras T1 through T12 of the user's U spine, preferably between vertebrae T3-T9, and most preferably between vertebrae T5-T7. In this operable configuration, the bench assembly 4300, 5300, 6300 and specifically the bench 4305, 5305, 6305 underlies and supports the user's U entire thorax, including the lumbar, thoracic and cervical spines, in a neutral position throughout the entire range of motion of the exercise, which helps protect the user's U spine and allows the motion of the exercise to be concentrated at the hip joints. The apparatus 4050, 5050, 6050 purposely eliminates any accessory movement through the user's spine and improves overall effectiveness of the resisted gluteal bridge exercise.

In the ready for use position $P_U$, the bench support frame assembly 4310, 5310, 6310 engages the front support member 4147, 5147, 6147 of the bench 4305, 5305, 6305. To properly use the exercise apparatus 4050, 5050, 6050 the user U sits near the end of the bench 4305, 5305, 6305, suitably positions his/her feet on the deck assembly 4200, 5200, 6200, and aligns the inferior portion of his/her scapulae at, or proximate the pivot point, PP. Once the user U is positioned on the bench 4305, 5305, 6305, the user U secures his or her hips and lower abdomen to the bench 4305, 5305, 6305 via the belt assembly 4315, 5315, 6315 and places his/her feet on the deck assembly 4200, 5200, 6200 and/or the front lateral member 4140, 5140, 6140. After the belt members 4320, 4325, 5320, 5325, 6320, 6325 are connected via the buckle 4330, 5330, 6330, the user u adjusts the length of the first and/or second members 4330, 4325, 5330, 5325, 6330, 6325 to ensure that the belt assembly 4315, 5315, 6315 properly secures the user to the bench 4305, 5305, 6305 and attain the ready for use position $P_U$.

After the user U is secured to the bench 4305, 5305, 6305 the user U utilizes their gluteal muscles and accessory muscles of the hip and thigh to drive and elevate his/her hips in a substantially upward direction, as reflected by upwardly directed arrow. This upwardly directed movement by the user U causes the users knees to move from a position of relative flexion towards a position of less knee flexion. Additionally, this upwardly directed movement by the user U causes the lower end 4305*a*, 5305*a*, 6305*a* of the bench 4305, 5305, 6305 to move upward and away from the deck assembly 4200, 5200 while the bench 4305, 5305, 6305 pivots around the pivot point PP. Further, this upwardly directed movement by the user U causes the resistance band 4405, 5405 to stretch or elongate which then provides resistance force to the user's U ability to move the lower end 4305*a*, 5305*a*, 6305*a* of the bench 4305, 5305, 6305 upward. Therefore, the higher the tension of the resistance band 4405, 5405, 6405 the more force the user U will have to use to cause the lower end 4305*a*, 5305*a*, 6305*a* of the bench 4305, 5305, 6305 to move upward.

While the user's feet remain on the deck assembly 4200, 5200, 6200 and/or resting against the deck assembly 4200, 5200, 6200 and the front lateral member 4140, 5140, 6140 the user U continues to driving upward until he/she reaches the third or extended position $P_E$ shown in FIG. 151. The extended position $P_E$ occurs for most users U when the interior angle (that extends through the front support member 4147, 5147, 6147) between the bench 4305, 5305, 6305 and the rear support members 4157, 5157, 6157 is between 75 and 115 degrees, and typically is 90-110 degrees. Further rotation beyond 130 degrees is prohibited by the over-rotation mechanism 4800, as described above. Once the extended position $P_E$ is reached, the user U may hold or maintain this position for a period of time. In the extended position $P_E$, the resistance assembly 4400, 5400, 6400 and the front support member 4147, 5147, 6147 intersect each other in an "X-shaped" arrangement (see FIG. 151). The is reached After the user U has reached the extended position $P_E$, the user U allows the lower end 4305*a*, 5305*a*, 6305*a* of the bench 4305, 5305, 6305 to move downward towards the deck assembly 4200, 5200, 6200 until the bench support frame assembly 4310, 5310, 6310 engages the front support member 4147, 5147, 6147 whereby the bench 4305, 5305, 6305 reaches the bottom position $P_B$. At the bottom position $P_B$, the gap 4950, 5950, 6950 is formed between the lower bench end 4305*a*, 5305*a*, 6305*a* or the lower bench frame end 4310, 5310, 6310 and the nearby extent of the central member 4125, 5125, 6125 of the frame assembly 4120, 5120, 6120. Accordingly, the user U progresses from the ready for use position $P_U$ upward through the hip extended position $P_E$ and back downward to the bottom position $P_B$, where the progression through these three positions defines one complete repetition of the gluteal bridge exercise. After the user U completes the desired number of repetitions, the user U releases the buckle 4330, 5330, 6330 which causes the first and second members 4320, 4325, 5320, 5325, 6320, 6325 to disengage from one another. The user U is then able to stand-up and exit from the exercise apparatus 4050, 5050, 6050.

As shown in FIGS. 152-154, the user U can move the exercise apparatus 4050, 5050, 6050 from the ready for use position $P_U$ or collapsed position $P_C$ to the flat bench position $P_F$ and then can perform exercises (e.g., bench press) on the bench 4305, 5305, 6305 in this position. To make this positional change in connection with the second embodiment of the exercise apparatus 5050 disclosed herein, the user U removes the cross-bar 5146 from the rear retaining mechanism 5600 by applying a rearward force on the retaining pin 5684 and applying a multi-directional force on the cross-bar 5146 to remove it from the channel 5616. Once removed, the rear support members 5157 can be moved forward and towards the front lateral member 5140. This enables the top end of the bench 5305 to moved downward towards the central member 5125. Then the user U rotates the flat bench supports 5802 into position and couples said supports 5802 to the bench 5305 using the upper retaining mechanism 5810. Once the top of the bench is secure, the user U can then rotate the front of the bench 5305 upward to couple/support the front of the bench 5305 using locking member 5710, which is shown in FIG. 153. Once both the front locking member 5710 and rear locking mechanism 5800 are properly coupled to the bench 5305, the user U can perform the desired flat bench exercises, as shown in FIG. 154.

6) Industrial Design

The above disclosure may represent an improvement in the art because the exercise apparatus 4050, 5050, 6050 allows a user or user to perform a gluteal bridge, typically with resistance, to improve the strength of a user's human posterior hip and gluteal muscles. The exercise apparatus 4050, 5050, 6050 facilitates the performance of a resisted gluteal bridge in a safe, controlled and efficient manner. In particular, the exercise apparatus protects the user's spine by maintaining the lumbar spine in a neutral position throughout the entire range of motion of the exercise, and also allows the motion of the exercise to be concentrated at the user's hip joints. Additionally, the exercise apparatus 4050, 5050, 6050 protects the user's pelvic bones from pressure that occurs when a heavy weight plate, barbell or dumbbells are placed across the upper portion of the user's hips, as done with conventional attempts to perform resisted gluteal bridges. Also, in contrast to other methods discussed above, the exercise apparatus 4050, 5050, 6050 allows the user to perform the resisted gluteal bridge with only one leg or hold the bridge in the hip extended position while "alternately lifting one leg then the other in marching steps."

While some implementations have been illustrated and described, numerous modifications come to mind without significantly departing from the spirit of the disclosure; and the scope of protection is only limited by the scope of the accompanying claims. For example, the pair of rear support members 5147 may have two different lengths: one length may be used in connection with the first through fourth positions, and a second length may be used in connection with fourth (or flat bench) position $P_F$. This may be accomplished using a hinge that is positioned between a lower extent of the rear support members and an upper extent of the rear support members 5147. The upper and lower supports may be coupled to one another using a mechanism that is similar to the mechanism that is described above in connection with front coupler 5780. This configuration would effectively combine the rear locking mechanism 5800 and the pair of rear supports 5157 into a single structure. Additionally, one or more of the above components may be omitted, altered, modified, or replaced with a completely different component.

While the above paragraphs describe some aspects of the front retaining mechanism 5760, rear retaining mechanism 4600, 5600, and upper retaining mechanism 5810, it should be understood that alternate mechanism for securing and maintaining the apparatus 4050, 5050 in their desired positions may be used. For example, one of the following structures may be designed and optimized to replace components of the above retaining mechanisms: (i) a simple spring loaded pin with a grasping element, such as a sphere, attached to one side, (ii) a pin that includes retractable projection (e.g., quick release pin), (iii) a pin that is rotated into a locked position (e.g., ¼ turn), or (iv) other similar structures.

Headings and subheadings, if any, are used for convenience only and are not limiting. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

What is claimed is:

1. An exercise apparatus configured to allow a user to perform a gluteal bridge movement or flat bench exercises, the exercise apparatus being collapsible to facilitate storage during non-use of the exercise apparatus, the exercise apparatus comprising:

a frame assembly having a support member that extends from a lower frame member;

a bench assembly that is pivotally connected to the support member to provide a pivot point about which the bench assembly pivots when a user performs the gluteal bridge movement, wherein the pivot point is in an elevated vertical position relative to the lower frame member; and a stabilization assembly having (i) a front locking member operably connected to the frame assembly, (ii) a front retaining mechanism operably connected to the bench assembly, (iii) a rear locking mechanism operably connected to the frame assembly, and (iv) an upper retaining mechanism operably connected to the bench assembly, wherein the front locking member, the front retaining mechanism, the rear locking mechanism, and the upper retaining mechanism are configured to place the bench in a flat bench position whereupon the user can perform various flat bench exercises.

2. The exercise apparatus of claim 1, wherein the support member removably coupled to a portion of the frame assembly and can be articulated in order to move the bench assembly between (i) a ready to use position where the user can begin to perform the gluteal bridge movement, and (ii) a collapsed position to facilitate storage of the exercise apparatus during its non-use.

3. The exercise apparatus of claim 1, wherein the support member is a rear support member and the frame assembly further includes a front support member that extends from the lower frame member and is pivotally connected to the bench assembly; and wherein the front support member is coupled to the rear support member at a location that is coincident with the pivot point of the bench assembly.

4. The exercise apparatus of claim 3, further comprising a bumper assembly coupled to the front support member and configured to absorb energy that would otherwise be transferred from the bench assembly to the front support member during performance of the gluteal bridge movement.

5. The exercise apparatus of claim 3, wherein a lower extent of the front support member is pivotably connected to a portion of the frame assembly.

6. The exercise apparatus of claim 1, wherein the stabilization assembly further includes a biased front coupler operably connected to the front locking member; and wherein the biased front coupler is configured to removably couple the front locking member to the front retaining mechanism in the flat bench position.

7. The exercise apparatus of claim 1, wherein the frame assembly further includes rear lateral member; and wherein the rear locking mechanism and the upper retaining mechanism are configured to removably couple the bench assembly to the rear lateral member in the flat bench position.

8. The exercise apparatus of claim 1, wherein the frame assembly is configured to be placed on a support surface; and when the exercise apparatus is in the flat bench position, an overall height is defined between the support surface and the top of the bench is less than 18 inches.

9. The exercise apparatus of claim 1, wherein the frame assembly further includes an over-rotation member and the bench assembly further includes an over-rotation projection; and wherein the over-rotation projection and the over-rotation member interact to prevent an interior angle defined between the bench and the support member from exceeding 130 degrees.

10. The exercise apparatus of claim 1, wherein a front extent of the frame assembly has a foot rest surface for the user, wherein said pivot point is in an elevated vertical position relative to the foot rest surface.

11. The exercise apparatus of claim 1, a resistance assembly operably connected to the bench assembly and the frame assembly, said resistance assembly providing a resistance force that the user overcomes in order to move the bench assembly between the ready to use position and an extended position while performing the gluteal bridge movement.

12. The exercise apparatus of claim 11, wherein the resistance assembly includes a resistance band that elastically deforms when the user performs the gluteal bridge movement.

13. The exercise apparatus of claim 12, wherein at least an extent of the resistance band is not positioned beneath the bench.

14. The exercise apparatus of claim 1, wherein the bench assembly underlies and supports the user's spine in a neutral position while the user pivotally moves the bench assembly between the ready to use position and an extended position about said pivot point to perform the gluteal bridge movement.

15. The exercise apparatus of claim 1, wherein in the ready to use position, a lower portion of the bench assembly is positioned above the frame assembly to define a gap there between.

16. The exercise apparatus of claim 1, wherein the frame assembly and the bench assembly are arranged such that the pivot point underlies and is aligned with the user's scapulae while the user pivotally moves the bench between the ready to use position and an extended position.

17. An exercise apparatus configured to allow a user to perform a gluteal bridge movement or flat bench exercises, the exercise apparatus comprising:

a frame assembly having a support member;

a bench assembly that is pivotally connected to the support member to provide an elevated pivot point about which the bench assembly pivots when a user performs a gluteal bridge movement, wherein the bench assembly includes a bench configured to underlie and support a major extent of the user's spine in a neutral position while the user performs the gluteal bridge movement;

a bumper assembly configured to absorb energy that would otherwise be transferred from the bench assembly to the support member during performance of the gluteal bridge movement; and a stabilization assembly having (i) a front locking member operably connected to the support member, (ii) a front retaining mechanism operably connected to the bench assembly, (iii) a rear locking mechanism operably connected to the frame assembly, and (iv) an upper retaining mechanism operably connected to the bench assembly, wherein the front locking member, the front retaining mechanism, the rear locking mechanism, and the upper retaining mechanism are configured to place the bench in a flat bench position.

18. The exercise apparatus of claim 17, wherein the support member is a front support member and the frame assembly further includes a rear support member that is removably coupled to a portion of the frame assembly and can be articulated in order to move the bench assembly between (i) a ready to use position where the user can begin to perform the gluteal bridge movement, and (ii) a collapsed position to facilitate storage of the exercise apparatus during its non-use.

19. The exercise apparatus of claim 17, wherein the support member is a front support member and the frame assembly further includes a rear support member pivotally connected to the bench assembly, wherein the front support member is coupled to the rear support member at a location that is coincident with the elevated pivot point of the bench assembly.

20. The exercise apparatus of claim 17, wherein a lower extent of the support member is pivotably connected to a portion of the frame assembly.

* * * * *